US012759777B2

(12) United States Patent
Buscema et al.

(10) Patent No.: US 12,759,777 B2
(45) Date of Patent: Oct. 13, 2026

(54) ARTICLE CARRIER, SHIPPING CARTON AND PACKAGE SYSTEM

(71) Applicant: WestRock Packaging Systems, LLC, Atlanta, GA (US)

(72) Inventors: Craig W. Buscema, Douglasville, GA (US); Fred S. Foushee, Suwanee, GA (US); Bradford J. Walling, Chesterfield, VA (US); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 540 days.

(21) Appl. No.: 16/962,993

(22) PCT Filed: Jan. 11, 2019

(86) PCT No.: PCT/US2019/013161

§ 371 (c)(1),
(2) Date: Jul. 17, 2020

(87) PCT Pub. No.: WO2019/143527

PCT Pub. Date: Jul. 25, 2019

(65) Prior Publication Data

US 2020/0339330 A1 Oct. 29, 2020

Related U.S. Application Data

(60) Provisional application No. 62/678,482, filed on May 31, 2018, provisional application No. 62/664,618, (Continued)

(51) Int. Cl.
*B65D 71/36* (2006.01)
*B65D 71/14* (2006.01)

(52) U.S. Cl.
CPC ..... *B65D 71/36* (2013.01); *B65D 71/14* (2013.01); *B65D 2301/10* (2013.01); (Continued)

(58) Field of Classification Search
CPC .... B65D 71/36; B65D 71/14; B65D 2301/10; B65D 2571/00141; B65D 2571/00185; (Continued)

(56) References Cited

U.S. PATENT DOCUMENTS 2,022,721 A 12/1935 Hompe
RE24,667 E * 7/1959 Fielding ..... B65D 71/16 206/182

(Continued)

FOREIGN PATENT DOCUMENTS

EP 2096042 A1 9/2009
FR 1589340 3/1970

(Continued)

OTHER PUBLICATIONS

Reynolds Matt: "Devils Backbone Keeps it local, familar," PMMI Media Group Packaging World—Packaging for Craft Brewing, Mar. 2017 (Mar. 2017), pp. 12-16, XP002790637, Chicago IL.

*Primary Examiner* — Andrew D Perreault
(74) *Attorney, Agent, or Firm* — Rohini K. Garg; Brian J. Goldberg; Tsugihiko Suzuki

(57) ABSTRACT

Aspects of the invention provide a package system comprising: at least one secondary packaging container or carrier (790; 1090; 1190; 1290) holding at least one primary container ('B'); a tertiary packaging carton (10; 90; 110; 310; T) holding the at least one secondary packaging container; and a blank (110; 1110; 1210; 1310; 1410; 1510; 1610; 710; 810) for forming the carrier (790; 1090; 1190; 1290). The blank comprising atop or bottom panel which is asymmetrical in shape about a centre axis of the top or bottom panel. The top (Continued)

or bottom panel by itself providing a single-layer top or bottom wall when a carton is erected from the blank. A first free side edge of the blank extends transversely with respect to the centre axis, at least a part of the first free edge being symmetrical about a point of symmetry.

15 Claims, 39 Drawing Sheets

Related U.S. Application Data filed on Apr. 30, 2018, provisional application No. 62/619,342, filed on Jan. 19, 2018.

(52) U.S. Cl.
CPC ..... *B65D 2571/00141* (2013.01); *B65D 2571/00185* (2013.01); *B65D 2571/00277* (2013.01); *B65D 2571/00283* (2013.01); *B65D 2571/0029* (2013.01); *B65D 2571/0066* (2013.01); *B65D 2571/00728* (2013.01); *B65D 2571/00759* (2013.01)

(58) Field of Classification Search
CPC ..... B65D 2571/00277; B65D 2571/00283; B65D 2571/0029; B65D 2571/0066; B65D 2571/00728; B65D 2571/00759; B65D 2571/00993
See application file for complete search history.

(56) References Cited

U.S. PATENT DOCUMENTS

| | | | | |
|---|---|---|---|---|
| 6,550,616 | B2 | 4/2003 | Le Bras | |
| 7,587,883 | B2 | 9/2009 | Cook et al. | |
| 8,011,564 | B2 | 9/2011 | Garner | |
| 2013/0112581 | A1 | 5/2013 | Dominski | |
| 2014/0305938 | A1* | 10/2014 | Jego ..... | B65D 75/20 220/23.4 |

FOREIGN PATENT DOCUMENTS

| | | |
|---|---|---|
| FR | 2082413 | 12/1971 |
| FR | 2781205 | 10/2000 |
| GB | 1558306 A | 12/1979 |
| WO | WO2005113368 | 1/2005 |
| WO | WO2015126800 | 9/2015 |

* cited by examiner

ARTICLE CARRIER, SHIPPING CARTON AND PACKAGE SYSTEM

CROSS-REFERENCE TO RELATED APPLICATIONS

This application is a National Phase application of PCT Application PCT/US19/13161, filed Jan. 11, 2019, which claims the benefit of U.S. Provisional Patent Application No. 62/619,342, filed Jan. 19, 2018, U.S. Provisional Patent Application No. 62/664,618 filed Apr. 20, 2018 and U.S. Provisional Patent Application No. 62/678,482 filed May 31, 2018, which are incorporated herein by reference in their entirety.

TECHNICAL FIELD

The present invention relates to secondary package containers such as, but not limited to, wrap-around carriers. More specifically, but not exclusively, the invention relates to a package system comprising a secondary carrier housing one or more primary product containers and a tertiary shipping carton accommodating a plurality of the secondary carriers.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present invention to provide to a secondary carrier formed from a nestable blank. It is desirable to minimise or reduce the material required to produce the carrier for economic and environmental benefit.

It is desirable to transport the secondary carrier, once loaded with articles, in a tertiary package. The strength of the tertiary package and its suitability for holding and transporting large weights of articles is an important consideration.

The present invention seeks to provide an improvement in the field of packaging by providing a tertiary shipping carton having at least one corner structure and/or at least one mitred corner. Beneficially, the strength and stackability of the shipping carton is thereby improved. Additionally, there is provided a secondary carrier adapted to the mitred corner structure of the tertiary shipping carton so that one, two or more secondary packages can fit within the tertiary shipping carton.

SUMMARY

According to a first aspect of the present disclosure there is provided a combination of a tertiary carton and a plurality of packages received in the tertiary carton wherein the tertiary carton comprises a bottom panel and a plurality of side and end panels each extending upward from the bottom panel to form side and end walls, the plurality of side and end walls including a first side wall and a first end wall disposed at about a right angle with respect to one another, and a bevelled corner panel hingedly connecting between the first side wall and the first end wall, the plurality of packages includes a corner package which comprises a secondary carton having a tubular structure and one or more generally cylindrical primary containers each received at least in part in the secondary carton, the tubular structure comprising a pair of opposing carton side panels, wherein the corner package is disposed with a terminal end e1 thereof facing the inside surface of the first end wall with the tubular axis of the secondary carton thereof extending generally perpendicularly to the first end wall, wherein the secondary carton of the corner package is in contact at one of the carton side panels thereof with the first side wall, and wherein the one or more primary containers of the corner package each is disposed with the cylindrical axis thereof extending generally perpendicularly to the bottom panel, the combination being characterized by the following formula: $a1 \leq \frac{1}{2}d$, $a2 \leq \frac{1}{2}d$ and $a1 \leq b1$ where "d" is the maximum diameter (maximum lateral size) of each of the one or more primary containers, "a1" is the distance between a notional plane containing the inside surface of the first end wall and the fold line F1 between the corner panel and the first end-side wall, "a2" is the distance between a notional plane containing the inside surface of the first side wall and the fold line F2 between the corner panel and the first end wall, and "b1" is the distance between a notional plane containing the terminal end e1 and a maximum width point P1 along an end edge of the one carton side panel adjacent to the corner panel, the maximum width point P1 defining the maximum width of the secondary carton extending between itself and a point on the other carton side panel of the secondary carton, the notional plane containing the terminal end e1 being parallel to or containing the inside surface of the first end wall.

Optionally, the distance a2 is equal to or greater than a distance b2, ($a2 \geq b2$) wherein the distance b2 is a distance between a notional plane containing the maximum width point P1 and a second point P2 on the corner package, the notional plane containing the maximum width point P1 being parallel to or containing the inside surface of the first side wall, the second point P2 being spaced apart from the maximum width point P1, the second point P2 being in contact with the corner panel or closer to the corner panel than any other points on the corner package excluding the maximum width point P1.

Optionally, the second carton of the corner package comprises a bevelled corner edge extending from the maximum width point P1 to the second point P1.

Optionally, the bevelled corner edge is provided by a top panel of the secondary carton of the corner package wherein a retention panel for engaging a primary container is hingedly connected to the bevelled corner edge.

Optionally, the bevelled corner edge is provided by a base panel of the second carton of the corner package wherein an opening for receiving a primary container is defined in the base panel.

Optionally, the bevelled corner edge is parallel to or in contact with the corner panel.

Optionally, the second point P2 on the corner package is located on a corner primary container of the corner package.

Optionally, the distance a1 is equal to or less than 30% of the maximum diameter d ($a1 \leq 0.3d$).

Optionally, the maximum diameter d of each of the one or more primary containers is defined by a cross section of a shape selected from the group consisting of a circle, an elliptic, a squircle and a rounded rectangle.

Optionally, the bevelled corner edge defines an angle x with respect to the notional plane containing the maximum width point P1, the angle x being equal to or greater than 10 degrees.

Optionally, the corner panel defines an angle y2 with respect to the notional plane containing the inside surface of the first side wall, the angle y2 being equal to or greater than the angle x.

Optionally, the corner panel defines an angle y1 with respect to the notional plane containing the inside surface of the first end wall, the angle y1 being equal to or greater than the angle y2.

Optionally, the maximum width point P1 is in contact with the first side wall of the tertiary carton.

Optionally, the maximum width point P1 is located adjacent to the fold line F1 between the corner panel and the first side wall.

Optionally, the terminal end e1 of the corner package is in contact with the first end wall.

Optionally, the second point P2 on the corner package is in contact with the corner panel.

Optionally, the second point P2 on the corner package is located between the fold lines F1 and F2.

Optionally, the second point P2 on the corner package is located adjacent to the fold line F2 between the corner panel and the first end wall.

According to a second aspect of the present disclosure there is provided a blank for forming a carrier comprising a top or bottom panel which is asymmetrical in shape about a centre axis of the top or bottom panel. The top or bottom panel by itself provides a single-layer top or bottom wall when a carton is erected from the blank. A first free side edge of the blank extends transversely with respect to the centre axis. At least a part of the first free edge is symmetrical about a point of symmetry. The top or bottom panel provides at least a part of the first free edge. The blank is nestable with another blank of the same size and configuration such that the symmetrical part of the first free edge of the blank and that of the other blank are formed by a single die cut blade.

Optionally, the symmetrical part of the first free edge is non-linear.

Optionally, the top or bottom panel is disposed over or below only a part of an endmost article.

According to a third aspect of the present disclosure there is provided a package comprising an article carrier and one or more articles, the article carrier being formed from the blank of the foregoing paragraphs, wherein the top or bottom panel is placed on or below, respectively, one of the opposite ends of said one or more articles and wherein said one or more articles are each generally columnar in shape.

According to a fourth aspect of the present disclosure there is provided a package system comprising the combination of one or more secondary carriers each including one or more primary product containers and a tertiary package loaded with said one or more secondary carriers. The tertiary package comprises mitred corners provided by one or more corner panels. Each of the one or more secondary carriers comprises a top panel having opposing side edges. A first side edge has a first length and a second edge has a second length, the second length is less than the first length.

According to a fifth aspect of the present disclosure there is provided a package comprising an arrangement of a plurality of secondary carriers each comprising one or more articles and loaded within a tertiary carton. The secondary carriers each have a front end horizontal dimension which is less than a rear end horizontal dimension. At least two adjacent secondary carriers are disposed in a back-to-back contacting relationship within the tertiary package.

According to a sixth aspect of the present disclosure there is provided a secondary package comprising a secondary carrier loaded with a group of articles. The secondary carrier comprises a plurality of panels forming tubular structure having a tubular axis. The plurality of panels includes a top panel hinged to a first side panel along a first fold line having a first length dimension. The group of articles defines a second length dimension in a longitudinal direction along the tubular axis of the secondary carrier. The second length dimension is substantially equal to the first length dimension. The top panel is hinged to a second side panel along a second fold line having a third length dimension. The third length dimension is less than the first and second length dimensions. The group of articles comprises a first article at a first end of the tubular structure and a second article at a second end of the tubular structure. The centre of the first article is spaced a distance from the centre of the second article. The third length dimension is greater than the distance between the centres of the first and second articles.

Further features and advantages of the present invention will be apparent from the specific embodiments illustrated in the drawings and discussed below.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the present disclosure will now be described with reference to the accompanying drawings, in which.

DETAILED DESCRIPTION OF EMBODIMENTS

Detailed descriptions of specific embodiments of the package system, shipping cartons, secondary carriers and blanks are disclosed herein. It will be understood that the disclosed embodiments are merely examples of the way in which certain aspects of the invention can be implemented and do not represent an exhaustive list of all of the ways in which the invention may be embodied. As used herein, the word "exemplary" is used expansively to refer to embodiments that serve as illustrations, specimens, models, or patterns. Indeed, it will be understood that the package system, shipping cartons, secondary carriers and blanks described herein may be embodied in various and alternative forms. The Figures are not necessarily to scale, and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "secondary package", "tertiary package", "carton" and "carrier" refer, for the non-limiting purpose of illustrating the various features of the invention, to a container for engaging, carrying, and/or dispensing articles, such as secondary packages or primary product containers. It is contemplated that the teachings of the invention can be applied to various primary product containers, which may or may not be tapered and/or cylindrical. Optional containers include cups, pots having a foil or film lid, bottles (for example metallic, glass or plastics bottles), cans (for example aluminium cans), tins, pouches, packets and the like.

Figure 24:
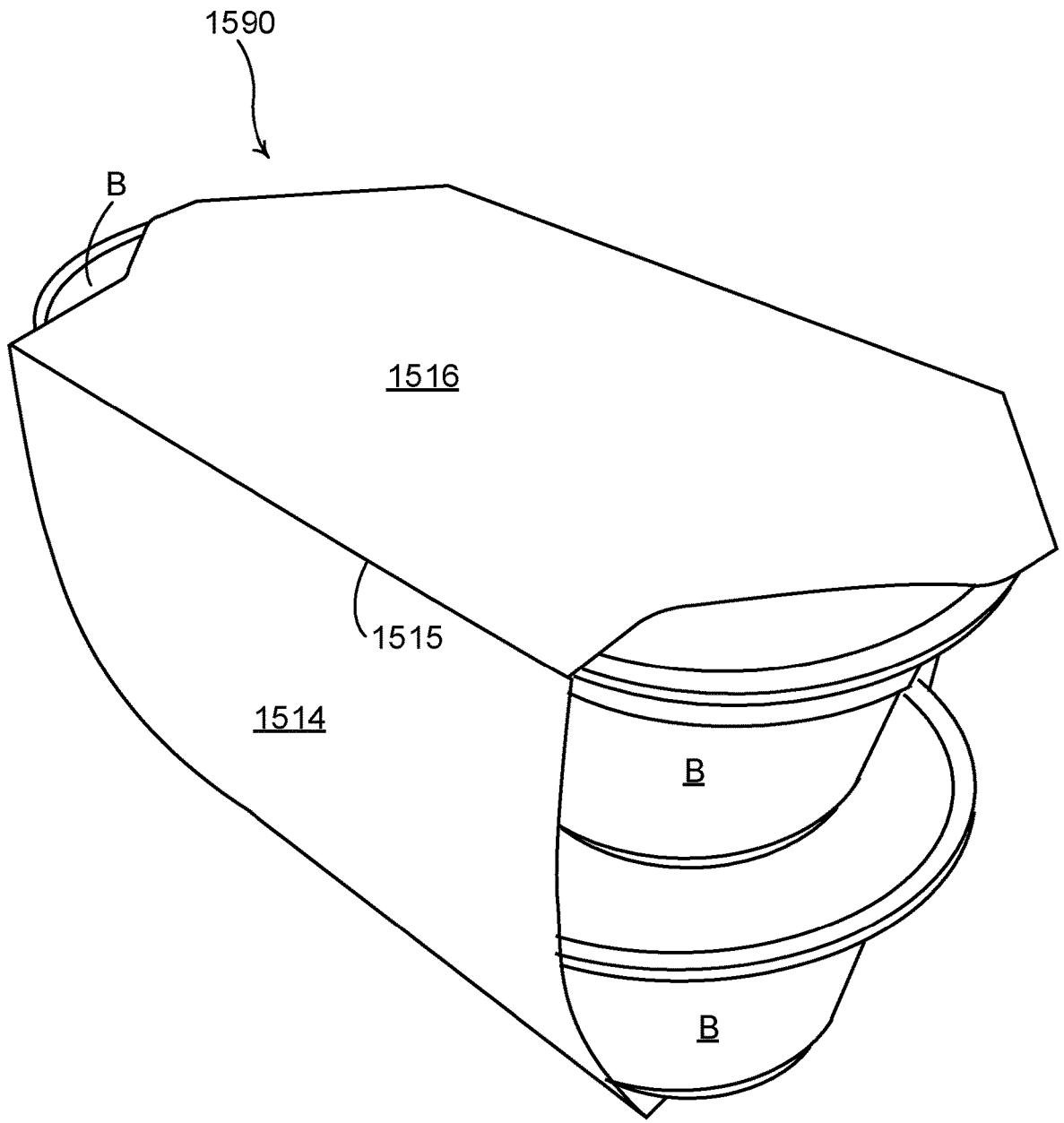
FIG. 24 is a perspective view from above of a first side of a secondary package comprising a secondary carrier formed from the blank of FIG. 23 loaded with a group of primary product containers or articles.
Figure 25:
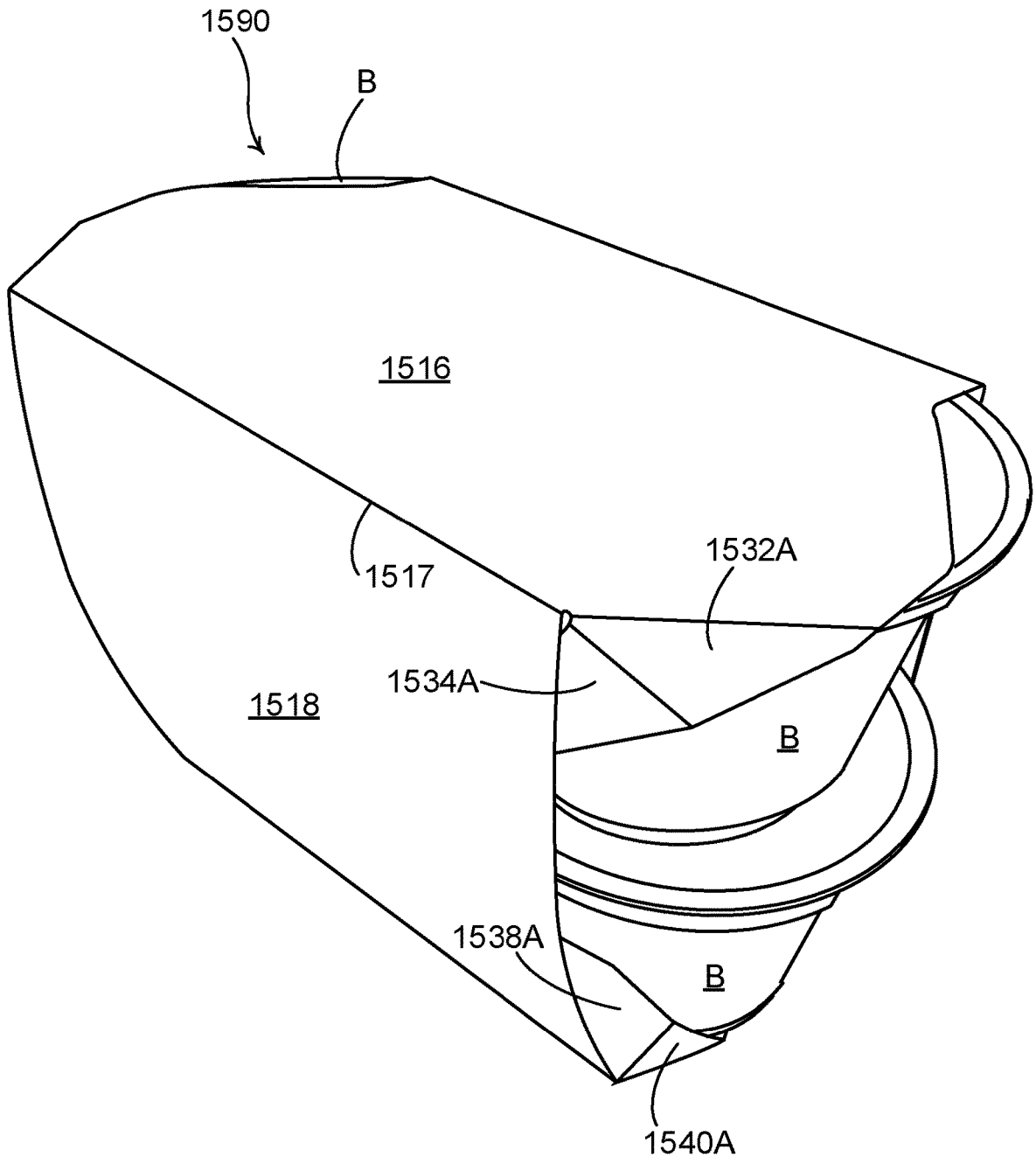
FIG. 25 is a perspective view from above of a second side of a secondary package comprising a secondary carrier formed from the blank of FIG. 23 loaded with a group of primary product containers or articles.

A package system is disclosed herein (see FIG. 14, 15) that comprises a tertiary shipping carton 90; 190; 290; 390 (see FIGS. 2, 17, 18 and 28), a secondary package in the form of a wrap-around style carrier 1090; 1190; 1290; 1390; 1490; 1590; 1690 (see FIGS. 4, 8, 12, 20, 22, 24, 25, 27); and a plurality of articles 'B', arranged in groups and held within each secondary carrier 1090; 1190; 1290; 1390; 1490; 1590; 1690. The tertiary shipping cartons 90; 190; 390 are formed from blanks 10; 110, 310 (see FIGS. 1, 16 and 28) formed from a sheet of suitable substrate; and the secondary carriers 1090; 1190; 1290; 1390; 1490; 1590; 1690 are formed from blanks 1010; 1110; 1210; 1310; 1410; 1510; 1610 (see FIGS. 3, 7, 10, 19, 21, 23 and 26) formed from a sheet of suitable substrate. The blanks 10; 110; 1010; 1110; 1210; 1310; 1410; 1510; 1610 may be formed from the same or from different substrates. A further package system is disclosed herein (see FIG. 30) that comprises a tertiary shipping carton 90 (see FIG. 2), a secondary package in the form of a wrap-around style carrier 1690 (see FIGS. 24, 25); and a plurality of articles 'B', arranged in groups and held within each secondary carrier 1690.

It is to be understood that, as used herein, the term "suitable substrate" includes all manner of foldable sheet material such as paperboard, corrugated board, fluted board, cardboard, plastic, combinations thereof, and the like that may be coated, uncoated, printed or not printed. It should be recognised that one or other numbers of blanks may be employed, where suitable, for example, to provide the structures described in more detail below. Optionally, the blanks 1010; 1110; 1210; 1310; 1410; 1510; 1610 for forming the secondary carrier 1090; 1190; 1290; 1390; 1490; 1590; 1690 may be formed from a paperboard that is bleached, coated and printed on one surface thereof and which is not bleached, coated or printed on the other (inside) surface thereof ("the brown side") such as, but not limited to, coated recycled board (CRB), clay-coated news back (CCNB), clay-coated kraftboard (CCKB), solid bleached board (SBB) or solid bleached sulphate (SBS). Optionally, the blanks 10; 110; 310 for forming the shipping cartons 90; 190; 290; 390 are formed from a corrugated board which provides structural rigidity and stacking strength such that the shipping cartons 90; 190; 290; 390 can accommodate a heavy load of articles.

The packaging structures or carton described herein may be formed from a sheet material such as paperboard, which may be made of or coated with materials to increase its strength. An example of such a sheet material is tear-resistant NATRALOCK@ paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In an illustrated and optional embodiment, the blanks 1010, 1110; 1210; 1310; 1410; 1510; 1610 are configured to form a wrap-around style carrier 1090; 1190; 1290; 1390; 1490; 1590; 1690 for packaging an optional arrangement of articles. In this illustrated embodiment, the arrangement is an m×n×t matrix or array, having one row (m=1), two columns (n=2) and arranged in two tiers (t=2); in the illustrated embodiment four articles are arranged in single row having two tiers of two articles B, and the articles B are individual 5.3 oz cups with a cover or film lid formed from a metallic or plastic material such as, but not limited to, aluminium or PET (polyester-polyethylene terephthalate). The blanks 1010, 1110; 1210; 1310; 1410; 1510; 1610 can be alternatively configured to form a carrier for packaging other types, number and size of article and/or for packaging articles in a different arrangement or configuration.

In the illustrated and optional embodiments, the blanks 10; 110; 310 are configured to form a shipping carton 90; 190; 390 that can optionally accommodate six secondary carriers 1090; 1190; 1290; 1390; 1490; 1590; 1690 arranged in a 2×3 matrix or array; and as such the shipping carton 90; 190; 390 may comprise 24, 5.3 oz cups 'B'. The shipping carton 290 is adapted to accommodate four secondary carriers 1090; 1190; 1290; 1390; 1490; 1590; 1690 arranged in a 2×2 matrix or array; and as such the shipping carton 290 may comprise 16, 5.3 oz cups 'B'. Accordingly, the package system accommodates a significant load.

Figure 1:
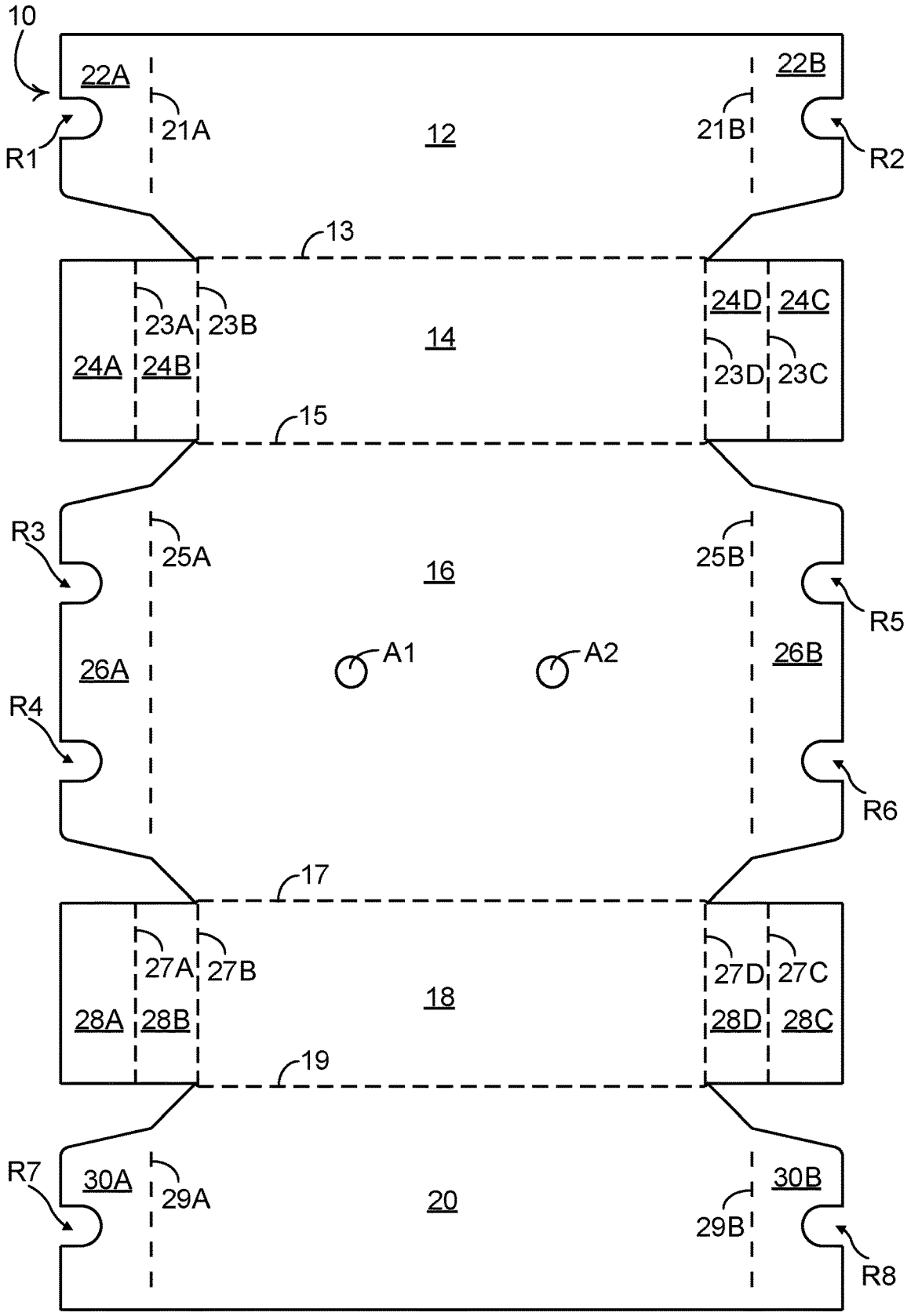
FIG. 1 is a plan view from above of a blank for forming a tertiary package or shipping carton according to various embodiments of the invention.

Referring now to FIG. 1, the blank 10 comprises a series of main panels for forming the main walls of a tertiary package or shipping carton 90. The series of main panels comprises: a first top panel 12, a first side panel 14, a base panel 16, a second side panel 18 and a second top panel 20. Optionally, the series of main panels 12, 14, 16, 18, 20, are hinged together in a linear series by hinged connections in the form of fold lines 13, 15, 17, 19.

The plurality of main panels 12, 14, 16, 18, 20 of the blank 10 form walls of a tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment the ends of the tubular structure are fully closed by end closure panels 22*a*, 24*a*, 24*b*, 26*a*, 28*a*, 28*b*, 30*a*, 22*b*, 24*c*, 24*d*, 26*b*, 28*c*, 28*d*, 30*b*.

End closure panels 22*a*, 24*a*, 24*b*, 26, 28*a*, 28*b*, 30*a* are configured to close a first end of the tubular structure and end closure panels 22*b*, 24*c*, 24*d*, 26*b*, 28*c*, 28*d*, 30*b* are configured to close a second end of the tubular structure.

The first end of the tubular structure is closed by a first end closure panel 22*a*, a second end closure panel 24*a*, a first corner panel 24*b*, a third end closure panel 26*a*, a fourth end closure panel 28*a*, a second corner panel 28*b* and a fifth end panel 30*a*. The first end closure panel 22*a* is hinged to a first end of the first top panel 12 by a hinged connection such as a fold line 21*a*. The second end closure panel 24*a* is hinged to a first end of a first corner panel 24*b* by a hinged connection such as a fold line 23*a*. The first corner panel 24*b* is hinged to a first end of the first side panel 14 by a hinged connection such as a fold line 23*b*. The third end closure panel 26*a* is hinged to a first end of the base panel 16 by a hinged connection such as a fold line 25*a*. The fourth end closure panel 28*a* is hinged to a first end of a second corner panel 24*b* by a hinged connection such as a fold line 27*a*. The second corner panel 24*b* is hinged to a first end of the second side panel 18 by a hinged connection such as a fold line 23*b*. The fifth end closure panel 30*a* is hinged to a first end of the second top panel 20 by a hinged connection such as a fold line 29*a*.

The second end of the tubular structure is closed by a sixth end closure panel 22*b*, a seventh end closure panel 24*c*, a third corner panel 24*d*, an eighth end closure panel 26*b*, a ninth end closure panel 28*c*, a fourth corner panel 28*d* and a tenth end closure panel 30*b*. The sixth end closure panel 22*b* is hinged to a second end of the first top panel 12 by a hinged connection such as a fold line 21*b*. The seventh end closure panel 24*c* is hinged to a second end of a third corner panel 24*d* by a hinged connection in the form of a fold line 23*c*. The third corner panel 24*d* is hinged to a second end of the first side wall panel 14 by a hinged connection such as a fold line 23*d*. The eighth end closure panel 26*b* is hinged to a second end of the base panel 16 by a hinged connection such as a fold line 25*b*. The ninth end closure panel 28*c* is hinged to a second end of a fourth corner panel 28*d* by a hinged connection in the form of a fold line 27*c*. The fourth corner panel 24*d* is hinged to a second end of the second side wall panel 18 by a hinged connection such as a fold line 27*d*. The tenth end closure panel 30*b* is hinged to a second end of the second top panel 20 by a hinged connection such as a fold line 29*b*.

The first end closure panel 22*a* and the fifth end closure panel 30*a* each form upper end closure panels at the first end of the tubular structure. The sixth end closure panel 22*b* and the tenth end closure panel 30*b* each form upper end closure panels at the second end of the tubular structure.

The third end closure panel 26*a* and the eighth end closure panel 26*b* each form a lower end closure panel at opposing ends of the tubular structure.

The second end closure panel 24*a* and the fourth end closure panel 28*a* each form a minor side end closure panel or dust flap at the first end of the tubular structure. The seventh end closure panel 24*c* and the ninth end closure panel 28*c* each form a minor side end closure panel or dust flap at the second end of the tubular structure.

Optionally, the first end closure panel 22*a* comprises a cutaway in the form of a first recess R1 struck from a free end edge opposing the hinged connection between the first end closure panel 22*a* and the first top panel 12.

Optionally, the sixth end closure panel 22*b* comprises a cutaway in the form of a second recess R2 struck from a free end edge opposing the hinged connection between the sixth end closure panel 22*b* and the first top panel 12.

Optionally, the third end closure panel 26*a* comprises a pair of cutaways in the form of a third recess R3 and a fourth recess R4 struck from a free end edge opposing the hinged connection between the third end closure panel 26*a* and the base panel 16.

Optionally, the eighth end closure panel 26*b* comprises a pair of cutaways in the form of a fifth recess R5 and a sixth recess R6 struck from a free end edge opposing the hinged connection between the eighth end closure panel 26*b* and the base panel 16.

Optionally, the fifth end closure panel 30*a* comprises a cutaway in the form of a seventh recess R7 struck from a free end edge opposing the hinged connection between the fifth end closure panel 30*a* and the second top panel 20.

Optionally, the tenth end closure panel 30*b* comprises a cutaway in the form of an eighth recess R8 struck from a free end edge opposing the hinged connection between the tenth end closure panel 30*b* and the second top panel 20.

The first and third recesses R1, R3 may be arranged to form a first opening in the first end of the shipping carton 90 when in a set-up condition. The fourth and seventh recesses R4, R7 may be arranged to form a second opening in the first end of the shipping carton 90 when in a set-up condition.

The second and fifth recesses R2, R5 may be arranged to form a third opening A3 (see FIG. 2) in the second end of the shipping carton 90 when in a set-up condition. The sixth and eighth recesses R6, R8 may be arranged to form a fourth opening A4 (see FIG. 2) in the second end of the shipping carton 90 when in a set-up condition.

Optionally, the base panel 16 comprises a pair of apertures A1, A2.

The first, second, third and fourth openings together with the pair of apertures A1, A2 in the base panel 16 may provide ventilation orifices.

Figure 2:
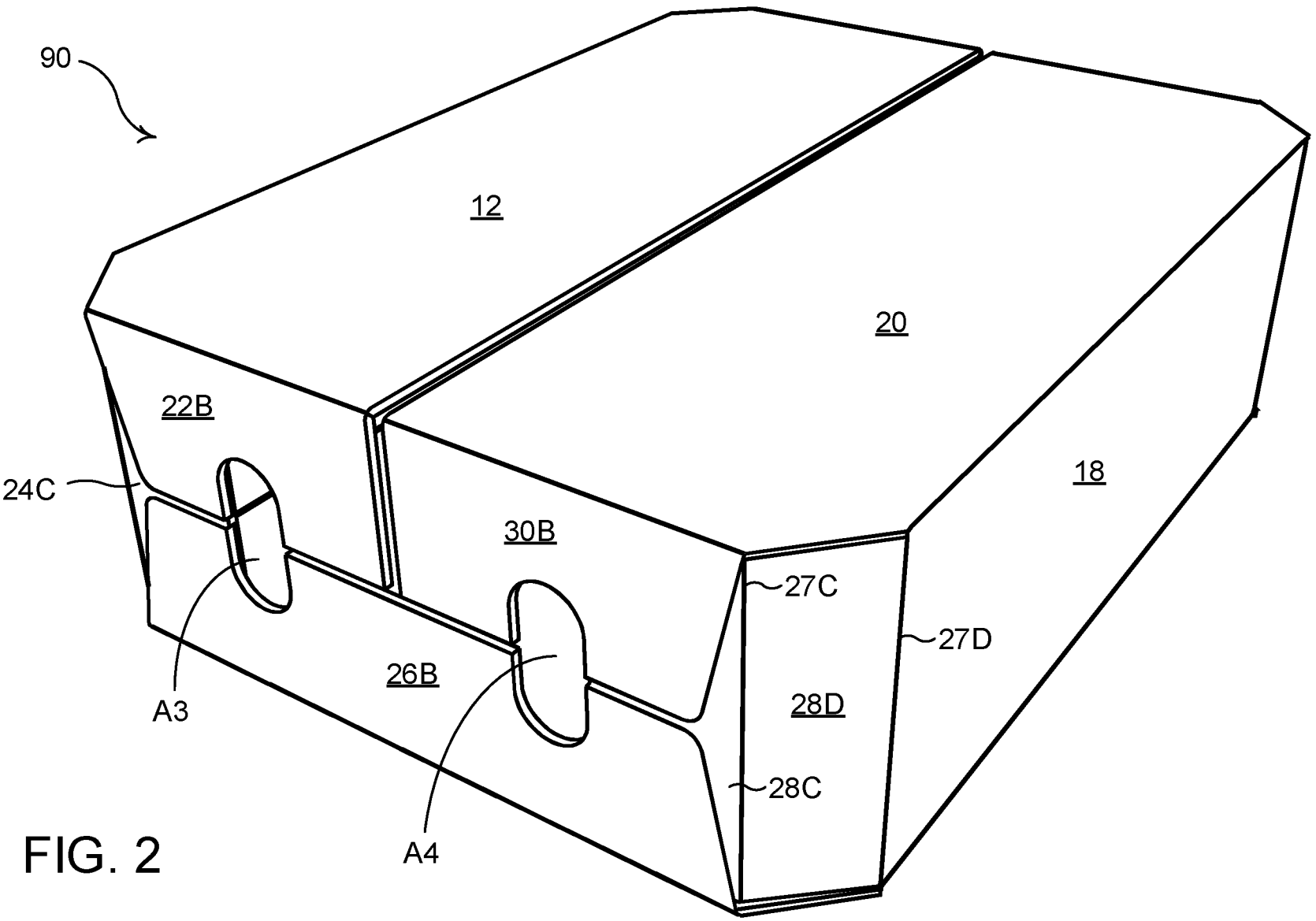
FIG. 2 is a perspective view from above of a tertiary package constructed from the blank of FIG. 1.

Turning to the construction of the shipping carton 90 as illustrated in FIG. 2, it is envisaged that the shipping carton 90 can be formed by a series of sequential folding operations in a straight-line machine so that the shipping carton 90 is not required to be rotated or inverted to complete its construction. The folding process is not limited to that described below and may be altered according to particular manufacturing requirements.

Figure 14:
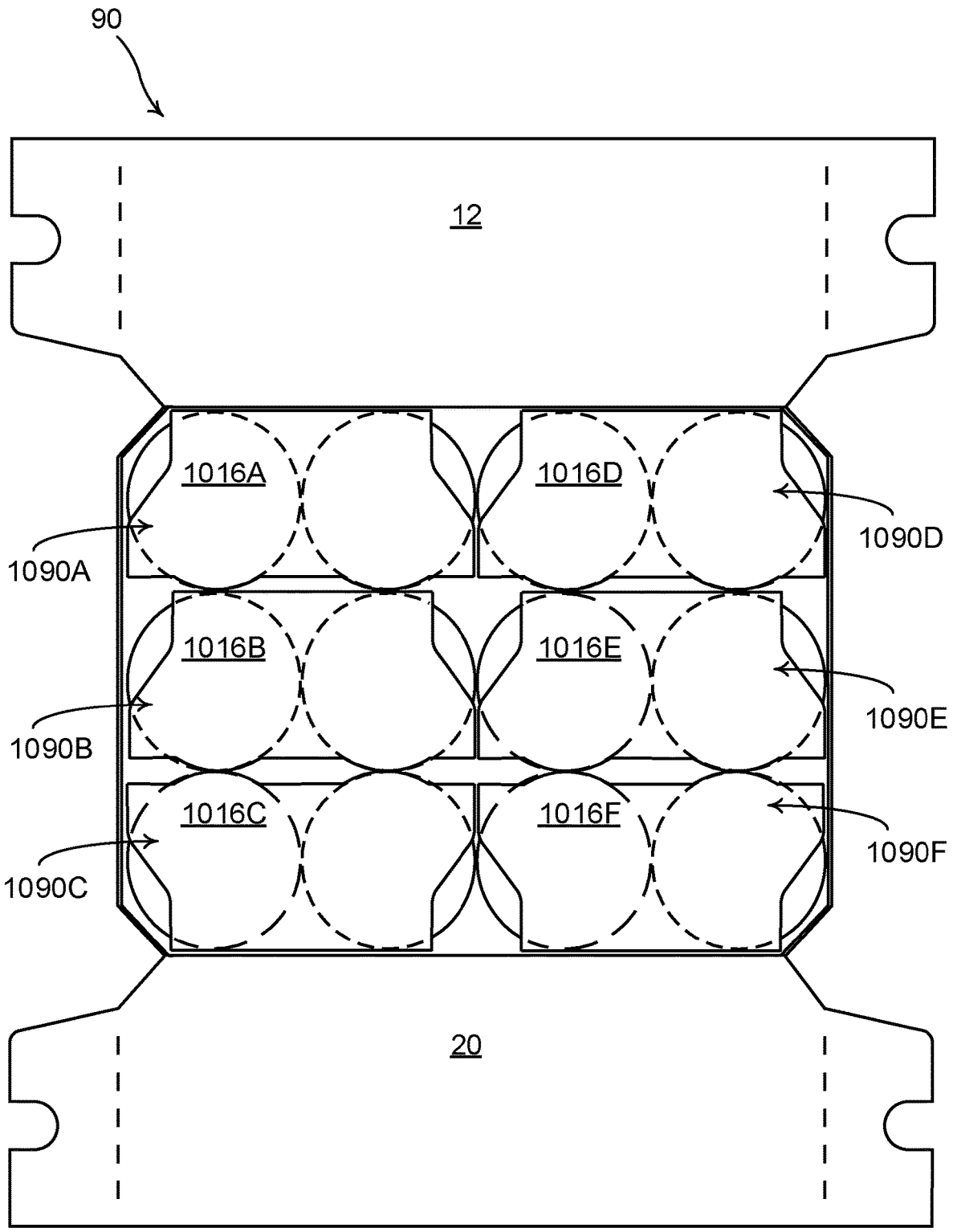
FIG. 14 is a top view of a stage of construction of a package system comprising the shipping carton of FIG. 2, loaded with a first arrangement of a plurality of secondary carriers of FIG. 4 (each secondary carrier being loaded with a plurality of primary product containers)

The shipping carton 90 may be formed into a tray open at the upper end as shown in FIG. 14. The tray may then be loaded with secondary packages 1090A, 1090B, 1090C, 1090D, 1090E, 1090F.

Alternatively, a group of secondary packages 1090A, 1090B, 1090C, 1090D, 1090E, 1090F may be placed upon the base panel 16 of the blank 10, the shipping carton 90 may assembled or wrapped about the group of secondary packages 1090A, 1090B, 1090C, 1090D, 1090E, 1090F.

In order to form the tray shown in FIG. 14 the first side panel 14 (together with the first top panel 12) is folded with respect to the base panel 16 about fold line 15 so as to be substantially perpendicular with the base panel 16. The second side panel 18 (together with the second top panel 20) is folded with respect to the base panel 16 about fold line 17 so as to be substantially perpendicular with the base panel 16.

The first corner panel 24*b* is folded with respect to the first side panel 14 about fold line 23*b* and the second end closure panel 24*a* is folded with respect to the first corner panel 24*b* about fold line 23*a* such that the second end closure panel 24*a* is oriented substantially perpendicular with the first side panel 14.

The second corner panel 28*b* is folded with respect to the second side panel 18 about fold line 27*b* and the fourth end closure panel 28*a* is folded with respect to the second corner panel 28*b* about fold line 27*a* such that the fourth end closure panel 28*a* is oriented substantially perpendicular with the second side panel 18.

Glue G or other adhesive treatment is applied to an outer surface of the second end closure panel 24*a* and to an outer surface of the fourth end closure panel 28*a*. Alternatively, glue G or other adhesive treatment may be applied to a corresponding portion of an inner surface of the third end closure panel 26*a*.

The third end closure panel 26*a* is folded with respect to the base panel 16 about fold line 25*a* to be brought into face contacting relationship with the second and fourth end closure panels 24*a*, 28*a*.

The third end closure panel 26*a* is secured to the second and fourth end closure panels 24*a*, 28*a*.

The third corner panel 24*d* is folded with respect to the first side panel 14 about fold line 23*d* and the seventh end closure panel 24*c* is folded with respect to the third corner panel 24*d* about fold line 23*c* such that the seventh end closure panel 24*c* is oriented substantially perpendicular with the first side panel 14.

The fourth corner panel 28*d* is folded with respect to the second side panel 18 about fold line 27*d* and the ninth end closure panel 28*c* is folded with respect to the fourth corner panel 28*d* about fold line 27*c* such that the ninth end closure panel 28*c* is oriented substantially perpendicular with the second side panel 18.

Glue G or other adhesive treatment is applied to an outer surface of the seventh end closure panel 24*c* and to an outer surface of the ninth end closure panel 28*c*. Alternatively, glue G or other adhesive treatment may be applied to a corresponding portion of an inner surface of the eighth end closure panel 26*b*.

The eighth end closure panel 26*b* is folded with respect to the base panel 16 about fold line 25*b* to be brought into face contacting relationship with the seventh and ninth end closure panels 24*c*, 28*c*.

The eighth end closure panel 26*b* is secured to the seventh and ninth end closure panels 24*c*, 28*c*.

Optionally, the first top panel 12 (together with the first and sixth end closure panels 22*a*, 22*b*) may be folded outwardly, as shown in FIG. 14 to facilitate loading through the upper open end.

Optionally, the second top panel 20 (together with the fifth and tenth end closure panels 30*a*, 30*b*) may be folded outwardly, as shown in FIG. 14 to facilitate loading through the upper open end.

Construction of the loaded shipping carton 90 is completed by folding the first and second top panels 12, 20 (together with the first and sixth end closure panels 22*a*, 22*b* and the fifth and tenth end closure panels 30*a*, 30*b*) inwardly over the group of secondary packages 1090A, 1090B, 1090C, 1090D, 1090E, 1090F.

Glue G or other adhesive treatment is applied to an upper portion of the outer surface of the second end closure panel 24*a* and to an outer surface of the fourth end closure panel 28*a*. Alternatively, glue G or other adhesive treatment may be applied to a corresponding portion of an inner surface of the first and fifth end closure panels 22*a*, 30*a*.

The first and fifth end closure panels 22*a*, 30*a* are folded with respect to the one of first and second top panels 12, 20 to which they are hinged, about fold lines 21*a*, 29*a* respectively. The first end closure panel 22*a* is brought into face contacting relationship with the second end closure panel 24*a*. The first end closure panel 22*a* is secured the second end closure panel 24*a*.

The fifth end closure panel 30*a* is brought into face contacting relationship with the fourth end closure panel 28*a*. The fifth end closure panel 30*a* is secured the fourth end closure panel 28*a*.

Glue G or other adhesive treatment is applied to an upper portion of the outer surface of the seventh end closure panel 24*c* and to an outer surface of the ninth end closure panel 28*c*. Alternatively, glue G or other adhesive treatment may be applied to a corresponding portion of an inner surface of the sixth or tenth end closure panels 22*b*, 30*b*.

The sixth and tenth end closure panels 22*b*, 30*b* are folded with respect to the one of first and second top panels 12, 20 to which they are hinged, about fold lines 21*b*, 29*b* respectively. The sixth end closure panel 22*b* is brought into face contacting relationship with the seventh end closure panel 24*c*. The sixth end closure panel 22*b* is secured the seventh end closure panel 24*c*.

The tenth end closure panel 30*b* is brought into face contacting relationship with the ninth end closure panel 28*c*. The tenth end closure panel 30*b* is secured the ninth end closure panel 28*c*.

The completed shipping carton 90 is shown in FIG. 2. The first and second top panels 12, 20 may be dimensioned such that a gap or slot is provided therebetween, the gap may extend across the top wall 12/20 of the shipping carton 90 formed by the first and second top panels 12, 20. The gap may provide a further ventilation access to the shipping carton 90.

The first and fifth end closure panels 22*a*, 30*a*, similarly the sixth and tenth end closure panels 22*b*, 30*b*, may be dimensioned such that a gap or slot is provided therebetween. The gap may provide a further ventilation access to the shipping carton 90.

Figure 3:
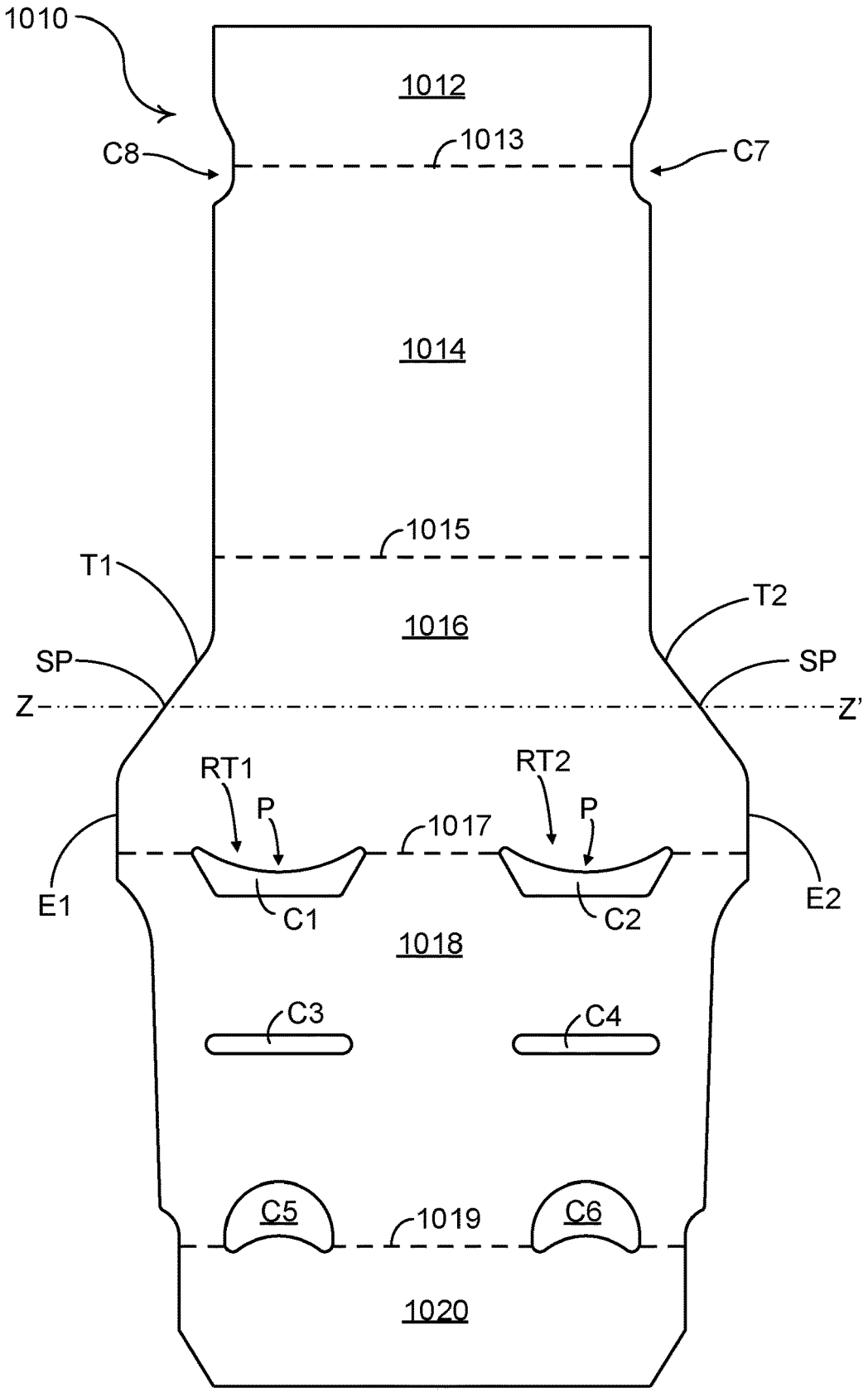
FIG. 3 is a plan view from above of a blank for forming a carrier of a secondary package according to a first embodiment.

Turning now to FIG. 3, there is illustrated a blank 1010 for forming a secondary package or article carrier 1090 (see FIG. 4) according to a first embodiment. The blank 1010 comprises a plurality of main panels 1012, 1014, 1016, 1018, 1020 for forming a tubular structure. The plurality of main panels 1012, 1014, 1016, 1018, 1020 comprises a first base panel (or outer layer) 1012, a first side panel 1014, a top panel 1016, a second side panel 1018 and a second base panel or securing flap (or inner layer) 1020. The plurality of panels 1012, 1014, 1016, 1018, 1020 may be arranged in a linear series hinged one to the next by corresponding fold lines 1013, 1015, 1017, 1019.

The term "top panel" as used herein refers to a panel that is placed upon one of the opposite ends of the primary products containers or articles B each having a generally columnar shape. The "top panel" provides a cover over at least a portion of the packaged article B in normal use. The term "base panel" as used herein refers to a panel that is placed below one of the opposite ends of the primary products containers or articles B or below a flange or protrusion of a primary products container or article B such that an upper surface supports the packaged article B in normal use. The primary products containers or articles B which are packaged by the secondary carrier 1090 are generally columnar in shape. The term "generally columnar shape" as used herein includes, but is not limited to, a generally truncated conical shape, generally truncated pyramidal shape, generally cylindrical shape, generally prismatic shape and the other similar shapes.

In some embodiments, the term "base panel" may refer to a panel disposed below a flange or skirt of an article B such that the article B can be suspended or supported therefrom.

Figure 4:
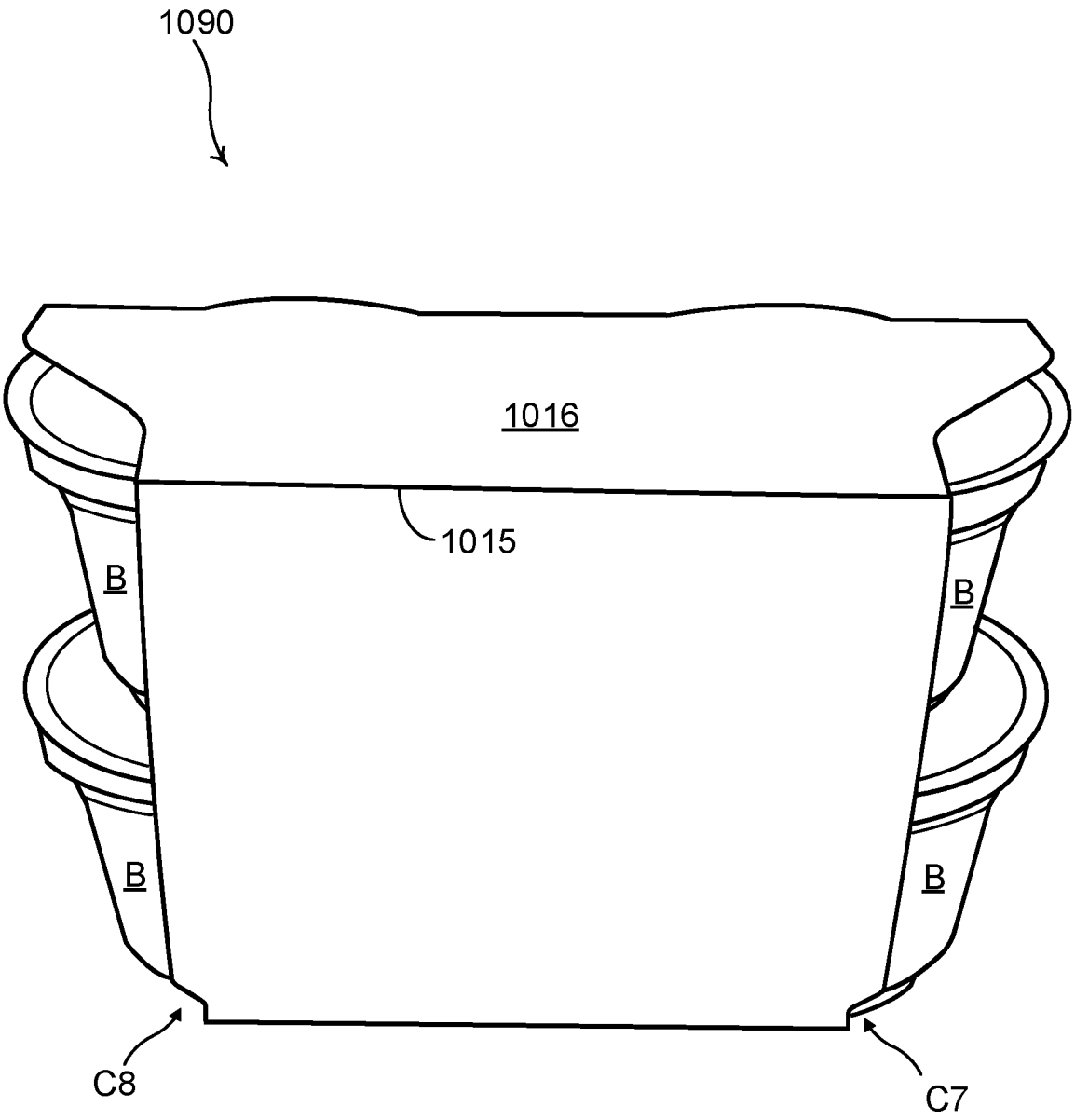
FIG. 4 is a perspective view from above of a secondary package comprising a secondary carrier formed from the blank of FIG. 3 loaded with a group of primary product containers or articles.

The blank 1010 is foldable to form a package 1090 as illustrated in FIG. 4. The first and second base panels 1012, 1020 are engageable with one another in an overlapping relationship to form a composite base wall 1012/1020 of the carrier 1090. The first and second base panels 1012, 1020 may be adhesively secured to each other. Alternatively, the blank 1010 may comprise a complementary locking mechanism for securing the first base panel 1012 to the second base panel 1020 or may be secured by use of a mechanical fixing such as, but not limited to, staples.

The blank 1010 is adapted to accommodate four articles B arranged in a 1×2×2 matrix or array. That is to say, the blank 1010 is arranged to accommodate two tiers of two adjacently disposed articles B. The blank 1010 comprises at least one top retention structure RT1, RT2 for engaging an article B disposed in the uppermost tier. The blank 1010 illustrated in FIG. 3 comprises two top retention structures RT1, RT2 for engaging each article B disposed in the uppermost tier.

Each of the top engaging structures RT1, RT2 comprises an opening C1, C2 respectively. Each opening C1, C2 is struck, at least in part, from the second side panel 1018. Optionally, the openings C1, C2 interrupt the fold line 1017 between the top panel 1016 and the second side panel 1018. When the second side panel 1018 is folded with respect to the top panel 1016, about fold line 1017, the openings C1, C2 can receive a portion of a respective article B. In the illustrated embodiment the openings C1, C2 each receive a flange of an article B.

The openings C1, C2 each define, in part a protrusion P extending from the side edge of the top panel 1016 and integral therewith. The protrusions P are struck from material which would otherwise form the second side panel 1018. In this way, protrusions P may be considered to be struck from the second side panel 1018. The protrusions P each form a protective top cover for a portion of an article B which is received in the openings C1, C2.

The blank 1010 comprises at least one top engaging structure C3, C4 for engaging an article B disposed in a lower tier. The blank 1010, as illustrated in FIG. 3, comprises two top engaging structures C3, C4 for engaging each article B disposed in the lower tier.

In the illustrated embodiment the blank 1010 comprises two top engaging structures C3, C4 for engaging each article B disposed in the bottom or lowermost tier. It will be appreciated that in article carriers arranged to accommodate more than two tiers further top engaging structures may be provided.

The top engaging structures C3, C4 each comprise a cutaway in the form of an aperture or slot struck from, or defined in, the second side panel 1018. In other embodiments, the top engaging structures C3, C4 may take alternative forms such as but not limited to one or more displaceable tabs defined, at least in part, by one or more cut lines. The tabs may be displaceable to form an opening in the second side panel 1018 for receiving a portion of an article B. The one or more tabs may each comprise an engaging edge for engagement with the article B.

The blank 10 may comprise at least one heel engagement structure C5, C6 for engaging with a heel or lower portion of an article B. The blank 1010 illustrated in FIG. 3 comprises two heel engagement structures C5, C6 each is provided for engaging a respective article B disposed in the lowermost tier.

Each of the heel engagement structures C5, C6 comprises an opening or aperture struck, at least in part, from the second side panel 1018. Optionally, the openings C1, C2 interrupt the fold line 1019 between the base panel 1020 and the second side panel 1018. When the second side panel 1018 is folded with respect to the base panel 1020, about fold line 1019, the openings C5, C6 can receive a portion of a respective article B. In the illustrated embodiment the openings C5, C6 each receive a lower portion or heel of an article B.

The openings C5, C6 each define, in part a protrusion extending from the side edge of the base panel 1020 and integral therewith. The protrusions P are struck from material which would otherwise form the second side panel 1018. In this way, protrusions P may be considered to be struck from the second side panel 1018. The protrusions P each form a protective base for a portion of an article B which is received in the openings C5, C6.

Optionally, the blank 1010 comprises a first cutaway C7 in the form of a recess struck from a portion of a first free end edge of the first side panel 1014 and from a portion of a first free end edge of the first base panel 1012. Optionally, the blank 1010 comprises a second cutaway C8 in the form of a recess struck from a portion of a second free end edge of the first side panel 1014 and from a portion of a second free end edge of the first base panel 1012. In this way the fold line 1013 hinging the first base panel 1012 to the first side panel 1014 terminates at each end at one of the first and second cutaways C7, C8.

The first and second cutaways C7, C8 may be shaped so as to be complementary or similar in shape to a lower portion or heel of the articles B being packaged, best illustrated in FIG. 4.

Turning to the construction of the article carrier 1090 as illustrated in FIG. 4, it is envisaged that the article carrier 1090 can be formed by a series of sequential folding operations in a straight-line machine so that the article carrier 1090 is not required to be rotated or inverted to complete its construction. The folding process is not limited to that described below and may be altered according to particular manufacturing requirements.

A group of articles B is assembled; in the embodiment illustrated in FIG. 2 four articles B are arranged in two tiers of two articles. The top panel 1016 of the blank 10 is disposed above the group of articles B to provide a top wall 1016 of the article carrier 1090.

The first and second side walls 1014, 1018 are folded, with respect to the top panel 1016 about fold lines 1015, 1017 respectively, about opposing sides of the group of articles B so as to be disposed about the opposing sides of the group of articles B, as shown in FIG. 4. A flange or skirt of each article B in the upper tier is received in a respective one of the openings C1, C2 of the retention structures RT1, RT2. A flange or skirt of each article B in the lower tier is received in a respective one of the openings of the top engaging structures C3, C3.

The second base panel 1020 is folded about the fold line 1019 so as to be disposed adjacent the base of the group of articles B.

Glue G or other adhesive treatment is applied to an outer surface of the second base panel 1020. Alternatively, glue G or other adhesive treatment may be applied to a corresponding portion of an inner surface of the first base panel 1012.

The first base panel 1012 is folded about the fold line 1013 so as to be disposed adjacent the base of the group of articles B. At least a portion of first base panel 1012 is brought into face contacting relationship with the second base panel 1020.

The first base panel 1012 is secured to the second base panel 1020.

The assembled article carrier 1090 is shown in FIG. 4.

The flange F of each article B has been at least partially received in the opening of a retention structure RT1, RT2 or of a top engaging structure C3, C4. In the illustrated embodiment the articles B are disconnected or individual cups which are disposed in close proximity to their adjacent neighbours. The articles B are tapered in shape, they can be considered to be substantially frusto-conical in shape, albeit inverted such that the end having the smaller diameter is disposed in closer proximity to the composite base panel 1012/1020 and the end having the larger diameter is disposed in closer proximity to the top panel 1016.

A void or gap exists between lower portions of two adjacent articles B.

A heel portion of each of the articles B disposed in the lowermost tier is disposed in a respective one of the heel engaging structures C5, C6.

The retention structure RT1, RT2, top engaging structures C3, C4 and heel engaging structures C5, C6 facilitate retention of the articles B within the article carrier 1090 preventing or inhibiting unintentional egress of the articles B from the article carrier 1090.

The article carrier 1090 comprises a tubular structure having two opposed open ends.

The top panel 1016 comprises a pair of opposed free end edges. Each of the pair of opposed free end edges comprises a contoured or tapered portion T1, T2. In this way the top panel 1016 comprises a first hinged edge H1, defined by fold line 1017, which is longer in dimension than a second hinged edge H2, defined by fold line 1015 (see FIG. 5).

The top panel 1016 is shaped such that a portion of each endmost article B1, B2 projects or extends beyond a respective one of the opposed free end edges. The tapered portions T1, T2 have the effect of insetting the adjacent corners of the top panel 1016 on a first side of the group of articles B being packaged.

Figure 5:
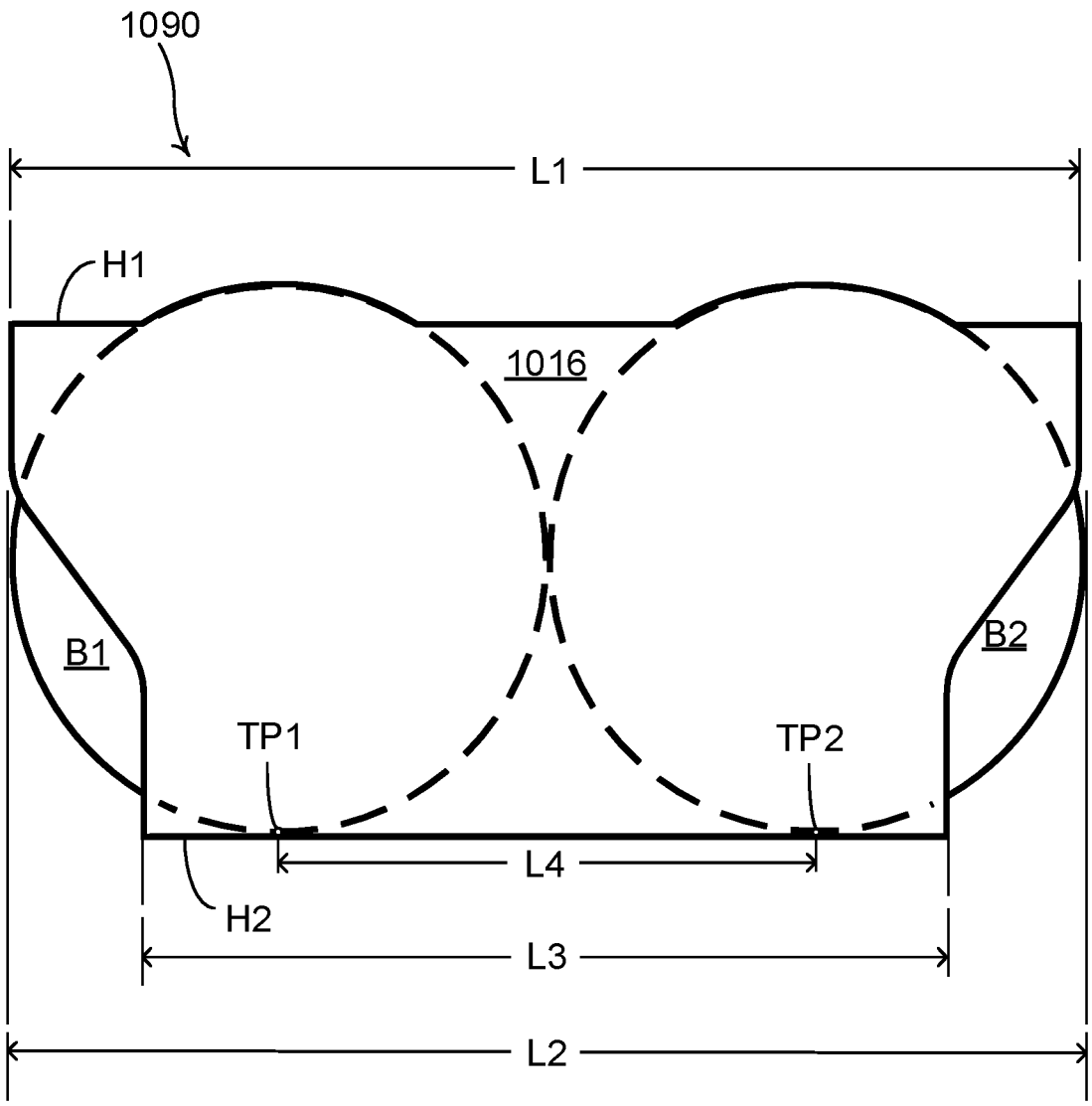
FIG. 5 is a top view the secondary package of FIG. 4.

The secondary package 1090 illustrated in FIG. 5 comprises a pair of articles B. The articles each comprises a diameter or width dimension and together the articles B define a length dimension L2 of the article group.

The first hinged edge H1 comprises a first dimension L1. The second hinged edge H2 comprises a second dimension L3. The first dimension L1 is greater than the second dimension L3 (L1>L3).

The first dimension L1 of the first hinged edge H1 of the top panel 1016 is substantially or generally equal to the length dimension L2 of the group of articles B being packaged (L1 L2).

The secondary package comprises a first article 1 disposed at first end of the tubular structure formed by the plurality of main panels 1012, 1014, 1016, 1018, 1020. The first article E1 is in touching contact with, or at least is closest to, the first side panel 1014 at a position defined by first point TP1. This is the position at which the first side panel 1014 is disposed tangentially to the first article E1.

The secondary package comprises a second article 1 disposed at second end of the tubular structure formed by the plurality of main panels 1012, 1014, 1016, 1018, 1020. The second article B2 is in touching contact with, or at least is closest to, the first side panel 1014 at a position defined by second point TP2. This is the position at which the first side panel 1014 is disposed tangentially to the second article B2.

The first point TP1 is spaced a linear dimension L4, along long the first side panel 1014, from the second point TP2. The linear dimension L4 is less than the second dimension L3 of the second hinged edge H2. Which in turn is less than first dimension L1 of the first hinged edge H1 and is also less than the length dimension L2 of the articles B being packaged (L4<L3<L1 L2).

The linear dimension L4 may be also the distance between the respective centres of the first and second articles E1, B2.

The top panel 1016 may be shaped such that an endmost article B disposed in an article carrier 1090 may be disposed in touching contact with, or at least close proximity to, an adjacently disposed end closure panel 22*a*, 24*a*, 24*b*, 26*a*, 28*a*, 28*b*, 30*a*, 22*b*, 24*c*, 24*d*, 26*b*, 28*c*, 28*d*, 30*b* of the shipping carton 90 as shown in FIG. 14. In this way the articles B may be tightly packaged by the shipping carton 90.

The top panel 1016 may be shaped such that an endmost article B disposed in a first article carrier 1090A may be disposed in touching contact with, or at least close proximity to, an adjacently disposed end closure panel 22*a*, 24*a*, 24*b*, 26*a*, 28*a*, 28*b*, 30*a* at a first end of the shipping carton 90.

The top panel 1016 may be shaped such that an endmost article B disposed at a second end of a first article carrier 1090A may be disposed in touching contact with, or at least close proximity to, an article B disposed at a first end of an adjacent second article carrier 1090D.

The top panel 1016 may be shaped such that an endmost article B disposed in the adjacent second article carrier 1090D may be disposed in touching contact with, or at least close proximity to, an adjacently disposed end closure panel 22*b*, 24*c*, 24*d*, 26*b*, 28*c*, 28*d*, 30*b* at a second end of the shipping carton 90.

In this way the articles B may be tightly packaged by the shipping carton 90, in at least a longitudinal direction of the shipping carton 90.

FIG. 14 illustrates a first method of orienting a plurality of article carriers 1090 within the shipping carton 90. In the illustrated embodiment six article carriers 1090A, 1090B, 1090C, 1090D, 1090E, 1090F are provided within the shipping carton 90.

The shipping carton 90 comprises three rows of two secondary packages 1090. The outermost rows of secondary packages 1090 are oriented such that the short hinged edges H2 of their top panels 1016 face outwardly, towards the first or second side panel 14, 18 of the shipping carton 90.

The inner or middle row of secondary packages 1090 are oriented in the same direction as each other. In the illustrated embodiment the inner or middle row of secondary packages 1090 are oriented such that the short hinged edges H2 of their top panels 1016 face towards the first side panel 14 of the shipping carton 90. It will be appreciated that in other embodiments the short hinged edges H2 of the top panels 1016 of the middle row of secondary packages 1090 may face towards the second side panel 18 of the shipping carton 90.

Figure 15:
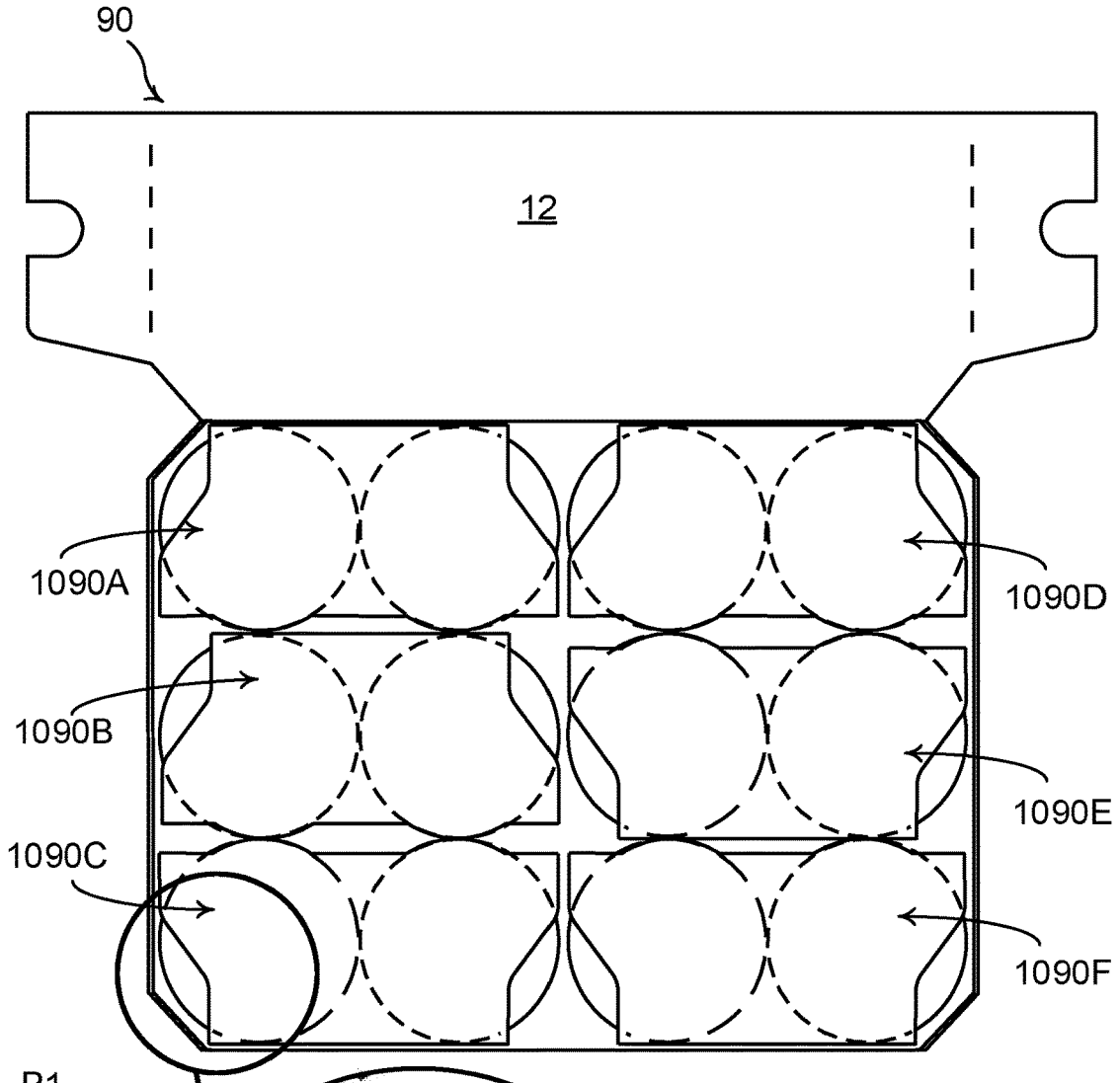
FIG. 15 is a top view of a stage of construction of a package system comprising the shipping carton of FIG. 2, loaded with a second, alternative, arrangement of a plurality of secondary carriers of FIG. 4 (each secondary carrier being loaded with a plurality of primary product containers), in the illustration one of the top panels has been omitted for illustrative purposes.

FIG. 15 illustrates a second method of orienting a plurality of article carriers 1090, in the illustrated embodiment six article carriers 1090A, 1090B, 1090C, 1090D, 1090E, 1090F, within the shipping carton 90. In the illustration the second top panel 20 of the shipping carton 90 has been omitted for illustrative purposes The shipping carton 90 comprises three rows of two secondary packages 1090. The outermost rows of secondary packages 1090 are oriented such that the short hinged edges H2 of their top panels 1016 face outwardly, towards the first or second side panel 14, 18 of the shipping carton 90.

The inner or middle row of secondary packages 1090 are oriented in the opposing directions to each other such that the short hinged edge H2 of the top panel 1016B of a third secondary packages 1090B faces towards the first side panel 14 of the shipping carton 90 and the short hinged edge H2 of the top panel 1016E of a fourth secondary packages 1090E faces towards the second side panel 18 of the shipping carton 90. The third secondary package 1090B and the adjacent fifth secondary package 1090C are disposed in a back-to-back contacting relationship. In this application, however, the expression "contacting relationship" is not limited to referring to an actually contacting or touching relationship but includes any relationship wherein two adjacent panels, walls or otherwise surfaces are facing or opposing to one another with a space therebetween but without any other packages or cartons therebetween.

Figure 15A:
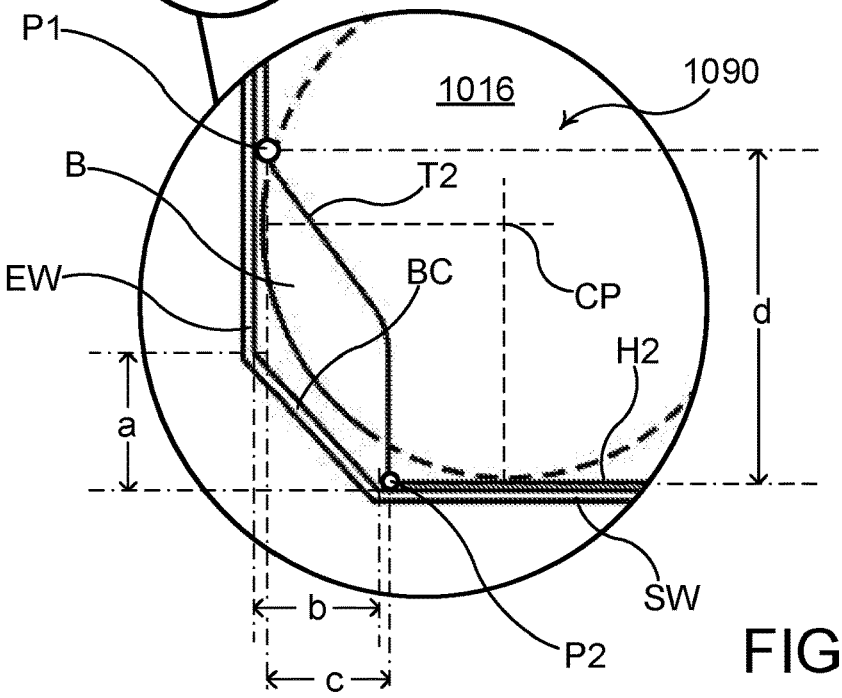
FIG. 15A is an enlarged view of a corner portion of the package system of FIG. 15.

FIG. 15A is an enlarged view of a corner of the package system, the package system comprises the shipping carton 90, the secondary packages 1090A, 1090B, 1090C, 1090D, 1090E, 1090F and the articles B.

It can be seen that the top panel 1016 of the secondary package 1090 is configured to expose a portion of the endmost article B. A portion of the endmost article B extends or projects beyond the top panel 1016. The embodiment shown exposes the widest part of the article B. The tapered or contoured edge T2 of the top panel 1016 commences at a point P1. Point P1 is disposed a distance 'd' from the second hinged edge H2 of the secondary package 1090. In the illustrated embodiment the distance 'd' is greater than a radial dimension of the article B.

In the illustrated embodiment the distance 'd' is greater than an internal distance 'a', measured in a transverse direction with respect to the secondary package 1090, between the end wall EW and the sidewall SW of the shipping carton 90, in other embodiments is the distance 'd' is equal to or greater than distance 'a' (d a).

The edge of the top panel 1016 terminates at second hinged edge H2 of the secondary package 1090 at a second point P2. Second point P2 is disposed a distance 'c' measured, in a longitudinal direction with respect to the secondary package 1090, from the point P1 or alternatively from the widest part of the secondary package 1090, which may be defined by the widest part of the top panel 1016 or the widest part of the article B). In the illustrated embodiment the distance 'c' is less than a radial dimension of the article B.

In the illustrated embodiment the distance 'c' is greater than an internal distance 'b', measured in a longitudinal direction with respect to the secondary package 1090, between the end wall EW and the sidewall SW of the shipping carton 90, in other embodiments is the distance 'c' is equal to or greater than distance 'b' (c b).

The shipping carton 90 can form a close or snug fit with the exposed portion of the endmost article B. In some embodiments the end wall and/or beveled corner panel of the shipping carton 90 may be contactable with the exposed portion of the endmost article B.

Figure 6:
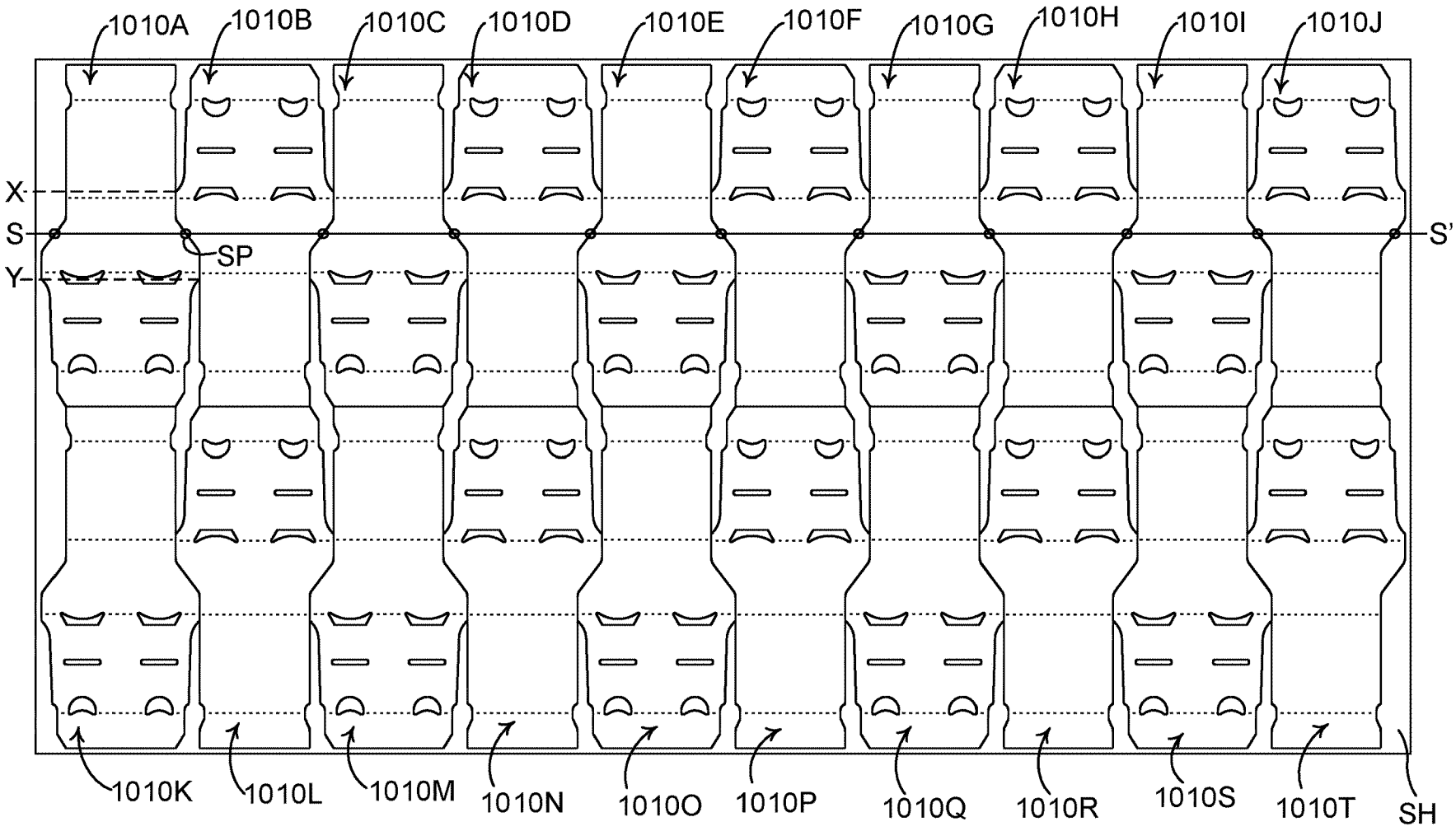
FIG. 6 is a plan view from above of a plurality of the blanks shown in FIG. 3 laid out in a nested arrangement.

FIG. 6 shows a plurality of blanks 1010A through to 1010T of the form shown in FIG. 3 laid out in a nested arrangement. FIG. 6 shows twenty blanks 1010A-T. The blanks 1010A-T comprise opposed end edges portion of which are symmetrical between X and Y. The portion of the end edge which is symmetrical is symmetrical about a point of symmetry SP. The point of symmetry lies upon a notional line S-S' which defines a centrally disposed longitudinal axis of the top panel 1016 of the blanks 1010A-T. The notional line S-S' shown in FIG. 6 lies upon a longitudinal centre axis of the top panel 1016, denoted in FIG. 3 by dashed line Z-Z'. The longitudinal centre axis of the top panel 1016 Z-Z' and the notional line S-S' extend longitudinally across the base panel 1216 and pass through the tapered or contoured portions T1, T2. That is to say, the point of symmetry SP lies upon the tapered or contoured portions T1, T2, best illustrated in FIG. 3.

The free end edges extend generally transversely with respect to the centre axis (S-S'). At least a part of the free end edge is symmetrical about a point of symmetry SP. The top panel 1016 provides at least a portion of the part of the free end edge which is symmetrical. A first blank 1010A is nestable with another blank 1010B which is of the same size and configuration as the first blank 1010A such that the symmetrical part of one of the free end edges of the first blank 1010A and that of the other blank 1010B are formed by a single die cut blade.

The portion of the end edge which is symmetrical is non-linear in shape. That is to say, it includes the tapered or contoured portion T1, T2 of the first or second end edges of the top panel 1016.

Figure 7:
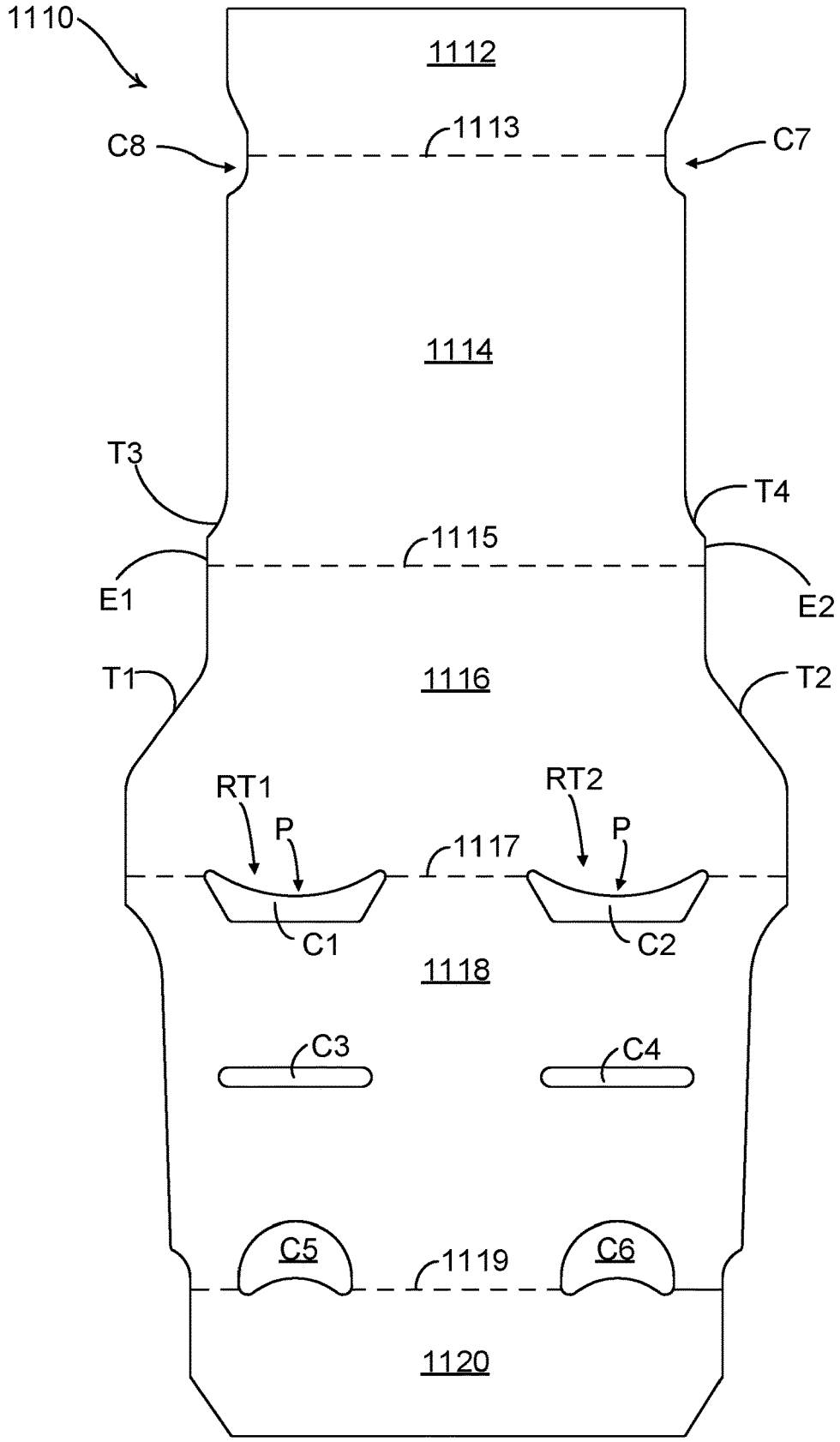
FIG. 7 is a plan view from above of a blank for forming a carrier according to a second embodiment.
Figure 8:
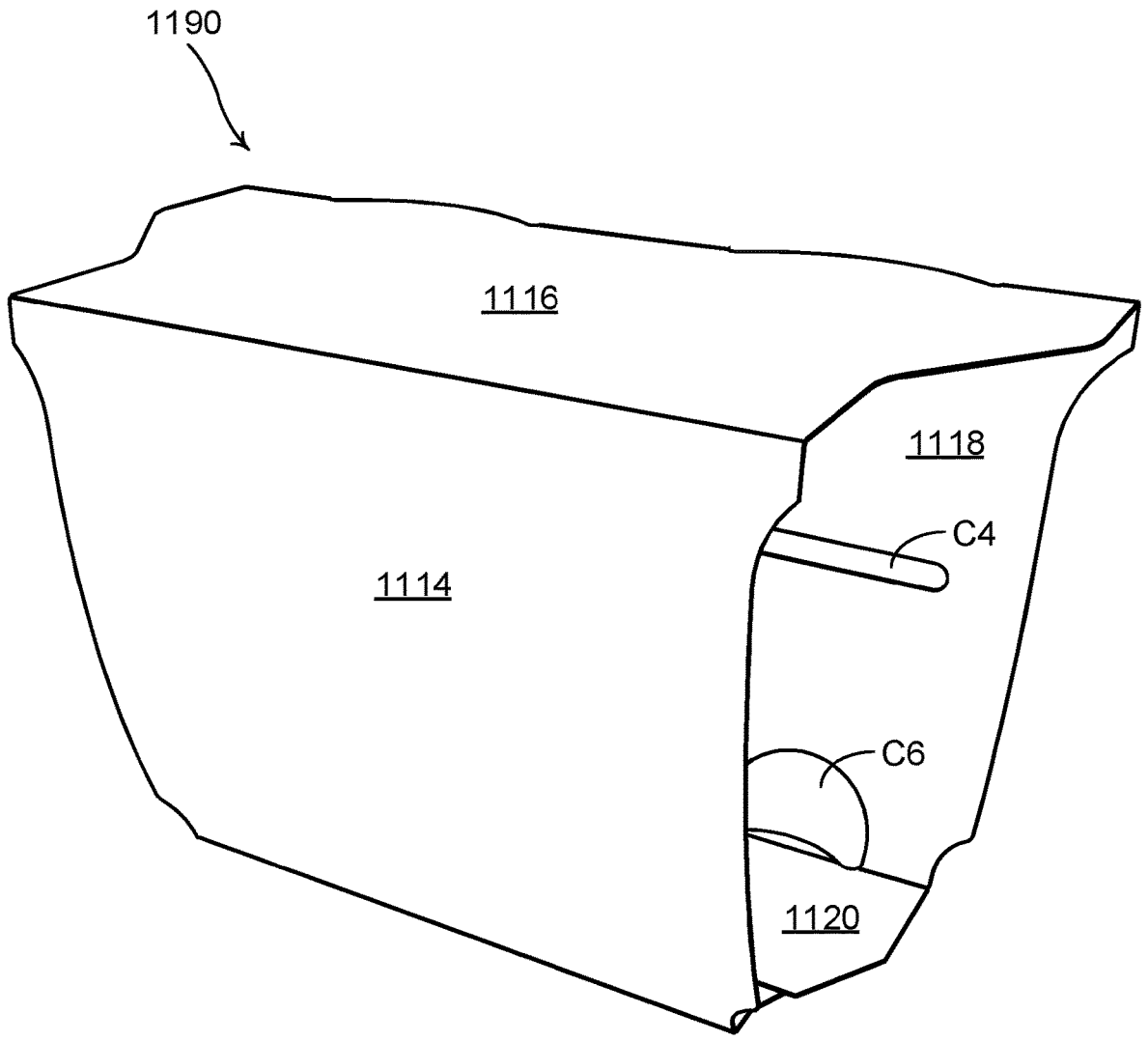
FIG. 8 is a perspective view from above of a secondary carrier formed from the blank of FIG. 7.
Figure 9:
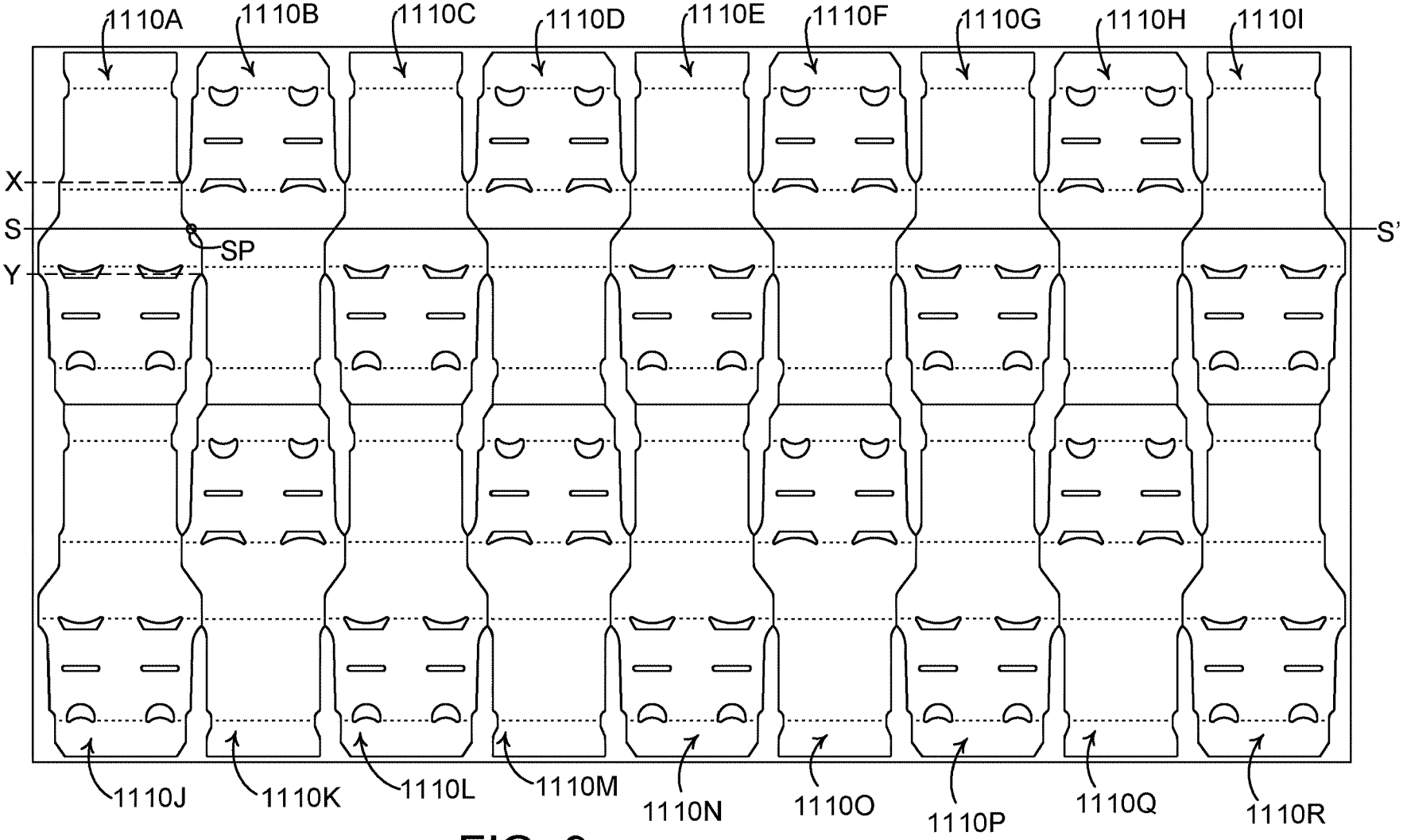
FIG. 9 is a plan view from above of a plurality of the blanks shown in FIG. 7 laid out in a nested arrangement.

Referring now to FIGS. 7 to 9 there is shown an alternative embodiment of the present disclosure. In the second illustrated embodiment, like numerals have, where possible, been used to denote like parts, albeit with the addition of the prefix "1100" to indicate that these features belong to the second embodiment. The second embodiment shares many common features with the embodiment of FIGS. 3 to 6 and therefore only the differences from the embodiment illustrated in FIGS. 3 to 6 will be described in any greater detail.

FIG. 7 illustrates a blank 1110 for forming a secondary package or article carrier 1190 (see FIG. 8) according to a second embodiment. The blank 1110 comprises a plurality of main panels 1112, 1114, 1116, 1118, 1120 for forming a tubular structure. The plurality of main panels 1112, 1114, 1116, 1118, 1120 comprises a first base panel (or outer layer) 1112, a first side panel 1114, a top panel 1116, a second side panel 1118 and a second base panel or securing flap (or inner layer) 1120. The plurality of panels 1112, 1114, 1116, 1118, 1120 may be arranged in a linear series hinged one to the next by corresponding fold lines 1113, 1115, 1117, 1119.

The blank 1110 is foldable to form a package 1190 as illustrated in FIG. 8. The first and second base panels 1112, 1120 are engageable with one another in an overlapping relationship to forma composite base wall 1112/1120 of the carrier 1190.

The blank 1110 is adapted to accommodate four articles B arranged in a 1×2×2 matrix or array. That is to say, the blank 1110 is arranged to accommodate two tiers of two adjacently disposed articles B. The blank 1110 comprises at least one top retention structure RT1, RT2 for engaging an article B disposed in the uppermost tier. The blank 1110 illustrated in FIG. 7 comprises two top retention structures RT1, RT2 for engaging each article B disposed in the uppermost tier.

The blank 1110 comprises at least one top engaging structure C3, C4 for engaging an article B disposed in a lower tier. The blank 10 illustrated in FIG. 7 comprises two top engaging structures C3, C4 for engaging each article B disposed in the lower tier. In the illustrated embodiment the blank 1110 comprises two top engaging structures C3, C4 for engaging each article B disposed in the bottom or lowermost tier. It will be appreciated that in article carriers arranged to accommodate more than two tiers further top engaging structures may be provided.

The blank 1110 may comprise at least one heel engagement structure C5, C6 for engaging with a heel or lower portion of an article B. The blank 1110 illustrated in FIG. 7 comprises two heel engagement structures C5, C6 each is provided for engaging a respective article B disposed in the lowermost tier.

Optionally, the blank 1110 comprises a first cutaway C7 in the form of a recess struck from a portion of a first free end edge of the first side panel 1114 and from a portion of a first free end edge of the first base panel 1112. Optionally, the blank 1110 comprises a second cutaway C8 in the form of a recess struck from a portion of a second free end edge of the first side panel 1114 and from a portion of a second free end edge of the first base panel 1112. In this way the fold line 1113 hinging the first base panel 1112 to the first side panel 1114 terminates at each end at one of the first and second cutaways C7, C8.

The article carrier 1190 as illustrated in FIG. 8 can be constructed by employing a series of sequential folding operations similar to that described above in relation to the blank 1010 of FIG. 3.

The blank 1110 comprises a pair of opposed free end edges E1, E2. A first free end edge E1 comprises a first tapered or contoured portion T1 provided by a first end edge of the top panel 1116.

A second free end edge E2 comprises a second tapered or contoured portion T2 provided by a second end edge of the top panel 1116. The second end edge of the top panel 1116 opposes the first end edge of the top panel 1116.

The first free end edge E1 comprises a third tapered or contoured portion T3 provided by a first end edge of the first side panel 1114.

The second free end edge E2 comprises a fourth tapered or contoured portion T4 provided by a second end edge of the first side panel 1114.

The third and fourth tapered or contoured portions T3, T4 have the effect of widening an upper portion of the first side panel 1114 with respect to a lower portion thereof. The upper portion of the first side panel 1114 is provided adjacent to the hinged connection 1115 between the first side panel 1114 and the top panel 1116.

The third and fourth tapered or contoured portions T3, T4 have the effect of widening a portion of the top panel 1116 of the blank 1110 of FIG. 7 with respect to a corresponding portion of the top panel 1016 of the blank 1010 of FIG. 3. The aforesaid widened portion of the top panel 1116 of the blank 1110 is provided adjacent to the hinged connection 1115 between the first side panel 1114 and the top panel 1116.

This has the effect of increasing the area of the first side panel 1114 and of the top panel 1116. This may advantageous for increasing a display area for providing information or branding to a consumer. The blank 1010 of FIG. 3 is advantageous in that is reduces the substrate material require to form the blank 1010. The blank 1010 is nestable to a greater extent than the blank of FIG. 7 enables a larger density of blanks 1010 to be provided by a substrate for a given carrier configuration. This is illustrated by comparison of FIGS. 6 and 9. The substrate SH of FIG. 6 comprises twenty blanks 1010A-T whereas the substrate SH of FIG. 9 comprises eighteen blanks 1110A-R.

Referring now to FIGS. 10 to 13 there is shown a further alternative embodiment of the present disclosure. In the third illustrated embodiment, like numerals have, where possible, been used to denote like parts, albeit with the addition of the prefix "1200" to indicate that these features belong to the third embodiment. The third embodiment shares many common features with the embodiments of FIGS. 3 to 9 and therefore only the differences from the embodiments illustrated in FIGS. 3 to 9 will be described in any greater detail.

Figure 10:
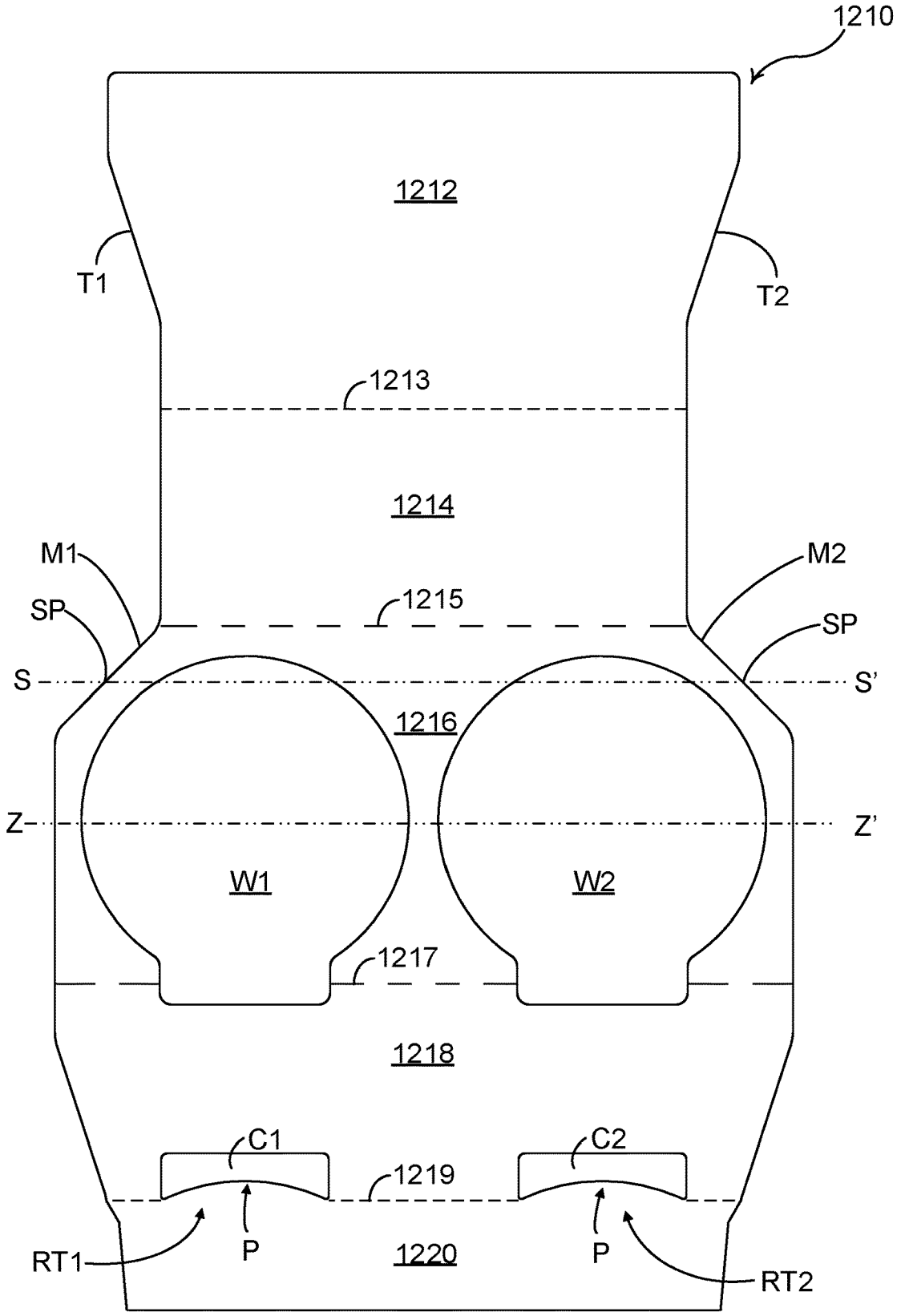
FIG. 10 is a plan view from above of a blank for forming a carrier according to a third embodiment.
Figure 11:
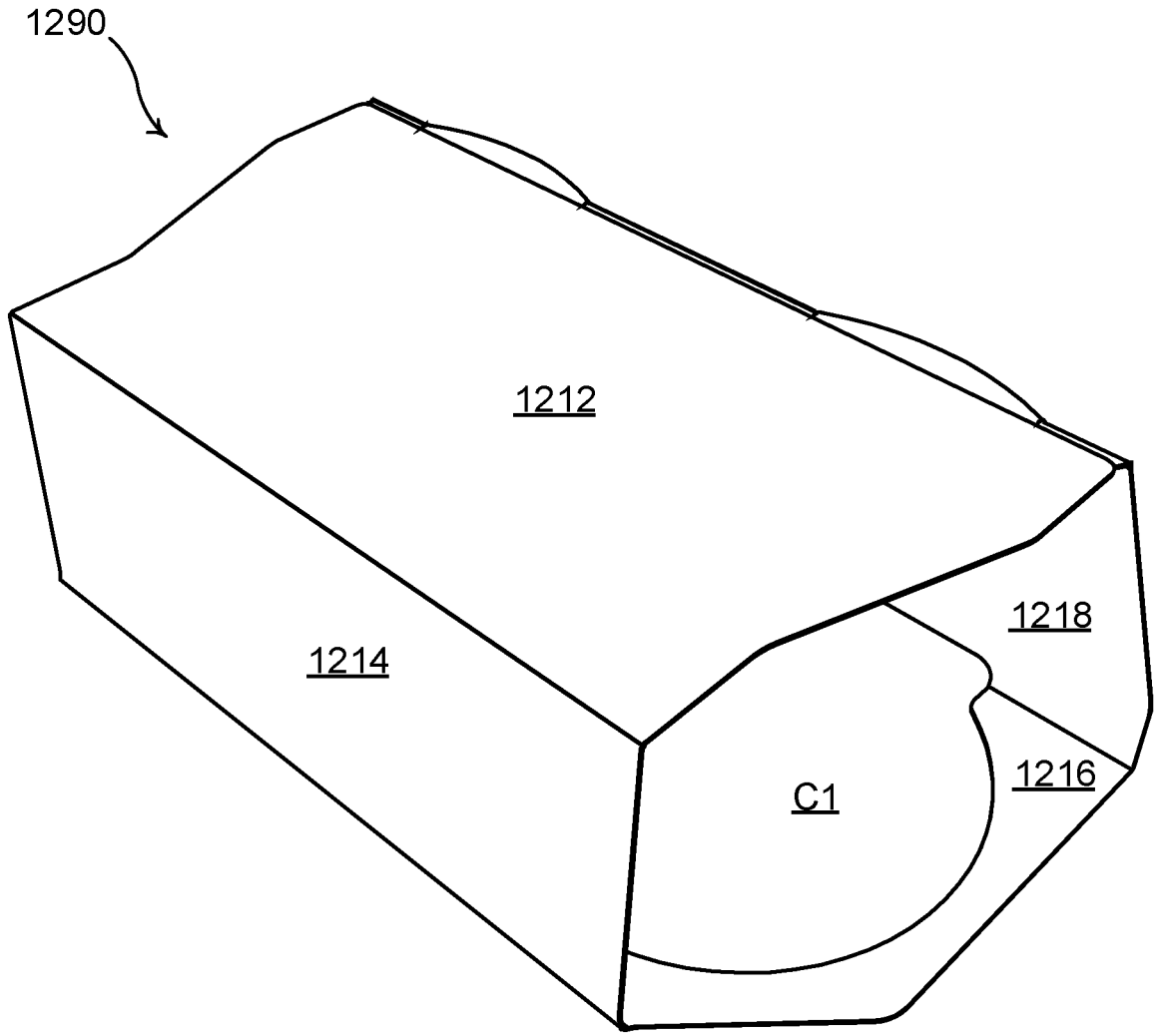
FIG. 11 is a perspective view from above of a secondary carrier formed from the blank of FIG. 10.

FIG. 10 illustrates a blank 1210 for forming a secondary package or article carrier 1290 (see FIGS. 11 and 12) according to a third embodiment. The blank 1210 comprises a plurality of main panels 1212, 1214, 1216, 1218, 1220 for forming a tubular structure. The plurality of main panels 1212, 1214, 1216, 1218, 1220 comprises a first top panel (or outer layer) 1212, a first side panel 1214, a base panel 1216, a second side panel 1218 and a second top panel or securing flap (or inner layer) 1220. The plurality of panels 1212, 1214, 1216, 1218, 1220 may be arranged in a linear series hinged one to the next by corresponding fold lines 1213, 1215, 1217, 1219.

The first top panel 1212 comprises a pair of opposed free end edges each of which comprises a tapered or contoured portion T1, T2. This has the effect of decreasing the length of the edge of the first top panel 1212 along the hinged connection 1213 coupling the first top panel 1212 to the first side panel 1214 compared to a free side edge opposing the hinged connection 1213.

The blank 1210 comprises at least one top retention structures RT1, RT2 for engaging an article B disposed in an uppermost tier. The blank 1210 illustrated in FIG. 10 comprises two top retention structures RT1, RT2 for engaging each article B disposed in the uppermost tier.

Each of the top engaging structures RT1, RT2 comprises an opening C1, C2 respectively. Each opening C1, C2 is struck, at least in part, from the second side panel 1218. Optionally, the openings C1, C2 interrupt the fold line 1219 between the second top panel 1220 and the second side panel 1218. When the second side panel 1218 is folded with respect to the second top panel 1220, about fold line 1219, the openings C1, C2 can receive a portion of a respective article B. In the illustrated embodiment the openings C1, C2 each receive a flange of an article B.

The openings C1, C2 each define, in part a protrusion P extending from the side edge of the second top panel 1220 and integrally formed therewith. The protrusions P are struck from material which would otherwise form the second side panel 1218. In this way protrusions P may be considered to be struck from the second side panel 1218. The protrusions P each form a protective top cover for a portion of an article B which is received in the openings C1, C2.

The base panel 1216 comprises a pair of opposed free end edges each of which comprises a mitred, chamfered or beveled corner portion M1, M2. This has the effect of decreasing the length of the edge of the base panel 1216 along the hinged connection 1215 coupling the base panel 1216 to the first side panel 1214 compared to a hinged side edge defined the hinged connection 1217 coupling the base panel 1216 to the second side panel 1218.

The base panel 1216 comprises a pair of article receiving apertures W1, W2. Each article receiving apertures W1, W2 is adapted to receive a portion of an article B. The article receiving apertures W1, W2 are dimensioned such that the articles B are prevented or inhibited from passing through the base panel 1216. Each article B comprises a flange, skirt or other radial projection which engages with an upper surface of the base panel 1216 proximate the article receiving apertures W1, W2. In this way the articles B can be suspended or hang from the base panel 1216.

Figure 12:
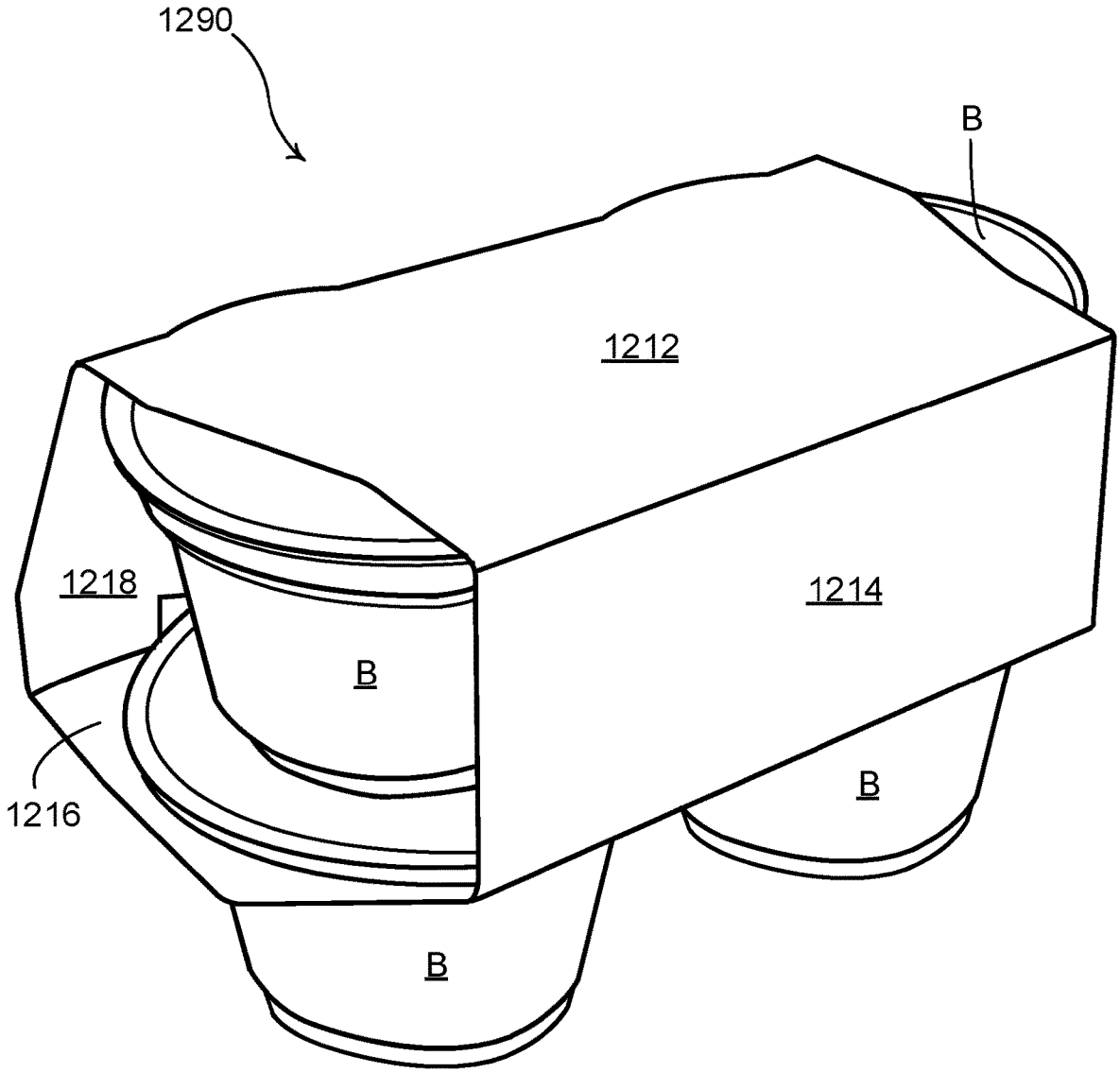
FIG. 12 is a perspective view from above of a secondary package comprising the carrier of FIG. 11 loaded with a group of primary product containers or articles.

The articles B received in the article receiving apertures W1, W2 form a lower tier of a group of articles B, best shown in FIG. 12. A second upper tier of articles B are placed upon the lower tier.

The second tier of articles B is disposed within the tubular structure of the carrier 1290. The bases of the articles B in the second tier are disposed above the base panel 1216.

The first and second side walls 1214, 1218 are folded upwardly, with respect to the base panel 1216 about fold lines 1215, 1217 respectively, about opposing sides of the upper tier of the group of articles B so as to be disposed about the opposing sides thereof. A flange or skirt of each article B in the upper tier is received in a respective one of the openings C1, C2 of the retention structures RT1, RT2.

The second top panel 1220 is folded with respect to the second side panel 1218 about fold line 1219 to be disposed at least partially over the articles B in the upper tier.

Glue G or other adhesive treatment is applied to an outer surface of the second top panel 1220. Alternatively, glue G or other adhesive treatment may be applied to a corresponding portion of an inner surface of the first top panel 1212.

The first top panel 1212 is folded with respect to the first side panel 1214 about fold line 1213 to be disposed at least partially over the articles B in the upper tier.

The first top panel 1212 is brought into face contacting relationship with the second top panel 1220.

The first top panel 1212 is brought into at least partial overlapping relationship with the second top panel 1220.

The first top panel 1212 is secured to the second top panel 1220 to form the secondary package 1290 shown in FIG. 12.

Figure 18:
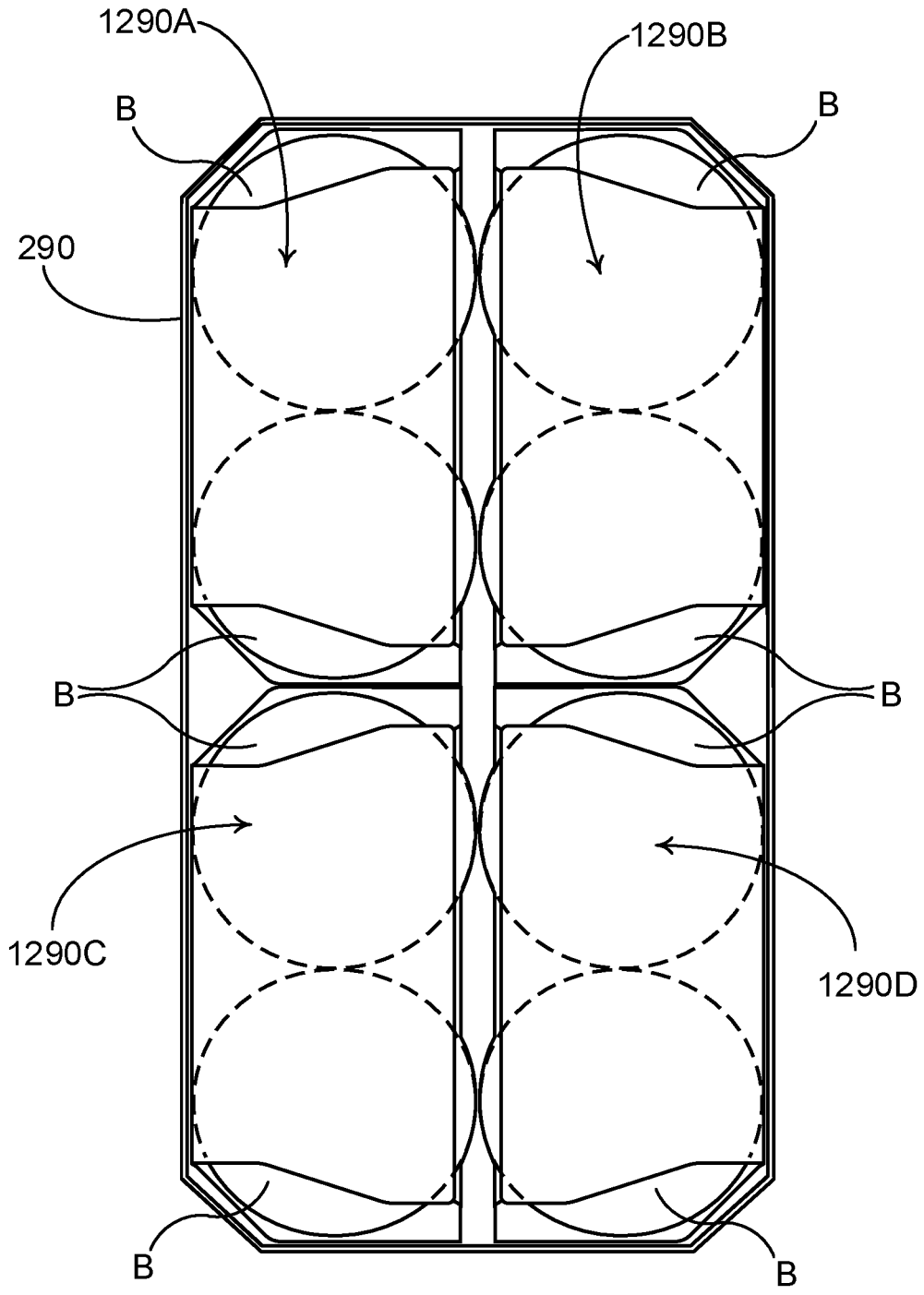
FIG. 18 is a schematic top view of an alternative package system comprising a further alternative shipping carton, loaded with a further arrangement of a plurality of secondary carriers of the embodiment of FIG. 12 (each secondary carrier being loaded with a plurality of primary product containers) in the illustration a top wall of shipping carton has been omitted for illustrative purposes.

FIG. 18 illustrates a top view of an alternative shipping carton 290 loaded with the secondary packages 1290 of the third embodiment. The alternative shipping carton 290 is configured to receive four secondary packages 1290A, 1290B, 1290C, 1290D arranged in a 2×2 matrix or array. The alternative shipping carton 290 is arranged to have corner panels which provide a beveled or mitred corner. In this way the shipping carton 290 adopts an octagonal shape as viewed from above in FIG. 18.

It will be appreciated that the secondary packages 1290 of the third embodiment may also be employed with the shipping carton 90 of FIG. 2 in a 2×3 matrix or array. Additionally, or alternatively the alternative shipping carton 290 may be loaded with the secondary packages 1090, 1190 of the first or second embodiments.

Returning to FIG. 18 it can be seen that the alternative shipping carton 290 forms a close or snug fit about the group of secondary packages 1290A, 1290B, 1290C, 1290D. The mitred corners M1, M2 of the secondary carrier 1290 are disposed in close proximity to the corner panels of the shipping carton 290. The base panel 1216 is shaped so as to allow the secondary packages 1290A, 1290B, 1290C, 1290D to form a close fit with the beveled corner panels of the shipping carton 290.

A first column of secondary packages 1290A, 1290C is arranged such that the first side panel 1214 of each secondary package 1290A, 1290C faces a first one of a pair of opposed side panels of the shipping carton 290.

A second column of secondary packages 1290B, 1290D is arranged such that the first side panel 1214 of each secondary package 1290B, 1290D faces the a second one of a pair of opposed side panels of the shipping carton 290.

In this way the secondary packages 1290A, 1290C of the first column are disposed back to back with the secondary packages 1290B, 1290D of the second column. That is to say, each second side panels 1218 of the secondary packages 1290A, 1290C faces a respective one of the second side panels 1218 of one of the secondary packages 1290B, 1290D.

Figure 13:
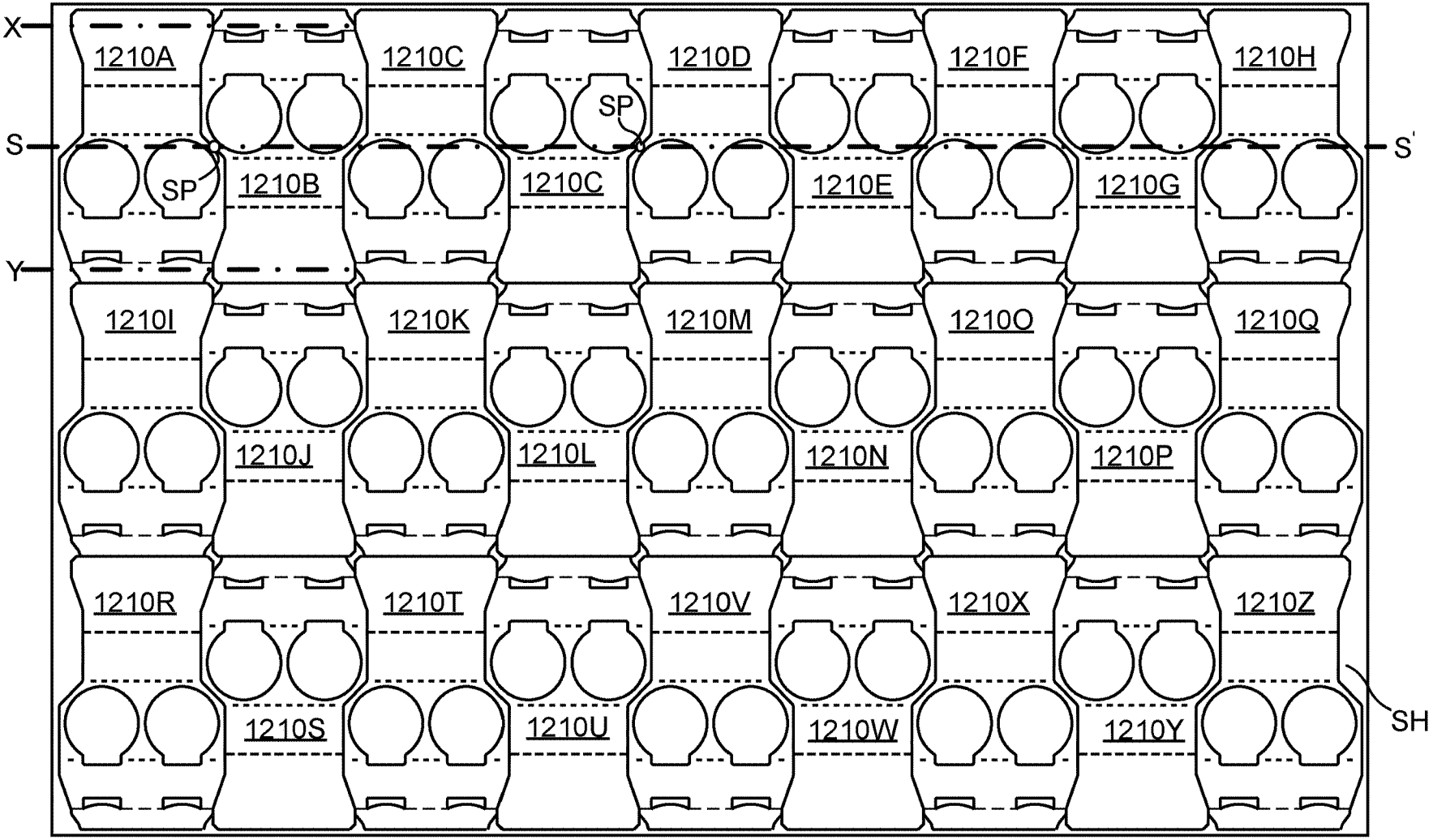
FIG. 13 is a plan view from above of a plurality of the blanks shown in FIG. 10 laid out in a nested arrangement.

FIG. 13 illustrates a plurality of blanks 1210A through to 1210Z of the form shown in FIG. 10 laid out in a nested arrangement. FIG. 13 shows twenty-six blanks 1210A-Z. The blanks 1210A-Z comprise opposed end edges, a portion of each edge is symmetrical, the symmetrical portion is denoted between X and Y in FIG. 13. The portion of the end edge which is symmetrical is symmetrical about a point of symmetry SP. The point of symmetry lies upon a notional line S-S'. The notional line S-S' extends longitudinally across the base panel 1216 and passes through the mitred corner portions M1, M2. That is to say, the point of symmetry SP lies upon the mitred corner portions M1, M2, best illustrated in FIG. 10. The notional line S-S' is offset from a longitudinal centre axis of the base panel 1216, denoted in FIG. 10 by dashed line Z-Z'.

The free end edges of the blanks 1210A-Z extend generally transversely with respect to the centre axis (Z-Z'). At least a part of the free end edge is symmetrical about a point of symmetry SP. The base panel 1216 provides at least a portion of the part of the free end edge which is symmetrical. A first blank 1210A is nestable with another blank 1210B which is of the same size and configuration as the first blank 1210A such that the symmetrical part of one of the free end edges of the first blank 1210A and that of the other blank 1210B are formed by a single die cut blade.

The portion of the end edge which is symmetrical is non-linear in shape. That is to say, it includes the tapered or contoured portion T1, T2 of the first or second end edges of the top panel 1216 and/or the mitred corner portions M1, M2 of the base panel 1216.

Figure 16:
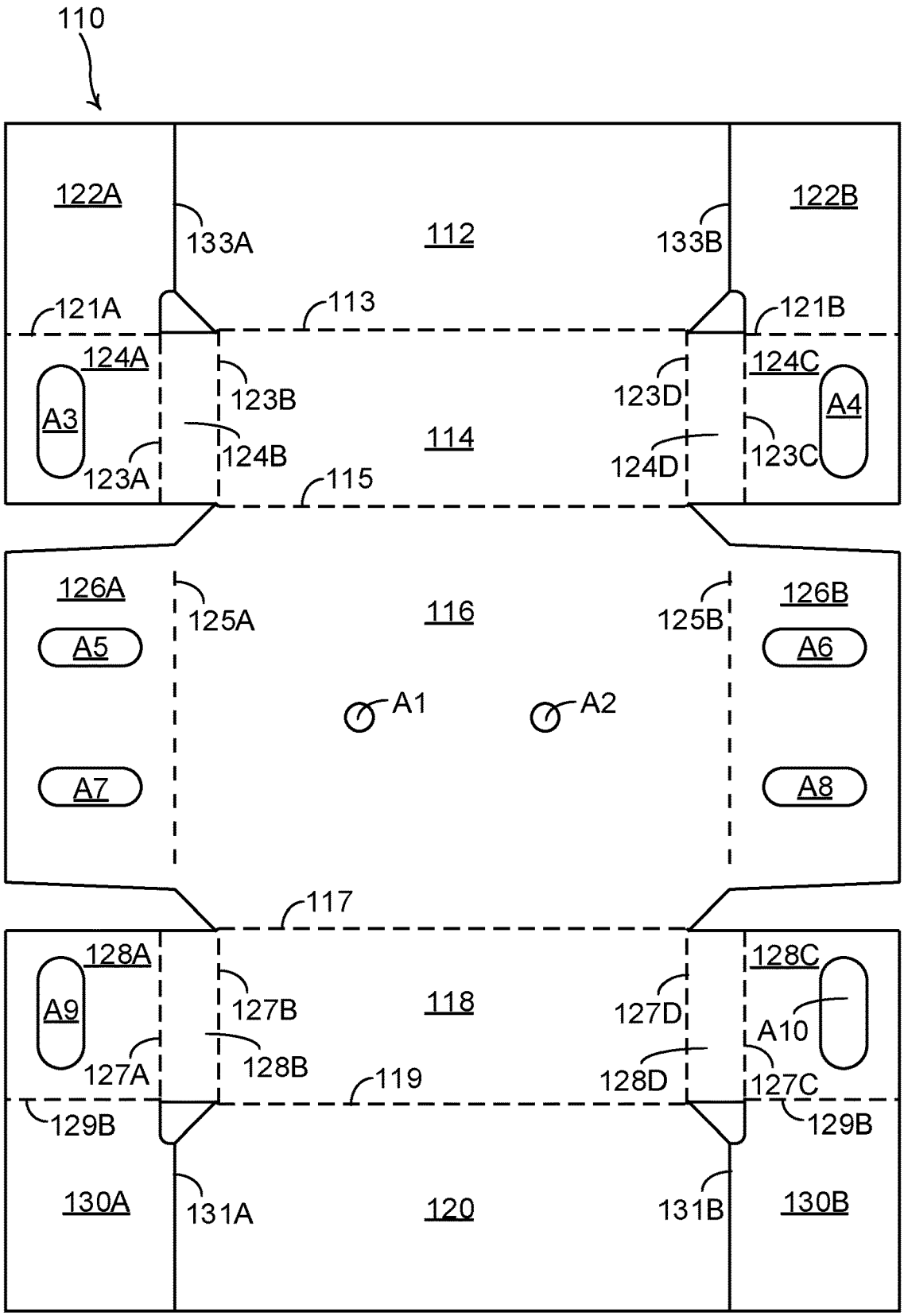
FIG. 16 is a plan view from above of an alternative blank for forming an alternative tertiary package or shipping carton according to various embodiments of the invention.
Figure 17:
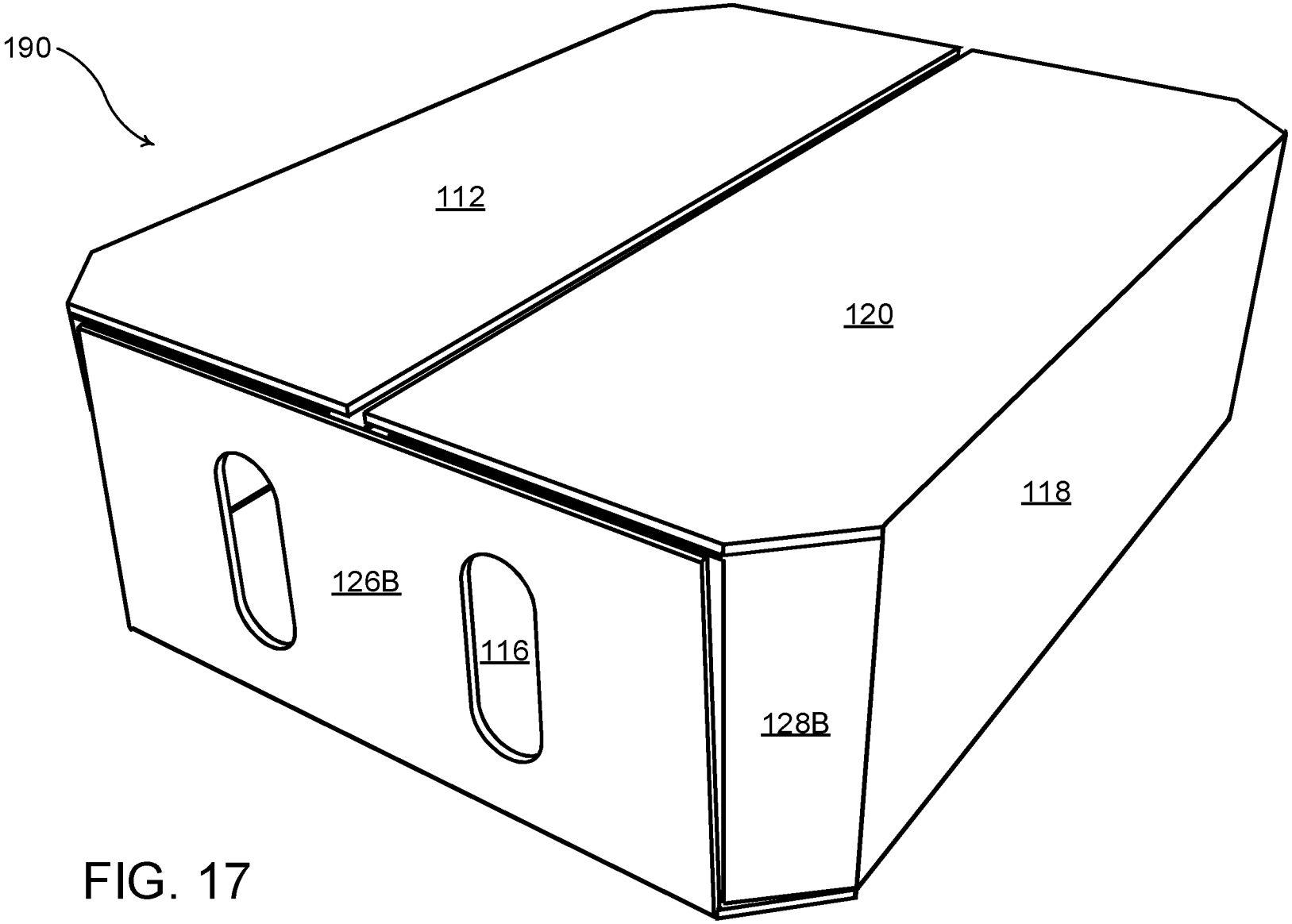
FIG. 17 is a perspective view from above of the alternative tertiary package constructed from the blank of FIG. 16.

Referring now to FIGS. 16 and 17 there is shown a further alternative embodiment of the shipping carton of the present disclosure. In the further alternative embodiment illustrated, like numerals have, where possible, been used to denote like parts, albeit with the addition of the prefix "100". The further alternative embodiment shares many common features with the embodiment of FIGS. 1 and 2 and therefore only the differences from the embodiments illustrated in FIGS. 1 and 2 will be described in any greater detail.

The blank 110 and shipping carton 190 of FIGS. 16 and 17 respectively may be employed with any of the secondary packages described and/or illustrated.

Referring now to FIG. 16, the blank 110 comprises a series of main panels for forming the main walls of a tertiary package or shipping carton 190. The series of main panels comprises: a first top panel 112, a first side panel 114, a base panel 116, a second side panel 118 and a second top panel 120. Optionally the series of main panels 112, 114, 116, 118, 120, are hinged together in a linear series by hinged connections in the form of fold lines 113, 115, 117, 119.

The plurality of main panels 112, 114, 116, 118, 120 of the blank 110 form walls of a tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment the ends of the tubular structure are fully closed by end closure panels 122*a*, 124*a*, 124*b*, 126*a*, 128*a*, 128*b*, 130*a*, 122*b*, 124*c*, 124*d*, 126*b*, 128*c*, 128*d*, 130*b*.

End closure panels 122*a*, 124*a*, 124*b*, 126, 128*a*, 128*b*, 130*a* are configured to close a first end of the tubular structure and end closure panels 122*b*, 124*c*, 124*d*, 126*b*, 128*c*, 128*d*, 130*b* are configured to close a second end of the tubular structure.

The first end of the tubular structure is closed by a first end closure panel 122*a*, a second end closure panel 124*a*, a first corner panel 124*b*, a third end closure panel 126*a*, a fourth end closure panel 128*a*, a second corner panel 128*b* and a fifth end panel 130*a*. The first end closure panel 122*a* is hinged to an upper edge end of the second end closure panel 124*a* by a hinged connection such as a fold line 121*a*. The first end closure panel 122*a* is separated from the first top panel 112 by a cutline or severable line 133*a*. The second end closure panel 124*a* is hinged to a first end of a first corner panel 124*b* by a hinged connection such as a fold line 123*a*. The first corner panel 124*b* is hinged to a first end of the first side panel 114 by a hinged connection such as a fold line 123*b*. The third end closure panel 126*a* is hinged to a first end of the base panel 116 by a hinged connection such as a fold line 125*a*. The fourth end closure panel 128*a* is hinged to a first end of a second corner panel 124*b* by a hinged connection such as a fold line 127*a*. The second corner panel 124*b* is hinged to a first end of the second side panel 118 by a hinged connection such as a fold line 123*b*. The fifth end closure panel 130*a* is hinged to an upper edge end of the fourth end closure panel 128*a* by a hinged connection such as a fold line 129*a*. The fifth end closure panel 130*a* is separated from the second top panel 120 by a cutline or severable line 131*a*.

The second end of the tubular structure is closed by a sixth end closure panel 122*b*, a seventh end closure panel 124*c*, a third corner panel 124*d*, an eighth end closure panel 126*b*, a ninth end closure panel 128*c*, a fourth corner panel 128*d* and a tenth end closure panel 130*b*. The sixth end closure panel 122*b* is hinged to an upper edge end of the seventh end closure panel 124*c* by a hinged connection such as a fold line 121*b*. The sixth end closure panel 122*b* is separated from the first top panel 112 by a cutline or severable line 133*b*. The seventh end closure panel 124*c* is hinged to a second end of a third corner panel 124*d* by a hinged connection in the form of a fold line 123*c*. The third corner panel 124*d* is hinged to a second end of the first side wall panel 114 by a hinged connection such as a fold line 123*d*. The eighth end closure panel 126*b* is hinged to a second end of the base panel 116 by a hinged connection such as a fold line 125*b*. The ninth end closure panel 128*c* is hinged to a second end of a fourth corner panel 128*d* by a hinged connection in the form of a fold line 127*c*. The fourth corner panel 124*d* is hinged to a second end of the second side wall panel 118 by a hinged connection such as a fold line 127*d*. The tenth end closure panel 130*b* is hinged to an upper edge end of the ninth end closure panel 128*c* by a hinged connection such as a fold line 129*b*. The tenth end closure panel 130*b* is separated from the second top panel 120 by a cutline or severable line 131*b*.

The first end closure panel 122*a* and the fifth end closure panel 130*a* each form securing panels at the first end of the tubular structure. The sixth end closure panel 122*b* and the tenth end closure panel 130*b* each form securing panels at the second end of the tubular structure.

In a setup condition the first end closure panel 122*a* is folded about fold line 121*a* to be substantially perpendicular with the second end closure panel 124*a*. The first end closure panel 122*a* is folded over the group of secondary packages disposed with the shipping carton 190. The fifth end closure panel 130*a* is folded about fold line 129*a* to be substantially perpendicular with the fourth end closure panel 128*a*. The fifth end closure panel 130*a* is folded over the group of secondary packages disposed with the shipping carton 190. The first end closure panel 122*a* and the fifth end closure panel 130*a* form an inner ply over which the first top panel 112 is folded to form an outer ply.

The first top panel 112 is secured to the first end closure panel 122*a* at one end and to the sixth end closure panel 122*b* at the other end.

The sixth end closure panel 122*b* is folded about fold line 121*b* to be substantially perpendicular with the seventh end closure panel 124*b*. The sixth end closure panel 122*b* is folded over the group of secondary packages disposed with the shipping carton 190. The tenth end closure panel 130*b* is folded about fold line 129*b* to be substantially perpendicular with the ninth end closure panel 128*c*. The tenth end closure panel 130*b* is folded over the group of secondary packages disposed with the shipping carton 190. The sixth end closure panel 122*b* and the tenth end closure panel 130*b* form an inner ply over which the second top panel 120 is folded to form an outer ply.

The second top panel 120 is secured to the fifth end closure panel 130*a* at one end and to the tenth end closure panel 130*b* at the other end.

The third end closure panel 126*a* and the eighth end closure panel 126*b* each form a lower end closure panels at opposing ends of the tubular structure. The third end closure panel 126*a* and the eighth end closure panel 126*b* extend substantially from the base panel 116 to the composite top wall 112/120 formed from the first and second top panels 112, 120. The third end closure panel 126*a* and the eighth end closure panel 126*b* are full depth panels that is to say, they have height substantially equal to the height of the first and second side panels 114, 118. (The third end closure panel 26*a* and the eighth end closure panel 26*b* of the embodiment of FIG. 1 are partial depth end closure panels, similarly the first, fifth, sixth and tenth end closure panels 22*a*, 30*a*, 22*b*, 30*b* are partial depth end closure panels.)

The second end closure panel 124*a* and the fourth end closure panel 128*a* each form a minor side end closure panel or dust flap at the first end of the tubular structure. The seventh end closure panel 124*c* and the ninth end closure panel 128*c* each form a minor side end closure panel or dust flap at the second end of the tubular structure.

The third end closure panel 126*a* is secured to the second end closure panel 124*a* and to the fourth end closure panel 128*a*.

The eighth end closure panel 126*b* is secured to the seventh end closure panel 124*c* and to the ninth end closure panel 128*c*.

Optionally, the second end closure panel 124*a* comprises a cutaway in the form of a first aperture A3 struck therefrom.

Optionally, the seventh end closure panel 124*b* comprises a cutaway in the form of a second aperture A4 struck therefrom.

Optionally, the third end closure panel 126*a* comprises a pair of cutaways in the form of a third aperture A5 and a fourth aperture A6 struck therefrom.

Optionally, the eighth end closure panel 126*b* comprises a pair of cutaways in the form of a fifth aperture A7 and a sixth aperture A8 struck therefrom.

Optionally, the fourth end closure panel 128*a* comprises a cutaway in the form of a seventh aperture A9 struck therefrom.

Optionally, the ninth end closure panel 128*c* comprises a cutaway in the form of an eighth aperture A10 struck therefrom.

The first and third apertures A3, A5 may be arranged to form a first opening in the first end of the shipping carton 190 when in a set-up condition. The fourth and seventh apertures A6, A9 may be arranged to form a second opening in the first end of the shipping carton 190 when in a set-up condition.

The second and fifth apertures A4, A7 may be arranged to form a third opening in the second end of the shipping carton 190 when in a set-up condition. The sixth and eighth apertures A8, A10 may be arranged to form a fourth opening in the second end of the shipping carton 190 when in a set-up condition.

Optionally, the base panel 116 comprises a pair of apertures A1, A2.

Referring now to FIGS. 19 to 27 there is shown an alternative embodiments of the present disclosure. In the fourth, fifth, sixth and seventh illustrated embodiments of the secondary carrier, like numerals have, where possible, been used to denote like parts, albeit with the addition of the prefix "1300, 1400, 1500, 1600" to indicate that these features belong to the fourth, fifth, sixth and seventh embodiments respectively. The fourth, fifth, sixth and seventh embodiments share many common features with the embodiments of FIGS. 3 to 9 and therefore only the differences from the embodiments illustrated in FIGS. 3 to 9 will be described in any greater detail.

Figure 19:
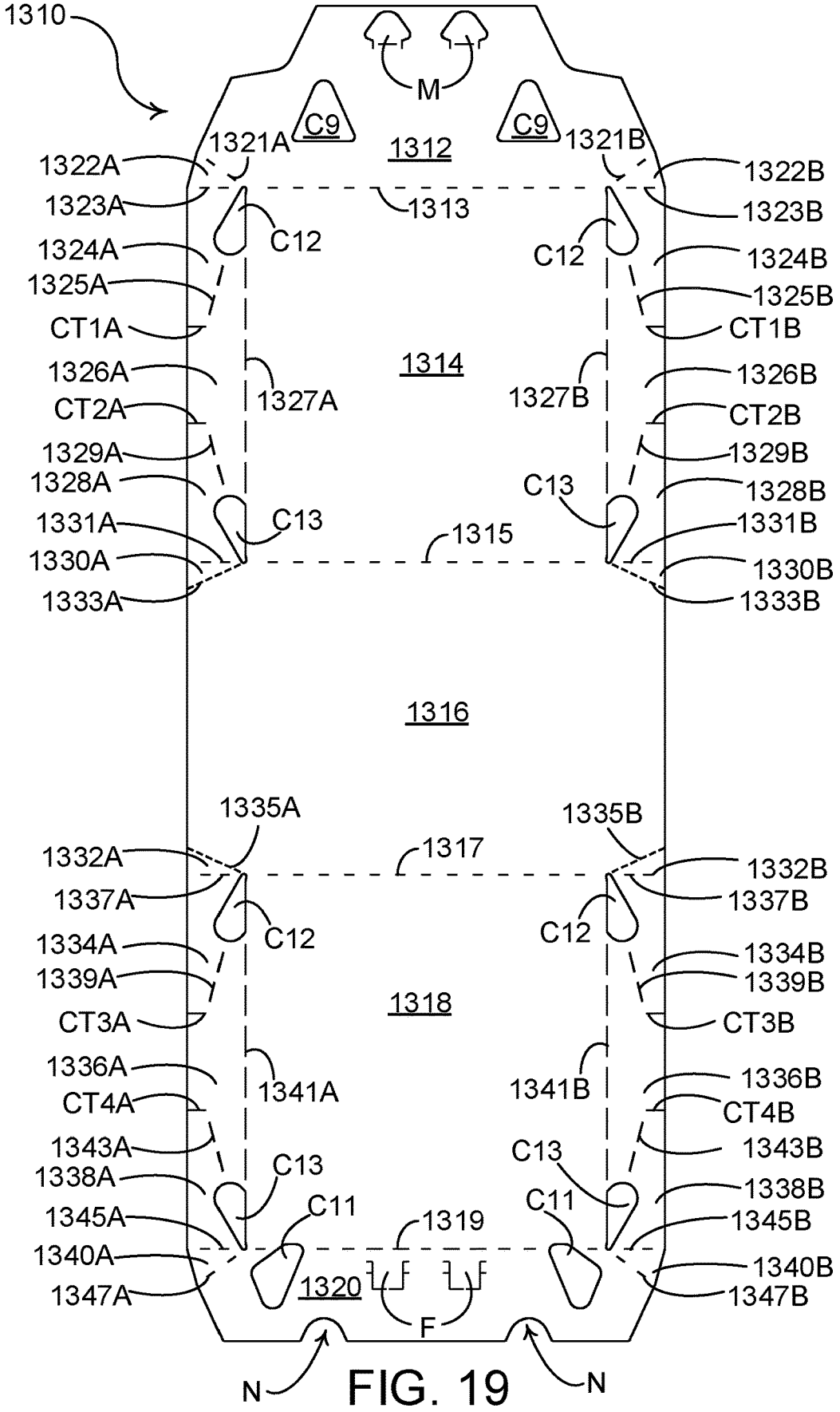
FIG. 19 is a plan view from above of a blank for forming a carrier of a secondary package according to a fourth embodiment.

FIG. 19 illustrates a blank 1310 for forming a secondary package or article carrier 1390 (see FIG. 20) according to a fourth embodiment. The blank 1310 comprises a plurality of main panels 1312, 1314, 1316, 1318, 1320 for forming a tubular structure. The plurality of main panels 1312, 1314, 1316, 1318, 1320 comprises a first base panel (or outer layer) 1312, a first side panel 1314, a top panel 1316, a second side panel 1318 and a second base panel or securing flap (or inner layer) 1320. The plurality of panels 1312, 1314, 1316, 1318, 1320 may be arranged in a linear series hinged one to the next by corresponding fold lines 1313, 1315, 1317, 1319.

The blank 1310 comprises a first base panel 1312 hinged to the first side panel 1314 by a hinged connection in the form of a fold line 1313. The blank 1310 comprises a second base panel 1320 hinged to the second side panel 1318 by a hinged connection in the form of a fold line 1319.

The first and second base panels 1312, 1320 are engageable with one another in an overlapping relationship to form a composite base wall 1312/1320 of the carrier 1390. The blank 1310 may comprise a complementary locking mechanism for securing the first base panel 1312 to the second base panel 1320. The first base panel 1312 may comprise at least one first part M of the complementary locking mechanism. The second base panel 1320 may comprise at least one second part F of the complementary locking mechanism. In the illustrated embodiment, the first base panel 1312 comprises two male tabs M struck therefrom so as to be defined within the first base panel 1312. Each of the male tabs M is hingedly connected to the first base panel 1312 by a hinged connection in the form of a fold line.

The second part F of the complementary locking mechanism forms a receiver. The receiver comprises an opening or slot for receiving the male tab M.

The second base panel 1320 comprises two optional female tabs each defining an opening or slot in the second base panel 1320; the female tabs forming at least part of the receiver.

The openings in the second base panel 1320 are configured to receive respective ones of the male tabs M.

The female tabs are arranged to be displaced out of the second base panel 1320 to form said openings and to bear against the respective male tab M when received therein. In some embodiments the complementary locking mechanism M/F may be omitted, the first and second base panels 1312, 1320 may be secured to each other by other means, such as but not limited to adhesive or staples.

Optionally, the first and second base panels 1312, 1320 may comprise at least one first aperture C9, C11. In the illustrated embodiment, each of the first and second base panels 1312, 1320 comprises two first apertures C9, C11. The first apertures C9, C11 may be employed to facilitate construction of the carton 1390. A packaging machine component or tool may engage with the first apertures C9, C11 to facilitate alignment of the first and second base panels 1312, 1320 with respect to each other or to align the first part M of the complementary locking mechanism with the second part F of the complementary locking mechanism. The complementary locking mechanism illustrated and described is entirely optional. Optionally, the second base panel 1320 comprises a pair of notches or recesses N each of which is arranged to be aligned with a respective one of the first apertures in the first base panel 1312.

The blank 1310 comprises end retention arrangements for securing endmost articles B within the carrier 1390. The end retention arrangements comprise a plurality of panels 1322A, 1324A, 1326A, 1328A, 1330A; 1322B, 1324B, 1326B, 1328B, 1330B; 1332A, 1334A, 1336A, 1338A, 1340A; 1332B, 1334B, 1336B, 1338B, 1340B adjacent end edges of the first and second side panel 1314, 1318.

Each of the end retention arrangements is substantially the same and will be described in further detail by reference to a first end retention arrangement adjacent a first end edge of the first side panel 1314. The first end retention arrangement comprises an anchor tab 1326A hingedly connected to the first end of the first side panel 1314 by a hinged connection in the form of a fold line 1327A. A lower retention panel 1324A is hingedly connected to a lower portion of the anchor tab 1326A by a hinged connection in the form of an oblique fold line 1325A which is inclined at an acute angle with respect to the fold line 1327A. An upper retention panel 1328A is hingedly connected to an upper portion of the anchor tab 1326A by a hinged connection in the form of an oblique fold line 1329A which is inclined at an acute angle with respect to the fold line 1327A.

The lower and upper retention panels 1324A, 1328A are partially separated from a central portion of the anchor tab 1326A by a pair of parallel cutlines CT1A, CT2A respectively. The lower and upper retention panels 1324A, 1328A may be generally trapezoidal in shape.

The lower retention panel 1324A is hingedly connected to a lower web panel 1322A by a hinged connection in the form of a fold line 1323A which is an extension of the fold line 1313 and aligned with the fold line 1313. The lower web panel 1322A is hingedly connected to the first base panel 1312 by a hinged connection in the form of a fold line 1321A which is inclined at an acute angle with respect to the fold line 1323A.

The upper retention panel 1328A is hingedly connected to an upper web panel 1330A by a hinged connection in the form of a fold line 1331A which is an extension of the fold line 1315 and aligned with the fold line 1315. The upper web panel 1330A is hingedly connected to the top panel 1316 by a hinged connection in the form of a fold line 1333A which is inclined at an acute angle with respect to the fold line 1331A.

Optionally, a first relief aperture C12 may be struck from material of the blank 1310 which would otherwise form the lower retention panel 1324A and the anchor tab 1326A. The first relief aperture C12 interrupts the fold lines 1321A, 1323A, 1325A and 1327A to provide a relief device at the notional point of intersection of fold lines 1321A, 1323A, 1325A and 1327A so as to facilitate folding of the first end retention arrangement.

Optionally, a second relief aperture C13 may be struck from material of the blank 1310 which would otherwise form the upper retention panel 1328A and the anchor tab 1326A. The second relief aperture C13 interrupts the fold lines 1327A, 1329A, 1331A and 1333A to provide a relief device at the notional point of intersection of fold lines 1327A, 1329A, 1331A and 1333A so as to facilitate folding of the first end retention arrangement.

Optionally, the first and second relief apertures C12, C13 are tapered for example but not limited to tear drop shaped.

Figure 20:
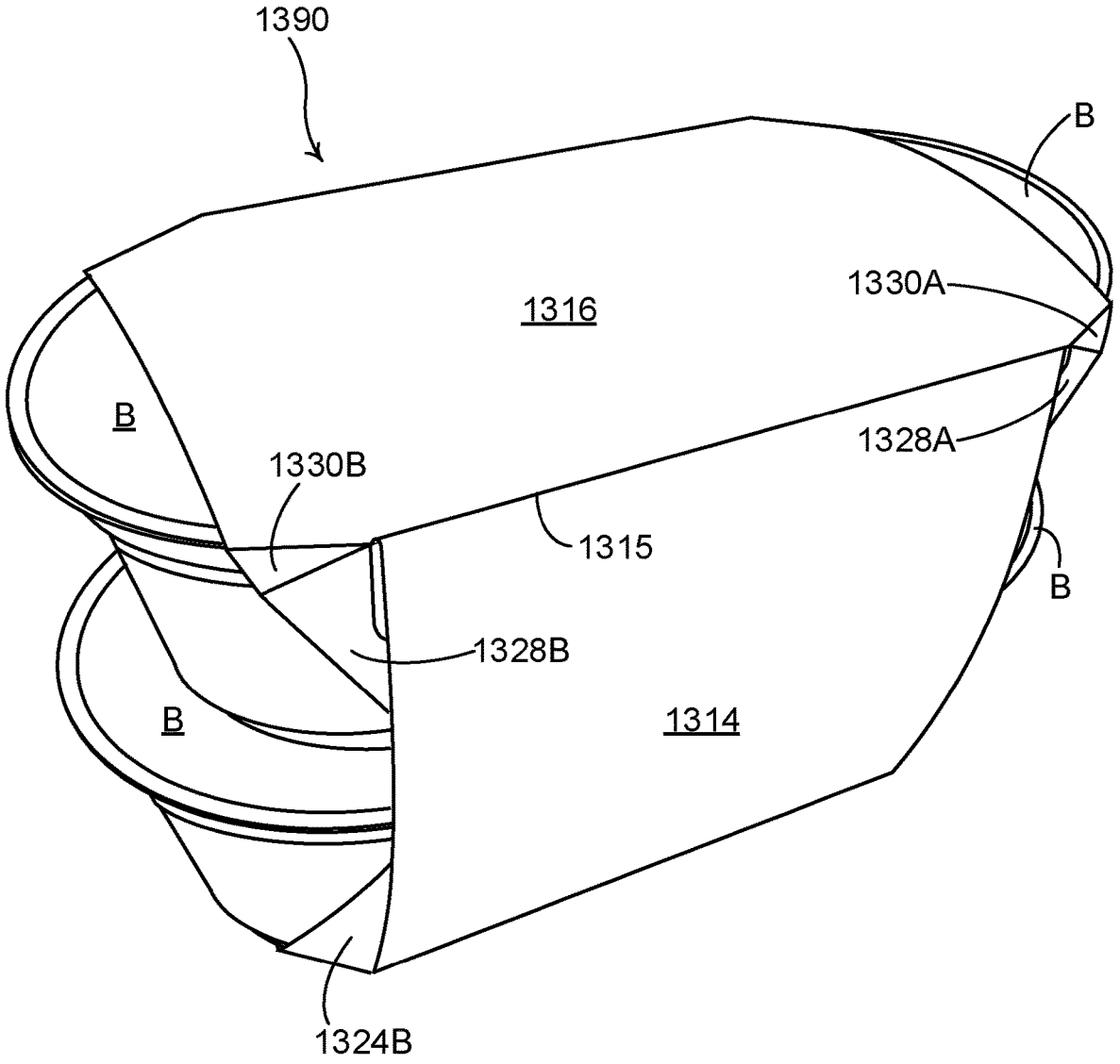
FIG. 20 is a perspective view from above of a secondary package comprising a secondary carrier formed from the blank of FIG. 19 loaded with a group of primary product containers or articles.

The blank 1310 is constructed into a carrier 1390, as shown in FIG. 20, by employing substantially the same method as previously described. During the process of folding the first and second side panels 1314, 1318 about opposing sides of the article group, the anchor tabs 1326A, 1326B, 1336A, 1336B are folded about fold lines 1327A, 1327B, 1341A, 1341B respectively to be brought into face to face relationship with the respective one of the first and second side panels 1314, 1318 to which they are hinged. The upper retention panels 1328A, 1328B, 1334A, 1334B and upper web panels 1330A, 1330B, 1332A, 1332B are folded automatically about upper portions of the endmost articles B in the upper tier of the article group to secure said articles B in the carrier 1390. The lower retention panels 1324A, 1324B, 1338A, 1338B are partially folded automatically about lower portions of the endmost articles B in the lower tier of the article group.

The second base panel 1320 is folded about fold line 1319 into proximity with the base of the article group, the first base panel 1312 is folded about fold line 1313 into proximity with the base of the article group so as to be in at least partial overlapping relationship with the second base panel 1320. In doing so the lower retention panels 1324A, 1324B, 1338A, 1338B and lower web panels 1322A, 1322B, 1340A, 1340B are folded automatically about lower portions of the endmost articles B in the lower tier of the article group to secure said articles B in the carrier 1390.

The first parts M of the complementary locking mechanism is engaged with respective second parts F of the complementary locking mechanism to secure the first base panel 1312 and the second base panel 1320 together.

FIG. 20 shows a secondary package comprising the secondary carrier 1390 loaded with a group of articles B. The ends of the end most articles B protrude through the partially open ends of the secondary carrier 1390. The top panel 1316 is shorter in length than the article group. The web panels 1322A, 1322B, 1340A, 1340B engage side edges of the endmost articles B in the upper tier of the article group. Each of the web panels 1322A, 1322B, 1340A, 1340B is defined in part by a pair of fold lines 1321A/1323A, 1321B/1323B, 1345A/1347A, 1345B/1347B. Each of the pairs of fold lines 1321A/1323A, 1321B/1323B, 1345A/1347A, 1345B/1347B are divergently arranged and define an angle therebetween, optionally the angle is in the range 10° to 90°, optionally between 20° and 50° and in the illustrated embodiment the angle is 25°.

Figure 21:
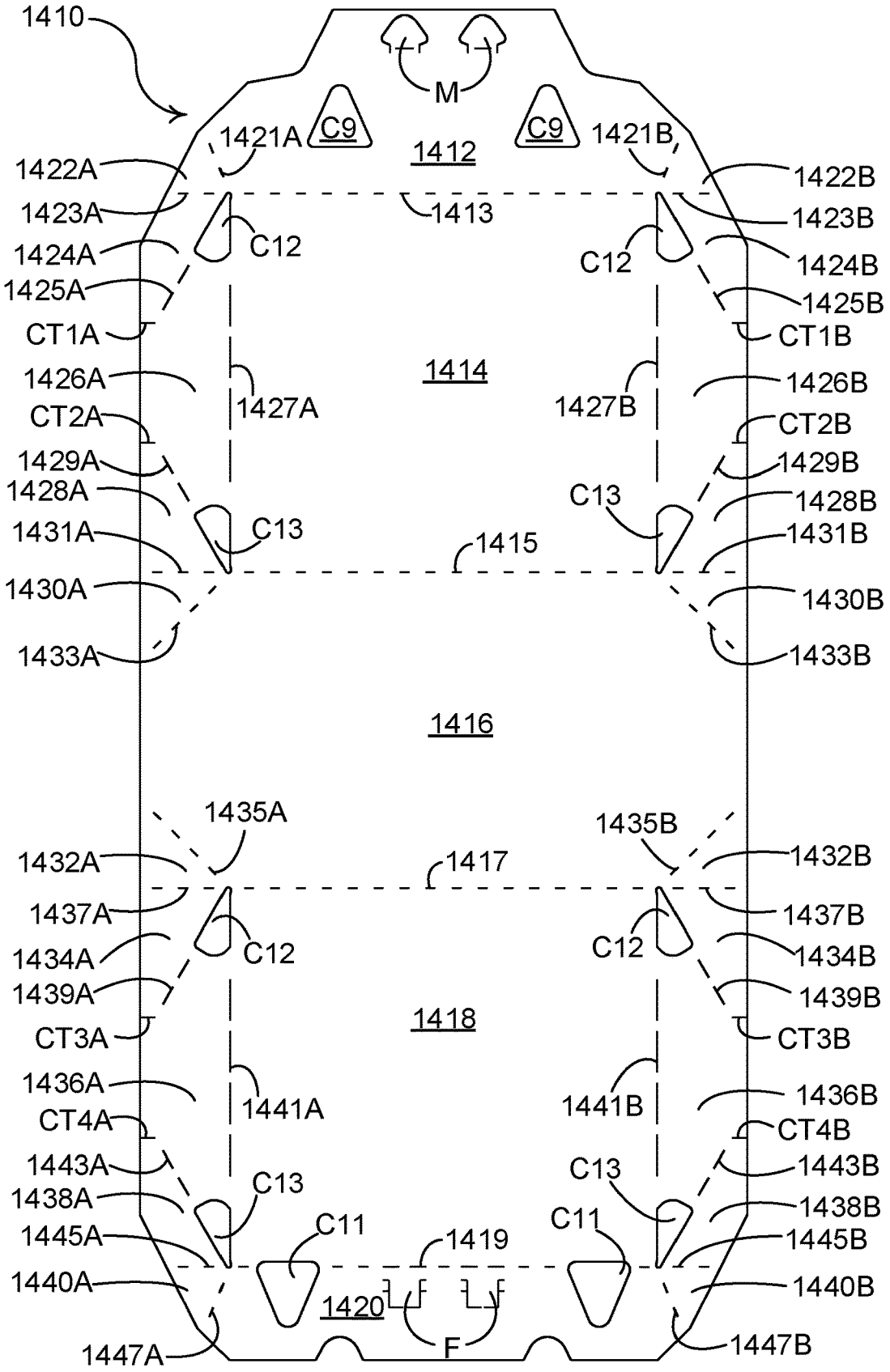
FIG. 21 is a plan view from above of a blank for forming a carrier of a secondary package according to a fifth embodiment.

FIG. 21 illustrates a blank 1410 for forming a secondary package or article carrier 1490 (see FIG. 22) according to a fifth embodiment. The blank 1410 comprises a plurality of main panels 1412, 1414, 1416, 1418, 1420 for forming a tubular structure. The plurality of main panels 1412, 1414, 1416, 1418, 1420 comprises a first base panel (or outer layer) 1412, a first side panel 1414, a top panel 1416, a second side panel 1418 and a second base panel or securing flap (or inner layer) 1420. The plurality of panels 1412, 1414, 1416, 1418, 1420 may be arranged in a linear series hinged one to the next by corresponding fold lines 1413, 1415, 1417, 1419.

The blank 1410 comprises a first base panel 1412 hinged to the first side panel 1414 by a hinged connection in the form of a fold line 1413. The blank 1410 comprises a second base panel 1420 hinged to the second side panel 1418 by a hinged connection in the form of a fold line 1419.

Figure 22:
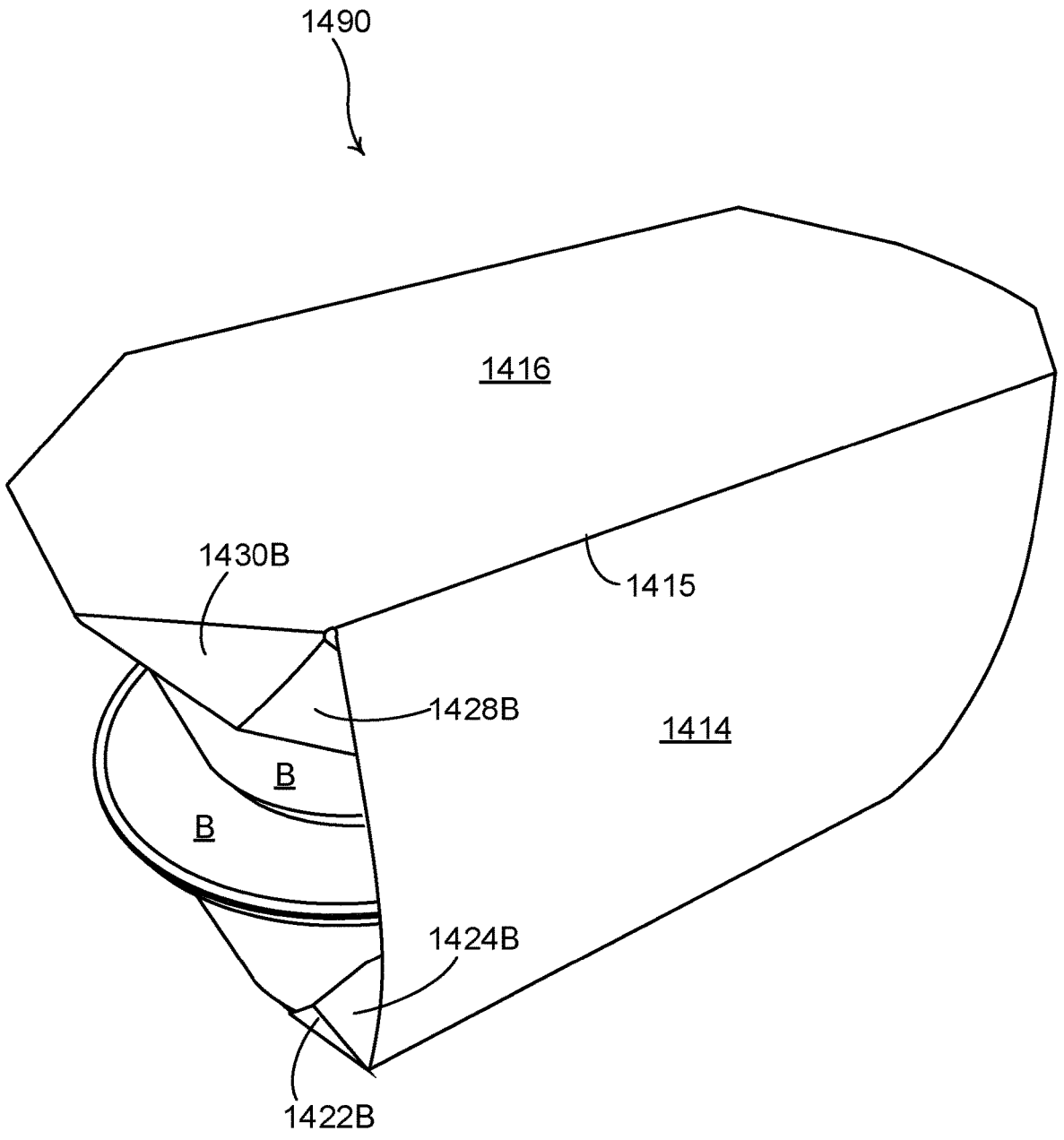
FIG. 22 is a perspective view from above of a secondary package comprising a secondary carrier formed from the blank of FIG. 21 loaded with a group of primary product containers or articles.

FIG. 22 shows a secondary package comprising the secondary carrier 1490 (formed from the blank 1410) loaded with a group of articles B. The tops of the end most articles B are fully covered so as to be protected by the top panel 1416. The top panel 1416 at least as long in dimension as the length of the article group. The web panels 1422A, 1422B, 1440A, 1440B engage side edges of the endmost articles B in the upper tier of the article group. Each of the web panels 1422A, 1422B, 1440A, 1440B is defined in part by a pair of fold lines 1421A/1423A, 1421B/1423B, 1445A/1447A, 1445B/1447B. Each of the pairs of fold lines 1421A/1423A, 1421B/1423B, 1445A/1447A, 1445B/1447B are divergently arranged and define an angle therebetween, optionally the angle is in the range 10° to 90°, optionally between 20° and 50° and in the illustrated embodiment the angle is 45°.

The web panels 1422A, 1422B, 1440A, 1440B extend further about the sides of the end most articles B in the upper tier of the article group than the web panels 1322A, 1322B, 1340A, 1340B of the embodiment of FIG. 20.

Figure 23:
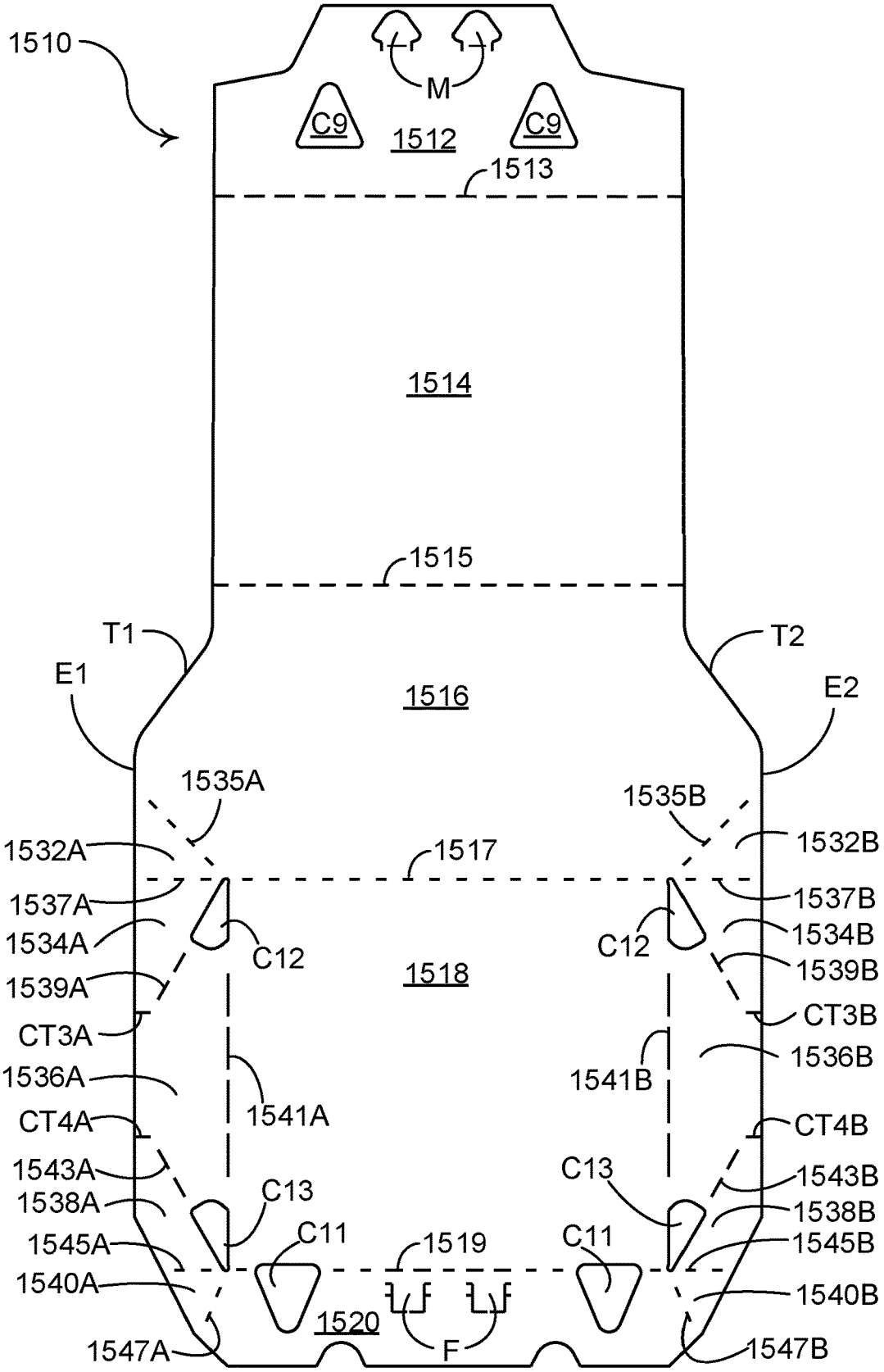
FIG. 23 is a plan view from above of a blank for forming a carrier of a secondary package according to a sixth embodiment.

FIG. 23 illustrates a blank 1510 for forming a secondary package or article carrier 1590 (see FIGS. 24 and 25) according to a sixth embodiment. The blank 1510 comprises a plurality of main panels 1512, 1514, 1516, 1518, 1520 for forming a tubular structure. The plurality of main panels 1512, 1514, 1516, 1518, 1520 comprises a first base panel (or outer layer) 1512, a first side panel 1514, a top panel 1516, a second side panel 1518 and a second base panel or securing flap (or inner layer) 1520. The plurality of panels 1512, 1514, 1516, 1518, 1520 may be arranged in a linear series hinged one to the next by corresponding fold lines 1513, 1515, 1517, 1519.

The first side panel 1514 is similar in construction to the first side panel 1014 of the embodiment of FIG. 3. The first side panel 1514 comprises two opposed free end edges, that is to say, the opposed end edges are free of connection to other panels, such as the first and second end retention arrangements provided in the embodiments of FIGS. 19 and 21.

The top panel 1516 is similar in construction to the top panel 1016 of the embodiment of FIG. 3. The top panel 1516 comprises a pair of opposed free end edges. Each of the pair of opposed free end edges comprises a contoured or tapered portion T1, T2. In this way the top panel 1516 comprises a first hinged edge, defined by fold line 1517, which is longer in dimension than a second hinged edge, defined by fold line 1515.

The top panel 1516 is shaped such that a portion of each endmost article B projects or extends beyond a portion of each one of the opposed free end edges, the exposed portions the endmost article B are disposed adjacent to first side panel 1514 and the shorter second hinged edge. The tapered portions T1, T2 have the effect of insetting the adjacent corners of the top panel 1516 on a first side of the group of articles B being packaged.

In the embodiment of FIG. 23 the tapered portions T1, T2 of the opposed free end edges are closer in proximity to the second hinged edge than the first hinged edge.

The blank 1510 comprises an end retention arrangement at opposed ends of the second side panel 1518; the end retention arrangements secure endmost articles B within the carrier 1590. The end retention arrangements comprise a plurality of panels 1532A, 1534A, 1536A, 1538A, 1540A; 1532B, 1534B, 1536B, 1538B, 1540B adjacent end edges of the first and second side panel 1314, 1318.

Each of the end retention arrangements is substantially the same in construction as the end retention arrangements of the embodiment of FIG. 19 and will be described in further detail by reference to a first end retention arrangement adjacent a first end edge of the second side panel 1518. The first end retention arrangement comprises an anchor tab 1536A hingedly connected to the first end of the second side panel 1518 by a hinged connection in the form of a fold line 1541A. A lower retention panel 1538A is hingedly connected to a lower portion of the anchor tab 1536A by a hinged connection in the form of an oblique fold line 1543A which is inclined at an acute angle with respect to the fold line 1541A. An upper retention panel 1534A is hingedly connected to an upper portion of the anchor tab 1536A by a hinged connection in the form of an oblique fold line 1539A which is inclined at an acute angle with respect to the fold line 1541A.

The lower and upper retention panels 1538A, 1534A are partially separated from a central portion of the anchor tab 1536A by a pair of parallel cutlines CT4A, CT3A respectively. The lower and upper retention panels 1538A, 1534A may be generally trapezoidal in shape.

The lower retention panel 1538A is hingedly connected to a lower web panel 1540A by a hinged connection in the form of a fold line 1545A which is an extension of the fold line 1519 and aligned with the fold line 1519. The lower web panel 1540A is hingedly connected to the second base panel 1520 by a hinged connection in the form of a fold line 1547A which is inclined at an acute angle with respect to the fold line 1545A.

The upper retention panel 1532A is hingedly connected to an upper web panel 1534A by a hinged connection in the form of a fold line 1537A which is an extension of the fold line 1517 and aligned with the fold line 1517. The upper web panel 1532A is hingedly connected to the top panel 1516 by a hinged connection in the form of a fold line 1535A which is inclined at an acute angle with respect to the fold line 1537A.

Optionally, a first relief aperture C12 may be struck from material of the blank 1510 which would otherwise form the upper retention tab 1534A and the anchor tab 1536A. The first relief aperture C12 interrupts the fold lines 1541A, 1539A, 1537A and 1532A to provide a relief device at the notional point of intersection of fold lines 1541A, 1539A, 1537A and 1532A so as to facilitate folding of the first end retention arrangement.

Optionally, a second relief aperture C13 may be struck from material of the blank 1510 which would otherwise form the lower retention panel 1538A and the anchor tab 1536A. The second relief aperture C13 interrupts the fold lines 1541A, 1543A, 1545A and 1547A to provide a relief device at the notional point of intersection of fold lines 1541A, 1543A, 1545A and 1547A so as to facilitate folding of the first end retention arrangement.

Optionally, the first and second relief apertures C12, C13 are tapered for example but not limited to tear drop shaped.

Figure 26:
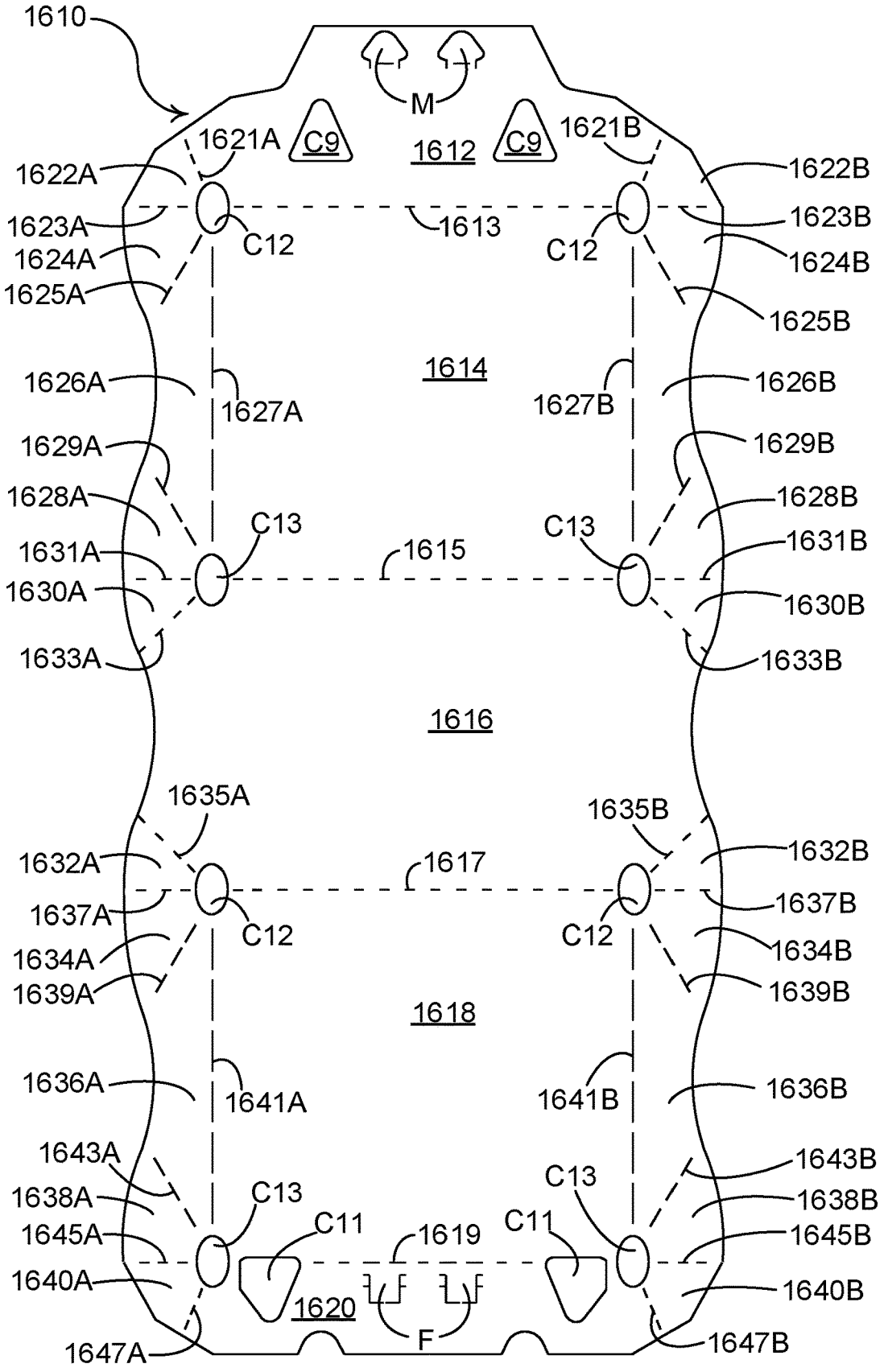
FIG. 26 is a plan view from above of a blank for forming a carrier of a secondary package according to a seventh embodiment.
Figure 27:
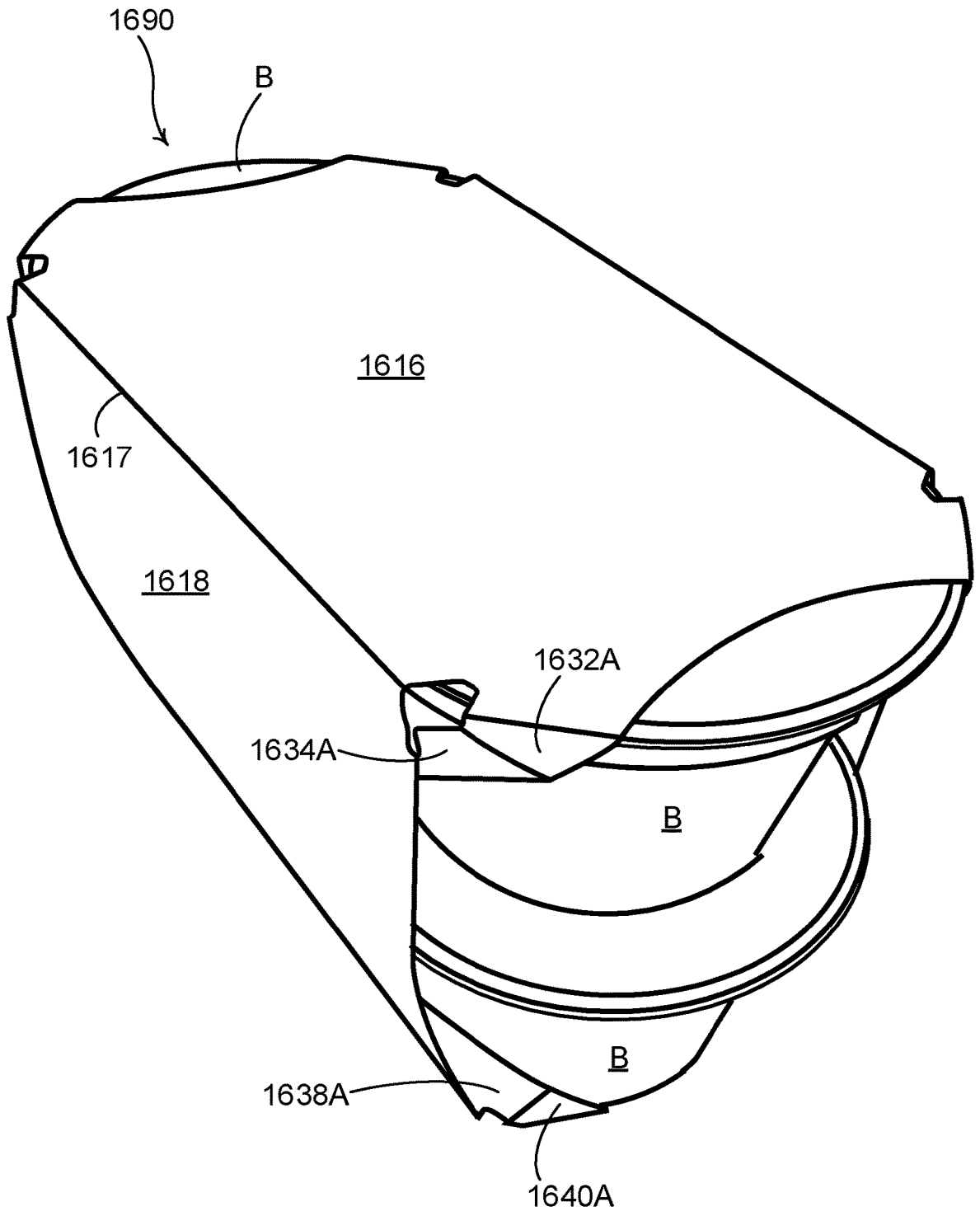
FIG. 27 is a perspective view from above of a secondary package comprising a secondary carrier formed from the blank of FIG. 26 loaded with a group of primary product containers or articles.

FIG. 26 illustrates a blank 1610 for forming a secondary package or article carrier 1690 (see FIG. 27) according to a seventh embodiment. The blank 1610 comprises a plurality of main panels 1612, 1614, 1616, 1618, 1620 for forming a tubular structure. The plurality of main panels 1612, 1614, 1616, 1618, 1620 comprises a first base panel (or outer layer) 1612, a first side panel 1614, a top panel 1616, a second side panel 1618 and a second base panel or securing flap (or inner layer) 1620. The plurality of panels 1612, 1614, 1616, 1618, 1620 may be arranged in a linear series hinged one to the next by corresponding fold lines 1613, 1615, 1617, 1619.

Opposed end edges of the blank 1610 are curvilinear in shape, the end edges are wave like in shape so that the blank 1610 is wider in the regions of the web panels 1622B, 1662B, 1630A, 1630B, 1632A, 1632B, 1640A, 1640B. The contoured shape of the end edges of the blank 1610 may facilitate nesting or tessellation of the blank 1610 with like blanks. In this way great number of blanks 1610 may be cut from a given area of sheet material compared to the blank 1410 of FIG. 21, where the blank 1410 and the blank 1610 are arranged to accommodate an article group of the same size and arrangement.

The relief apertures C12, C13 are elliptical in shape, and are struck in part from a respective one of the top panel 1616, first base panel 1612 or second base panel 1620.

The first apertures C11, struck from the second base panel 1620, are adapted to accommodate the relief apertures C13; the first apertures C11 take a trapezoidal form in the embodiment of FIG. 26, other shapes may be employed.

Figure 28:
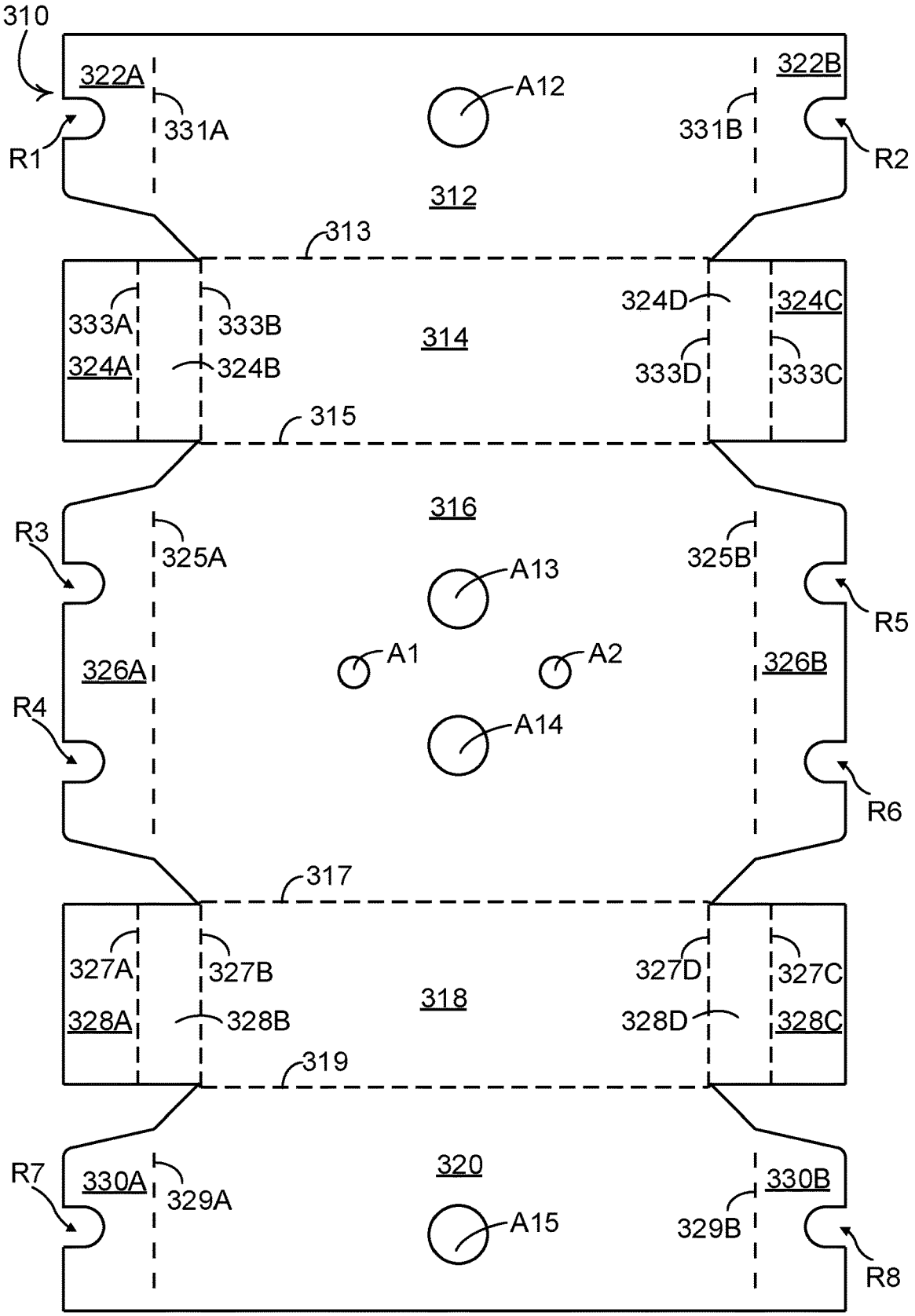
FIG. 28 is a plan view from above of a further alternative blank for forming a further alternative tertiary package or shipping carton according to various embodiments of the invention.
Figure 29:
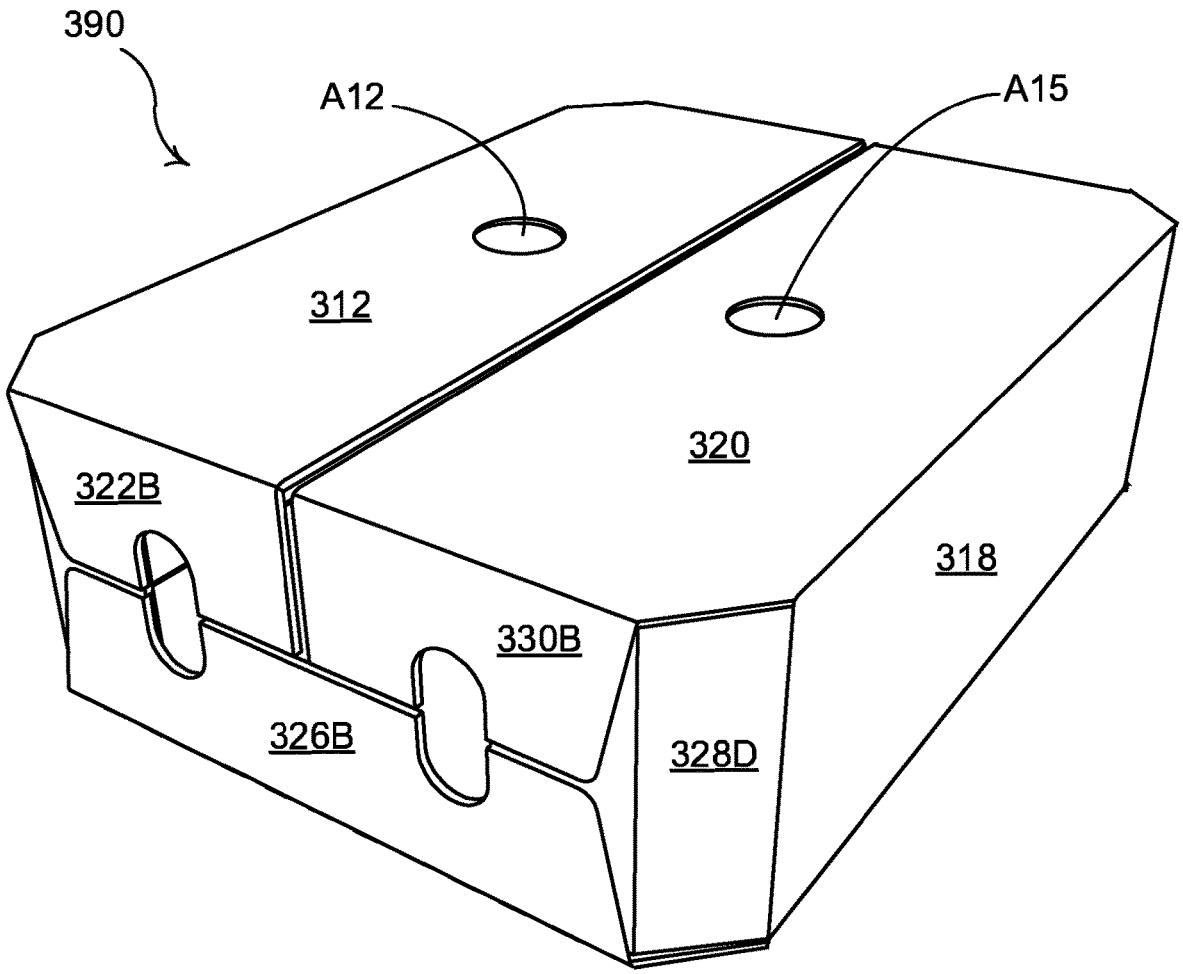
FIG. 29 is a perspective view from above of the further alternative tertiary package constructed from the blank of FIG. 28.

Referring now to FIGS. 28 and 29 there is shown a yet a further alternative embodiment of the shipping carton of the present disclosure. In this fourth illustrated embodiment, like numerals have, where possible, been used to denote like parts, albeit with the addition of the prefix "300". The fourth illustrated embodiment shares many common features with the embodiments of FIGS. 1, 2, 16 and 17 and therefore only the differences from the embodiments illustrated in FIGS. 1, 2, 16 and 17 will be described in any greater detail.

The blank 310 and shipping carton 390 of FIGS. 28 and 29 respectively may be employed with any of the secondary packages described and/or illustrated.

Referring now to FIG. 28, the blank 310 comprises a series of main panels for forming the main walls of a tertiary package or shipping carton 390. The series of main panels comprises: a first top panel 312, a first side panel 314, a base panel 316, a second side panel 318 and a second top panel 320. Optionally the series of main panels 312, 314, 316, 318, 320, are hinged together in a linear series by hinged connections in the form of fold lines 313, 315, 317, 319.

Figures 30A, 30B, 30C:
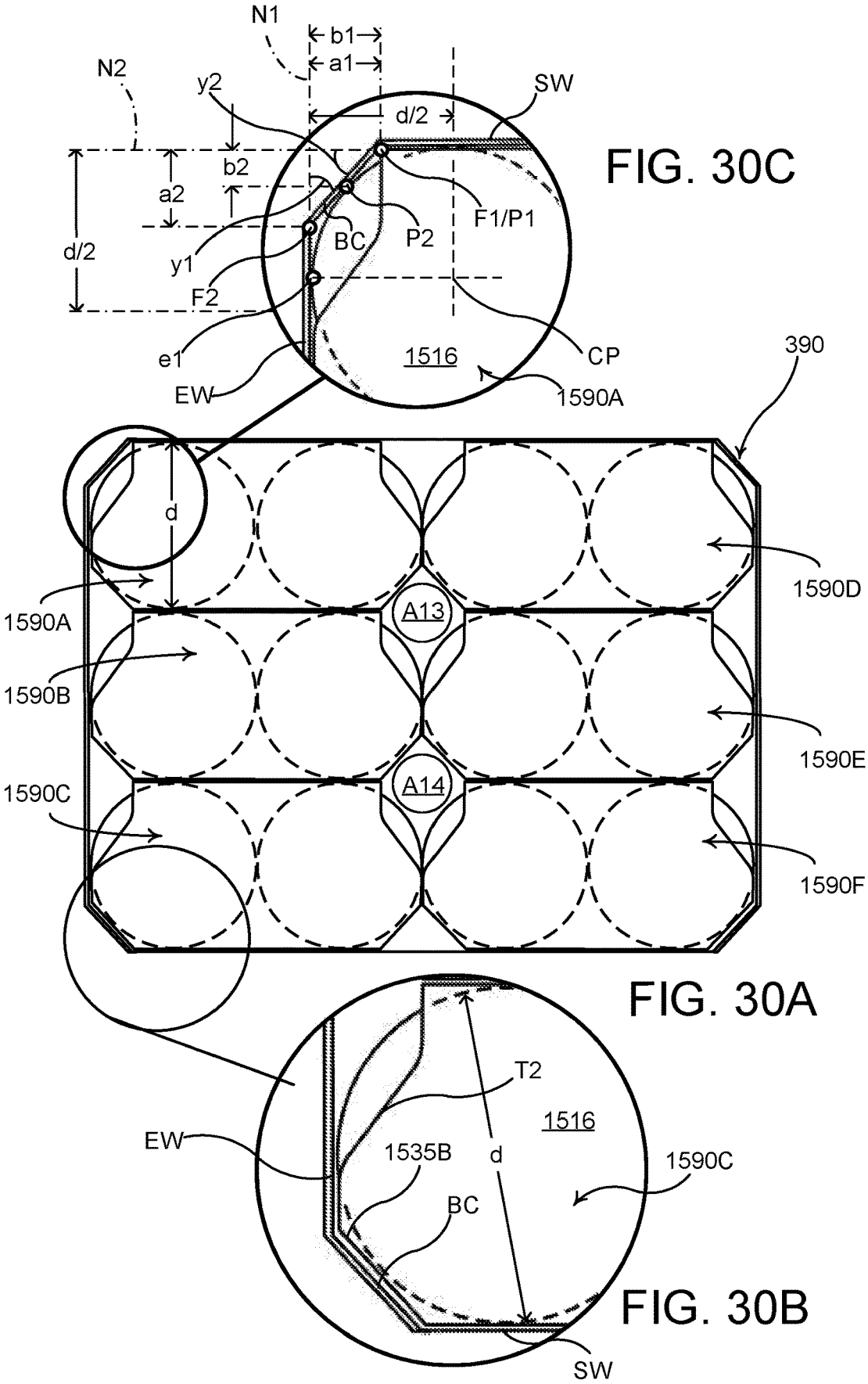
FIG. 30A is a top view of a stage of construction of a package system comprising the shipping carton of FIG. 2, loaded with an arrangement of a plurality of secondary carriers of FIG. 24 (each secondary carrier being loaded with a plurality of primary product containers), in the illustration one of the top panels has been omitted for illustrative purposes.
FIG. 30B is an enlarged view of a first corner portion of the package system of FIG. 30A.
FIG. 30C is an enlarged view of a second corner portion of the package system of FIG. 30A.

The blank 310 comprises a first opening A12 in the first top panel 312. The blank 310 comprises a second opening A15 in the second top panel 320. The blank 310 comprises a four openings A1, A2, A13, A14 in the base panel 316. The first opening A12, second opening A15 a third opening A13 and a fourth opening A14 are arranged collinearly with each other. In an assembled tertiary package 390, the first opening A12 is vertically aligned with the third opening A13, the second opening A15 is vertically aligned with the fourth opening A14. When the tertiary package 390 is employed with the packages such as the secondary carriers 1590 for FIGS. 24 and 25 the first and third openings A12, A13 are aligned with a void between a first group of four secondary packages 1590A, 1590B, 1590D, 1590E, the second and fourth openings A15, A14 are aligned with a void between a second group of four secondary packages 1590B, 1590C, 1590E, 1590F, as illustrated in FIG. 30A, the first and second top panel 312, 320 have been omitted for illustrative purposes.

The alignment of the openings A12/A13, A15/A14 with voids between secondary packages creates an air passage way to provide ventilation which may facilitate cooling of refrigerated products.

FIGS. 30C, 31A-D and 32A-C illustrate corner portions of various packaging systems, the package systems employ a tertiary package comprising opposed end walls EW and opposed side walls SW. A corner panel BC couples each end wall EW to one of the opposed side walls SW. The FIGS. 30C, 31A-D and 32A-C show only one corner of the package system, it will be appreciated that at least one other corner of the package system will be similarly arranged, and in some embodiments all corners of the package system are similarly arranged.

The package system is a combination of a tertiary carton and a plurality of packages received in the tertiary carton. The plurality of packages each comprise a secondary carton having a tubular structure and one or more generally cylindrical primary containers each received at least in part in the secondary carton. The primary containers each comprise a maximum diameter or maximum lateral dimension d.

The tertiary carton comprises a bottom panel (not shown in FIGS. 30C, 31A-D and 32A-C) and a plurality of side 14, 18; 114; 118; 314, 318 and end 22A, 24A, 26A, 28A, 30A, 22B, 24B, 26B, 28B, 30B; 122A, 124A, 126A, 128A, 130A, 122B, 124B, 126B, 128B, 130B; 322A, 324A, 326A, 328A, 330A, 322B, 324B, 326B, 328B, 330B panels each extending upward from the bottom panel to form the opposed side walls SW and the opposed end walls EW. The plurality of side and end walls SW, EW include a first side wall SW and a first end wall EW disposed at about a right angle with respect to one another. A bevelled corner panel BC hingedly connects between the first side wall SW and the first end wall EW. The bevelled corner panel BC is hingedly connected to the first side wall SW by first fold line F1. The bevelled corner panel BC is hingedly connected to the first end wall SW by second fold line F2.

Referring to FIG. 30C there is shown a tertiary carton 390 (see FIG. 30A) which is loaded with six secondary cartons 1590A to 1590F.

The inside surface of the first end wall EW lies on or defines a first notional plane N1. The fold line F1 between the corner panel BC and the first side wall SW is spaced a distance a1 from the first notional plane N1 containing the inside surface of the first end wall EW.

The inside surface of the first side wall SW lies on or defines a second notional plane N2. The fold line F2 between the corner panel BC and the first end wall EW is spaced a distance a2 from the second notional plane N2 containing the inside surface of the first side wall SW.

The first notional line N1 defines a first angle y1 with the corner panel BC. The second notional line N2 defines a second angle y2 with the corner panel BC. The first angle y1 is equal to the second angle y2. The second angle y2 is 45°. The first angle y1 is 45°.

The secondary package 1590 comprises a terminal end e1, the terminal end e1 is disposed facing the inside surface of the first end wall EW. The terminal end e1 of secondary package 1590 is provided by a protruding portion of an endmost article B. A tubular axis of the secondary carton 1590 extends generally perpendicularly to the first end wall EW. One of the carton side panels 1514 of the secondary carton 1590 is in contact with the first side wall SW.

The secondary carton 1590 comprises one or more primary containers each of which is disposed with their cylindrical axes extending generally perpendicularly to the bottom panel of the tertiary package 390.

The terminal end e1 of the secondary package 1590 lies on or defines a third notional plane. The secondary package 1590 comprises a maximum width point P1 along an end edge of the one carton side panel 1514 adjacent to the corner panel BC.

The maximum width point P1 defines the maximum width of the secondary carton 1590 extending between itself and a point on the other carton side panel 1518 of the secondary carton 1590. The notional plane containing the terminal end e1 is parallel to or contains the inside surface of the first end wall EW.

The maximum width point P1 of the secondary package 1590 is spaced a distance b1 from the third notional plane containing the terminal end e1 of the secondary package 1590.

The maximum width point P1 is spaced apart from the first fold line F1, the maximum width point P1 being closer to the centre of the secondary carton 1590A than the first fold line F1.

The secondary package, more specifically the endmost article B is in contact with the corner panel or closer to the corner panel than any other points on the corner package (excluding the maximum width point P1) at a second point P2.

The second point P2 of the secondary package 1590 lies on or defines a fourth notional plane which is spaced apart from the second notional plane N2 by distance b2. The distance a2 is equal to or greater than a distance b2, (a2≥b2).

In the embodiment of FIG. 30C the distance a2 is greater than the distance b2. The distance a1 is equal to the distance b1.

The second point P2 is spaced apart from the maximum width point P1.

Figure 31A:
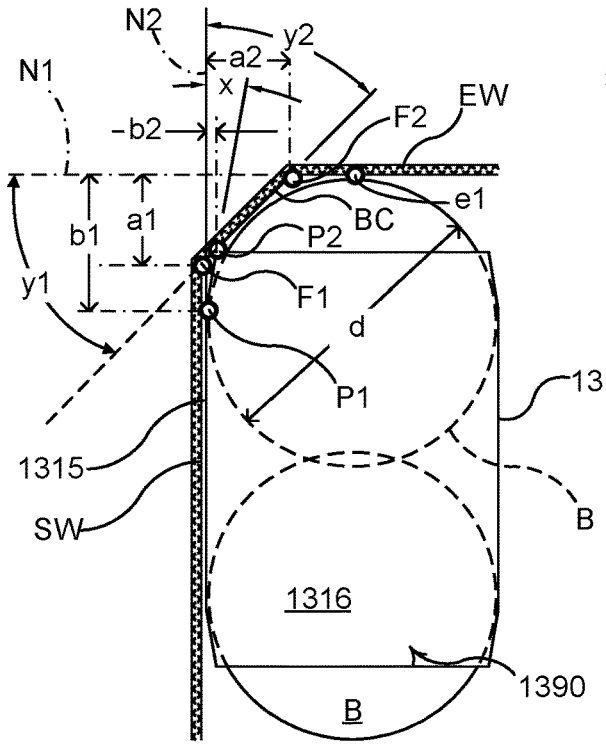
FIGS. 31A to 31D and FIGS. 32A to 32C show various arrangements of primary products container employed with secondary carriers disposed within a tertiary package.

Referring to FIG. 31A there is shown a tertiary carton 90; 190; 390 which is loaded with at least one secondary carton 1390. The secondary carton 1390 of FIG. 31A is substantially similar to that shown in FIGS. 19 and 20.

The inside surface of the first end wall EW lies on or defines a first notional plane N1. The fold line F1 between the corner panel BC and the first side wall SW is spaced a distance a1 from the first notional plane N1 containing the inside surface of the first end wall EW.

The inside surface of the first side wall SW lies on or defines a second notional plane N2. The fold line F2 between the corner panel BC and the first end wall EW is spaced a distance a2 from the second notional plane N2 containing the inside surface of the first side wall SW.

The second notional line N2 defines a second angle y2 with the corner panel BC. The second notional line N2 defines a third angle x with the web panel 1322A, 1322B, 1335A, 1335B or at least with the fold line 1321A, 1321B, 1335A, 1335B hinging the web panel 1322A, 1322B, 1335A, 1335B to the top panel 1316.

The second angle y2 is larger than the third angle x. The second angle y2 is 45°. The third angle x is 10°.

In the embodiment of FIG. 31A the distance a2 is greater than the distance b2. The distance a1 is greater than the distance b1.

Figure 31B:
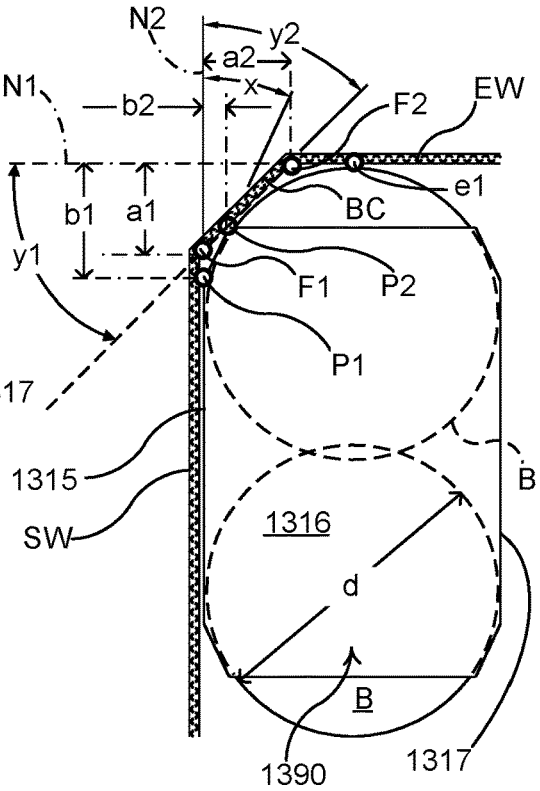

In the embodiment of FIG. 31B the third angle x is increased to 25°. The second point P2 is spaced further from the first fold line and from the second notional plane.

Figure 31C:
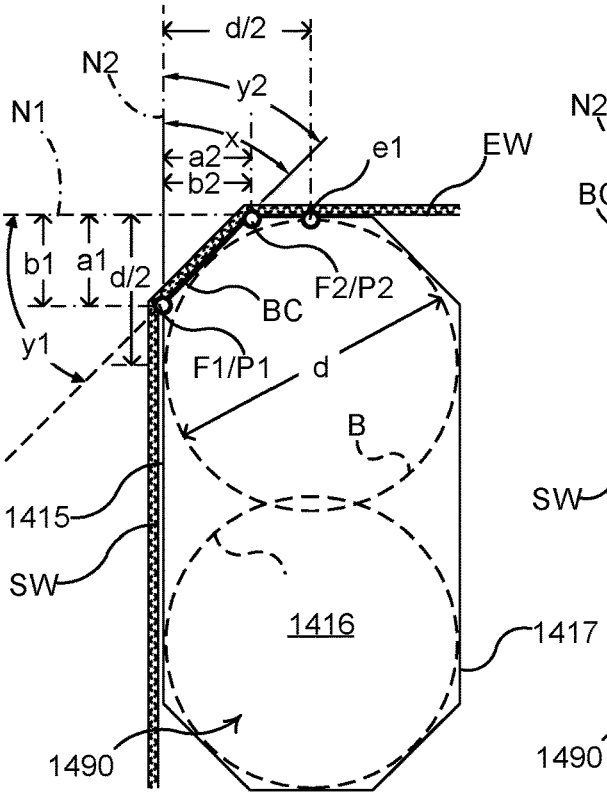

Referring to FIG. 31C there is shown a tertiary carton 90; 190; 390 which is loaded with at least one secondary carton 1490. The secondary carton 1490 of FIG. 31C is substantially similar to that shown in FIGS. 21 and 22.

The terminal end e1 of secondary package 1490 is provided by an end of the top panel 1416 or by an end of the top panel 1416 and an end of the endmost article B.

The second angle y2 is equal to the third angle x. The second angle y2 is 45°. The third angle x is 45°.

The maximum width point P1 is substantially coincident with the first fold line F1. The second point P2 is substantially coincident with the second fold line F2.

In the embodiment of FIG. 31C the distance a2 is equal to the distance b2. The distance a1 is equal to the distance b1.

Figure 31D:
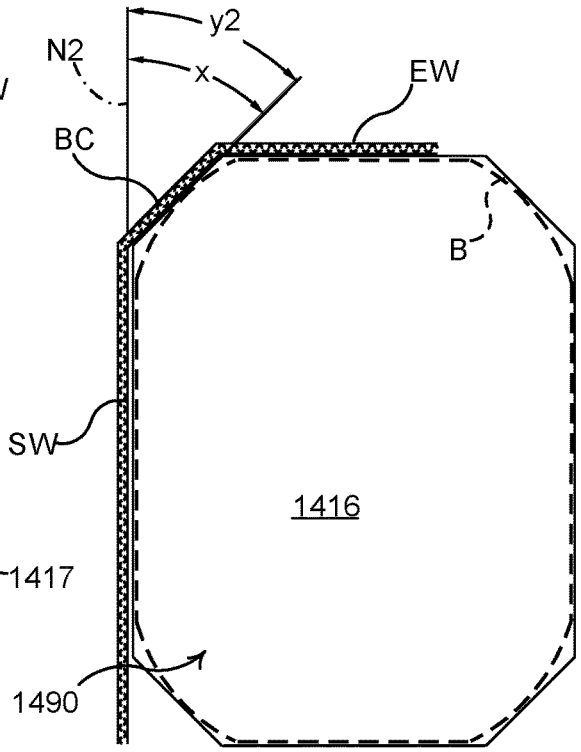

FIG. 31D illustrates similar arrangement to the embodiment of FIG. 31C, in this embodiment however the secondary carton 1490 is adapted to accommodate a primary product container or article B which is rectangular in shape albeit with rounded corners.

Figure 32A:
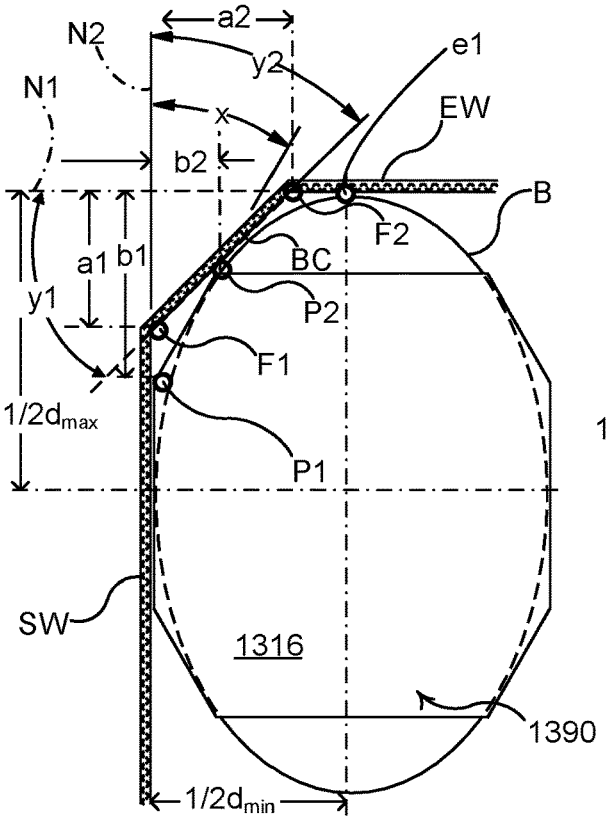

FIG. 32A illustrates similar arrangement to the embodiment of FIG. 31B, in this embodiment however the secondary carton 1390 is adapted to accommodate a primary product container or article B which is elliptical in shape. The second angle y2 is greater than the third angle x. The second angle y2 is 45°. The third angle x is 30°.

Figure 32B:
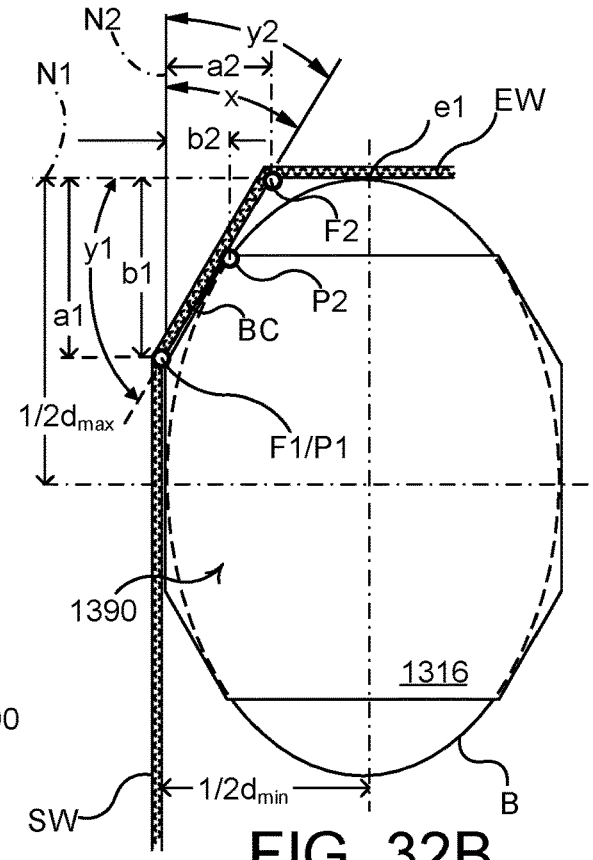

FIG. 32B illustrates similar arrangement to the embodiment of FIG. 32A, in this embodiment however the tertiary package is adapted such that the second angle y2 is equal the third angle x. The second angle y2 is 30°. The third angle x is 30°. The first angle y1 is 60°. The distance a2 is greater than the distance b2. The distance a1 is equal to the distance b1. The maximum width point P1 is substantially coincident with the first fold line F1. The second point P2 is spaced apart from the second fold line F2.

Figure 32C:
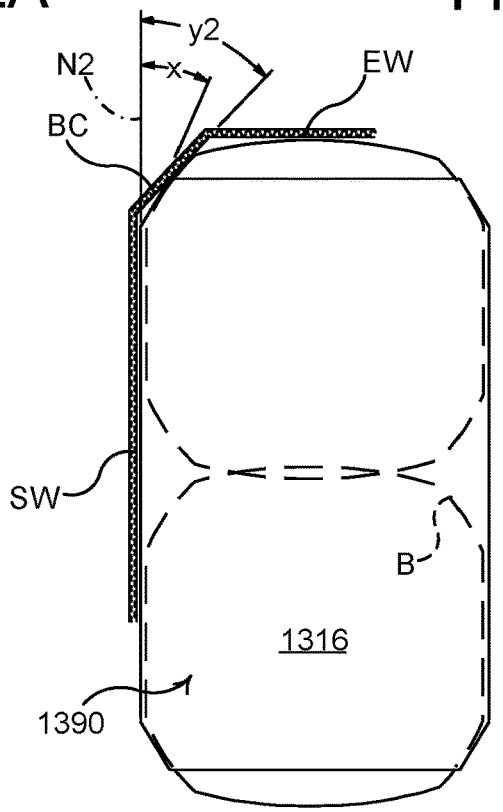

FIG. 32C illustrates similar arrangement to the embodiment of FIG. 31D, in this embodiment however the secondary carton 1490 is adapted to accommodate at least primary product container or articles B which are squircular in shape that is to say substantially squared shaped with rounded corners.

The combinations or package systems of FIGS. 30C, 31A-D and 32A-C are characterized by the following formulae:

$$a1 \leq \frac{1}{2}d;$$

$$a2 \leq \frac{1}{2}d; \text{ and}$$

$$a1 \leq b1$$

The first, second, third and fourth openings in the end walls, the first, second, third and fourth openings in the top and bottom panels together with the pair of apertures A1, A2 in the base panel 116 may provide ventilation orifices.

The tertiary shipping cartons 90; 190; 290 (shown in FIGS. 2, 17 and 18) each comprise four corner panels 24*b*, 24*d*, 28*b*, 28*d*; 124*b*, 124*d*, 128*b*, 128*d*. The secondary packaging containers 1090; 1190; 1290 are shaped to be arranged to fit internally of and fit snugly with the bevelled corner structures of the tertiary shipping carton 90; 190; 290. Multiple tertiary shipping cartons 90; 190; 290 can be stacked one on top of the next due to the robust and strong structure. The stacking strength of the tertiary shipping cartons 90; 190; 290 may be enhanced by the provision of the beveled corner structures.

The present disclosure provides a secondary carrier 1090; 1190; 1290 having a top 1016; 1116; 1212/1220 and/or bottom 1012/1020; 1112/1120; 1216 panel which is asymmetrical in shape. The secondary carrier may comprise a 1090; 1190; 1290 having a top 1016; 1116; 1212/1220 and/or bottom 1012/1020; 1112/1120; 1216 panel which is generally trapezoidal in shape. The secondary carrier 1090; 1190; 1290 comprises a tubular structure having first open end and a second opposing open end. The top panel 1016; 1116; 1212/1220 is shaped to expose a portion of a first article 1 at the first end of the carrier and to expose a portion of a second article B2 at the second end of the carrier. Each of the portions of the first and second articles 1, B2 exposed are located adjacent to a first side wall 1014; 1114; 1214 of the tubular structure.

The secondary carrier 1090; 1190; 1290 can be placed within tertiary package 190; 190; 290 having mitred or beveled corner provided by one or more corner panels 24*b*, 24*d*, 28*b*, 28*d*; 124*b*, 124*d*, 128*b*, 128*d*. The corner panels 24*b*, 24*d*, 28*b*, 28*d*; 124*b*, 124*d*, 128*b*, 128*d* may be hinged or coupled to a side 14, 18; 114, 118 or end 24*a*, 24*c*, 28*a*, 28*c*; 124*a*, 124*c*, 128*a*, 128*c* panel of the tertiary package 190; 190; 290. The secondary carriers can be loaded such that one of the first or second articles is disposed in close proximity to or touching contact with one of the corner panels of the tertiary package. In some embodiments at least four secondary carriers are loaded into a tertiary package. The secondary carriers are arranged such that an endmost article from each secondary carrier is disposed close proximity to or touching contact with a respective one of each of the corner panels of the tertiary package.

The top or bottom panel of the secondary carrier comprise first and second opposed longitudinal edges H1, H2. At least one of the first and second longitudinal edges may be shorter in dimension L1, L3 than a longitudinal dimension L2 of a group of articles disposed with the carrier. The longitudinal dimension L2 may be defined as the distance between the outermost end of a first endmost article and the outermost end of a second endmost article at an opposing end of the tubular structure. The second longitudinal edge has a length dimension L3 which is less than the longitudinal dimension L2 of a group of articles disposed with the carrier and is greater than the distance L4 between the centre of the first endmost article and the centre of the second endmost article.

The first longitudinal edge H1 may define a rear end horizontal dimension L1 of the secondary carrier. The second longitudinal edge H2 may define a front end horizontal dimension L3 of the secondary carrier. The front end horizontal dimension L3 is less than the rear end horizontal dimension L1. A plurality of secondary carriers may be arranged in a tertiary package or shipping carton such that at least two secondary carriers disposed adjacent to each other are oriented in a back to back relationship such that the shorted front ends of the carrier are disposed outermost.

A package system is disclosed herein (see FIG. 37) that comprises a tertiary shipping carton T, a secondary package in the form of a wrap-around style carrier 790 (see FIG. 34); and a plurality of articles 'B', arranged in groups and held within each secondary carrier 790. The tertiary shipping carton T is formed from a blank constructed from a sheet of suitable substrate, such as the blank shown in FIG. 1; and the secondary carriers 790 are formed from blanks 710; 810 (see FIGS. 33 and 35) constructed from a sheet of suitable substrate.

It is to be understood that, as used herein, the term "suitable substrate" includes all manner of foldable sheet material such as paperboard, corrugated board, fluted board, cardboard, plastic, combinations thereof, and the like that may be coated, uncoated, printed or not printed. It should be recognised that one or other numbers of blanks may be employed, where suitable, for example, to provide the structures described in more detail below. Optionally, the blanks 710; 810 forming the secondary carrier 790 may be formed from a paperboard that is bleached, coated and printed on one surface thereof and which is not bleached, coated or printed on the other (inside) surface thereof ("the brown side") such as, but not limited to, coated recycled board (CRB), clay-coated news back (CCNB), clay-coated kraftboard (CCKB), solid bleached board (SBB) or solid bleached sulphate (SBS). Optionally, the blank forming the shipping carton T may be formed from a corrugated board which provides structural rigidity and stacking strength such that the shipping carton T can accommodate a heavy load of articles.

The packaging structures or carton described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In an illustrated and optional embodiment, the blank 710 is configured to form a wrap-around style carrier 790 for packaging an optional arrangement of articles. In this illustrated embodiment, the arrangement is an m×n×t matrix or array, having one row (m=1), two columns (n=2) and arranged in two tiers (t=2); in the illustrated embodiment four articles are arranged in single row having two tiers of two articles B, and the articles B are individual 5.3 oz cups with a cover or film lid formed from a metallic or plastic material such as, but not limited to, aluminum or PET (polyester-polyethylene terephthalate). The blank 110 is configured to form a wrap-around style carrier (not shown) for packaging an optional arrangement of articles. In this illustrated embodiment, the arrangement is an m×n×t matrix or array, having two rows (m=2), three columns (n=3) and arranged in two tiers (t=2); in the illustrated embodiment twelve articles are arranged in two rows each having two tiers of three articles B, and the articles B are individual 5.3 oz cups with a cover or film lid formed from a metallic or plastic material such as, but not limited to, aluminum or PET (polyester-polyethylene terephthalate). The blanks 710, 810 can be alternatively configured to form a carrier for packaging other types, number and size of article and/or for packaging articles in a different arrangement or configuration.

In the illustrated and optional embodiments, the shipping carton T is configured to accommodate six secondary carriers 790 arranged in a 2×3 matrix or array; and as such the shipping carton T may comprise 24, 5.3 oz cups 'B'. Accordingly, the package system accommodates a significant load.

Figure 33:
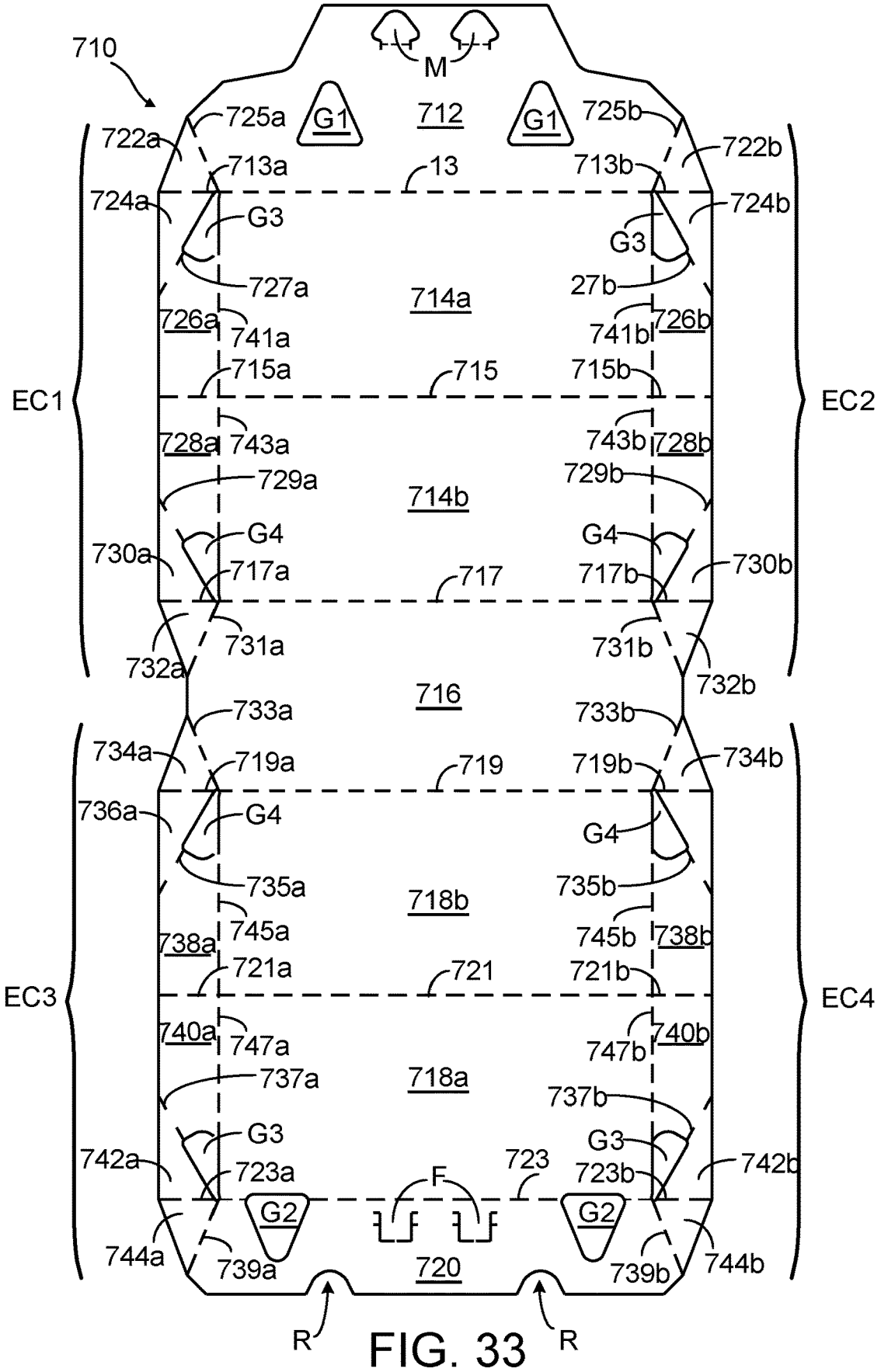
FIG. 33 is a plan view from above of a blank for forming a secondary package or carton according to an eighth embodiment of the disclosure.

Referring now to FIG. 33, there is illustrated a blank 710 for forming a secondary package or article carrier 790 (see FIG. 34) according to a first embodiment. The blank 710 comprises a plurality of main panels 712, 714*a*, 714*b*, 716, 718*b*, 718*a*, 720 for forming a tubular structure. The plurality of main panels 712, 714*a*, 714*b*, 716, 718*b*, 718*a*, 720 comprises a first base panel (or outer layer) 712, a first lower side panel 714*a*, a first upper side panel 714*b*, a top panel 716, a second upper side panel 718*b*, a second lower side panel 718*a* and a second base panel or securing flap (or inner layer) 720. The plurality of panels 712, 714*a*, 714*b*, 716, 718*b*, 718*a*, 720 may be arranged in a linear series hinged one to the next by corresponding fold lines 713, 715, 717, 719, 721, 723.

The term "top panel" as used herein refers to a panel that is placed upon one of the opposite ends of the primary products containers or articles B each having a generally columnar shape. The "top panel" provides a cover over at least a portion of the packaged article B in normal use. The term "base panel" as used herein refers to a panel that is placed below one of the opposite ends of the primary products containers or articles B or below a flange or protrusion of a primary products container or article B such that an upper surface supports the packaged article B in normal use. The primary products containers or articles B which are packaged by the secondary carrier 790 are generally columnar in shape. The term "generally columnar shape" as used herein includes, but is not limited to, a generally truncated conical shape, generally truncated pyramidal shape, generally cylindrical shape, generally prismatic shape and the other similar shapes.

Figure 34:
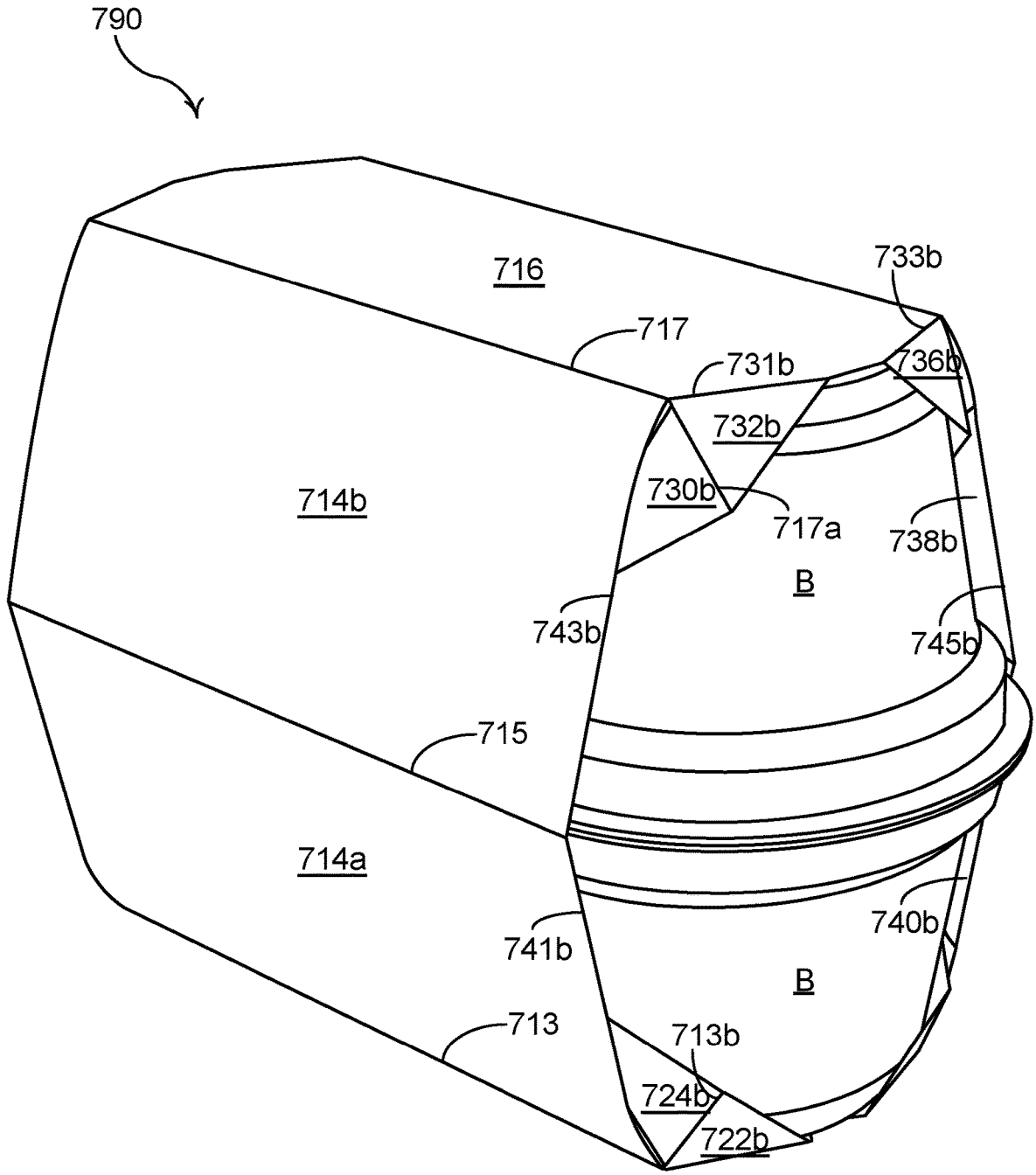
FIG. 34 is a perspective view from above of a secondary package comprising a carrier constructed from the blank of FIG. 33 and loaded with a plurality of primary product containers.

The blank 710 is foldable to form a package 790 as illustrated in FIG. 34. The first and second base panels 712, 720 are engageable with one another in an overlapping relationship to form a composite base wall 712/720 of the carrier 90. The blank 710 may comprise a complementary locking mechanism M/F for securing the first base panel 712 to the second base panel 720. Alternatively, the first and second base panels 712, 720 may be adhesively secured to each other or may be secured by use of a mechanical fixing such as, but not limited to, staples.

The first base panel 712 may comprise at least one first part M of the complementary locking mechanism. The second base panel 720 may comprise at least one second part F of the complementary locking mechanism. In the illustrated embodiment, the first base panel 712 comprises two male tabs M struck therefrom so as to be defined within the first base panel 712. Each of the male tabs M is hingedly connected to the first base panel 712 by a hinged connection in the form of a fold line.

The second part F of the complementary locking mechanism forms a receiver. The receiver comprises an opening or slot for receiving the male tab M.

The second base panel 720 comprises two optional female tabs each defining an opening or slot in the second base panel 720; the female tabs forming at least part of the receiver.

The openings in the second base panel 720 are configured to receive respective ones of the male tabs M.

The female tabs are arranged to be displaced out of the second base panel 720 to form said openings and to bear against the respective male tab M when received therein.

Optionally, the first and second base panels 712, 720 may comprise at least one first aperture G1, G2. In the illustrated embodiment, each of the first and second base panels 712, 720 comprises two first apertures G1, G2. The first apertures G1, G2 may be employed to facilitate construction of the carton 790. A packaging machine component or tool may engage with the first apertures G1, G2 to facilitate alignment of the first and second base panels 712, 720 with respect to each other or to align the first part M of the complementary locking mechanism with the second part F of the complementary locking mechanism. The complementary locking mechanism illustrated and described is entirely optional. Optionally, the second base panel 720 comprises a pair of notches or recesses R each of which is arranged to be aligned with a respective one of the first apertures G1 in the first base panel 712.

The first base panel 712 is shaped at a free side edge so as to comprise a central tongue in which the first parts M of the complementary locking mechanism are provided. In this way the first base panel 712 comprises rebated corners opposing the hinged connection to the first lower side panel 714*a*; the rebated corners are formed from generally step-shaped recesses cut from the free side edge of the first base panel 712. The rebated corners facilitate construction of the composite base panel 712/720, by preventing or reducing the likelihood of the first base panel 712 being disposed in overlapping relationship with portions of the second base panel 720 comprising the first apertures G2.

The first apertures G1 provided in the first base panel 712 are longitudinally offset from the first apertures G2 provided in the second base panel 720.

The first apertures G1 provided in the first base panel 712 are spaced apart from the fold line 713 hingedly connecting the first base panel 712 to the first lower side panel 714*a*.

The first apertures G2 provided in the second base panel 720 interrupt the fold line 723 that hingedly connects the second base panel 720 to the second lower side panel 718*a*.

A central portion of the first base panel 712 extends substantially across the entire width of the composite base panel 712/720.

The first parts M of the complementary locking mechanism are provided proximate to the free side edge of the central tongue of the first base panel 712. The second parts F of the complementary locking mechanism are provided proximate to the fold line 723 hingedly connecting the second base panel 720 to the second lower side panel 718*a*.

The blank 710 is adapted to accommodate four articles B arranged in a 1×2×2 matrix or array.

That is to say, the blank 710 is arranged to accommodate two tiers of two adjacently disposed articles B.

The blank 710 comprises end closure structures for closing each end of the tubular structure formed from the plurality of main panels 712, 714*a*, 714*b*, 716, 718*b*, 718*a*, 720. (The end closure structures are also referred to herein as retaining structures for retaining articles in the tubular structure). Each end closure structure comprises a pair of end retention arrangements EC1, EC3; EC2, EC4 for securing endmost articles B within the carrier 790. The end retention arrangements EC1, EC3; EC2, EC4 comprise a plurality of panels 722A, 724A, 726A, 728A, 730A, 732A; 734A, 736A, 738A, 740A, 742A, 744A; 722B, 724B, 726B, 728B, 730B, 732B; 734B, 736B, 738B, 740B, 742B, 744B adjacent end edges of the blank 710.

Each of the end retention arrangements is substantially the same and will be described in further detail by reference to a first end retention arrangement EC1 adjacent a first end edge of the first side panel 712, first base panel 712 and top panel 716. The first end retention arrangement comprises an anchor tab 726A/728A comprising an upper anchor tab 728A and a lower anchor tab 26A each hingedly connected to a first end of the first side panel 712 by respective hinged connections in the form of fold lines 741A, 743A. The upper anchor tab 728A is hingedly connected to the lower anchor tab 726A by a hinged connection in the form of a fold line 715A. Fold line 715A is arranged to contiguous and collinear with the fold line 715 hinging the first lower side panel 714*a* to the first upper side panel 714*b*.

A lower retention panel 724A is hingedly connected to a lower portion of the lower anchor tab 726A by a hinged connection in the form of a fold line 727A. An upper retention panel 730A is hingedly connected to the upper anchor tab 728A by a hinged connection in the form of a fold line 729A.

The lower retention panel 724A is hingedly connected to a lower web panel 722A by a hinged connection in the form of a fold line 713A. Fold line 713A is arranged to contiguous and collinear with the fold line 713 hinging the first lower side panel 714*a* to the first base panel 712.

The lower web panel 722A is hingedly connected to the first base panel 712 by a hinged connection in the form of a fold line 725A.

The upper retention panel 730A is hingedly connected to an upper web panel 732A by a hinged connection in the form of a fold line 717A. Fold line 717A is arranged to contiguous and collinear with the fold line 717 hinging the first upper side panel 714*b* to the top panel 716.

The upper web panel 732A is hingedly connected to the top panel 716 by a hinged connection in the form of a fold line 731A.

Optionally, a first relief aperture G3 may be struck from material of the blank 710 which would otherwise form the lower retention panel 714A and the lower anchor tab 726A. The first relief aperture G3 interrupts the fold lines 713, 713A, 725A and 727A to provide a relief device at the notional point of intersection of fold lines 713, 713A, 725A and 727A so as to facilitate folding of the first end retention arrangement EC1.

Optionally, a second relief aperture G4 may be struck from material of the blank 710 which would otherwise form the upper retention panel 730A and the upper anchor tab 728A. The second relief aperture G4 interrupts the fold lines 717, 717A, 729A and 731A to provide a relief device at the notional point of intersection of fold lines 717, 717A, 729A and 731A so as to facilitate folding of the first end retention arrangement.

Optionally, the first and second relief apertures G3, G4 are tapered for example but not limited to tear drop shaped.

Turning to the construction of the article carrier 790 as illustrated in FIG. 34, the article carrier 790 may be formed by a series of sequential folding operations in a straight-line machine so that the article carrier 790 is not required to be rotated or inverted to complete its construction. The folding process is not limited to that described below and may be altered according to particular manufacturing requirements.

A group of articles B is assembled; in the embodiment illustrated in FIG. 34 four articles B are arranged in two tiers of two articles. The upper tier of articles B are inverted with respect to the lower tier. In this way a lid or cover of each article in the upper tier is disposed upon a lid or cover of a respective one of the articles in the lower tier. In embodiments where the articles B have a tapered or conical shape, the article group is arranged to be widest at the middle and narrower at the ends. The top panel 716 of the blank 710 is disposed above the group of articles B to provide a top wall 16 of the article carrier 790.

First and second side walls 714*a*/714*b*, 718*a*/718*b* are formed by folding the first upper and first lower side panels 714*b*, 714*a* and the second upper and second lower side panels 718*b*, 718*a* with respect to the top panel 716; by folding said panels 714*b*, 714*a*, 718*b*, 718*a* about fold lines 717, 719 respectively, about opposing sides of the group of articles B so as to be disposed about the opposing sides of the group of articles B, as shown in FIG. 34.

During the process of folding the first upper and lower side panels 714*b*, 714*a* and second upper and lower side panels 718*b*, 718*a* about the opposing sides of the article group, the anchor tabs 726A/728A, 726B/728B, 738A/740A, 38B/40B are folded about fold lines 741A, 743A, 741B, 743B, 745A, 747A, 745B, 47B respectively to be brought into face to face relationship with the respective one of the first and second side walls 714*a*/714*b*, 718*a*/718*b* to which they are hinged. The upper anchor tabs 728A, 728B are brought into face to face relationship with the first upper side panel 714*b*. The upper anchor tabs 738A, 738B are brought into face to face relationship with the second upper side panel 718*b*. The lower anchor tabs 726A, 726B are brought into face to face relationship with the first lower side panel 714*a*. The lower anchor tabs 740A, 740B are brought into face to face relationship with the second lower side panel 718*a*.

The upper retention panels 30A, 30B, 36A, 36B and upper web panels 732A, 732B, 734A, 734B are folded automatically about upper portions of the endmost articles B in the upper tier of the article group to secure said articles B in the carrier 90. The lower retention panels 724A, 724B, 742A, 742B are partially folded automatically about lower portions of the endmost articles B in the lower tier of the article group.

The first lower side panel 714*a* is folded with respect to the first upper side panel 714*b* about fold line 715.

The second lower side panel 718*a* is folded with respect to the second upper side panel 718*b* about fold line 721.

In alternative embodiments, the fold lines 715, 721 may be omitted, the first and second side walls may be deformed or bowed to form convex surfaces when viewed from an external point of view.

The second base panel 720 is folded about fold line 723 into proximity with the base of the article group, the first base panel 712 is folded about fold line 713 into proximity with the base of the article group so as to be in at least partial overlapping relationship with the second base panel 720. In doing so the lower retention panels 724A, 724B, 742A, 742B and lower web panels 722A, 722B, 744A, 744B are folded automatically about lower portions of the endmost articles B in the lower tier of the article group to secure said articles B in the carrier 790.

The first parts M of the complementary locking mechanism is engaged with respective second parts F of the complementary locking mechanism to secure the first base panel 712 and the second base panel 720 together.

The assembled article carrier 790 is shown in FIG. 34.

A flange of each article B in the upper tier is disposed proximate a flange of an article B in the lower tier upon which the upper article B is disposed. The first and second side walls 714*a*/714*b*, 718*a*/718*b* are deformed or folded about said flanges. In embodiments in which the first and second side walls 714*a*/714*b*, 718*a*/718*b* comprise upper side panels 714*b*, 718*b* and lower side panels 714*a*, 718*a* the first and second side walls 714*a*/714*b*, 718*a*/718*b* are arranged such that the fold lines 715, 721 are adjacent to the flanges of the articles B.

Figure 36:
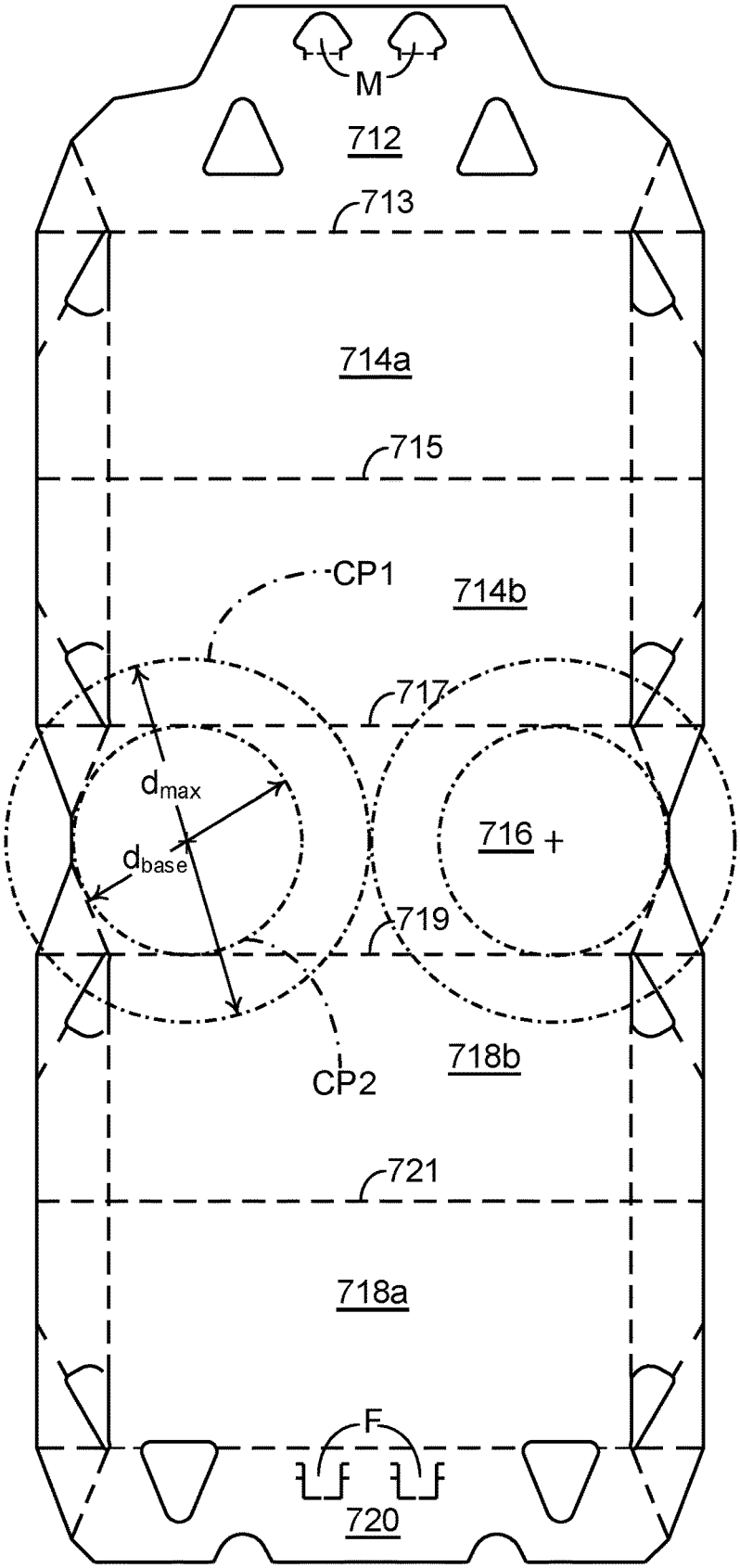
FIG. 36 is a plan view from above of the blank of FIG. 33 showing the position and/or alignment of articles with respect to a top panel of the blank.

In the illustrated embodiment the articles B are disconnected or individual cups which are disposed in close proximity to their adjacent neighbours. The articles B are tapered in shape, they can be considered to be substantially frusto-conical in shape, albeit inverted, when in normal use. The articles B comprise a maximum lateral dimension or diameter $d_{max}$ (see FIG. 36), in the illustrated embodiment the maximum lateral dimension is provided at or by an upper end or top of the articles B. The articles B comprise a base having lateral dimension or diameter $d_{base}$. The articles B in the lower tier are arranged such that the end having the smaller diameter is disposed in closer proximity to the composite base panel 712/720 and the end having the larger diameter is disposed in closer proximity to the top panel 716. The articles B in the upper tier are arranged such that the end having the smaller diameter is disposed in closer proximity to the top panel 716 and the end having the larger diameter is disposed in closer proximity to the composite base panel 712/720.

A void or gap exists between lower portions of two adjacent articles B in the lower tier. This void or gap may receive at least portions of the complementary locking mechanism.

The end retention arrangements EC1, EC3; EC2, EC4 facilitate retention of the articles B within the article carrier 90 preventing or inhibiting unintentional egress of the articles B from the article carrier 790.

The article carrier 790 comprises a tubular structure having two opposed open ends which are partially closed by the end retention arrangements EC1, EC3; EC2, EC4.

The top panel 716 comprises a pair of opposed end edges. Each of the pair of opposed end edges is tapered towards each of the hinged connections 717, 719 to the first and second side wall 714*a*/714*b*, 18*a*/18*b*. In this way the top panel 716 is longer in dimension at its middle than at each of the hinged edges, defined by fold line 717, 719. A central portion of the top panel 16 is longer than each of the first and second side wall 714*a*/714*b*, 718*a*/718*b*.

Figure 38:
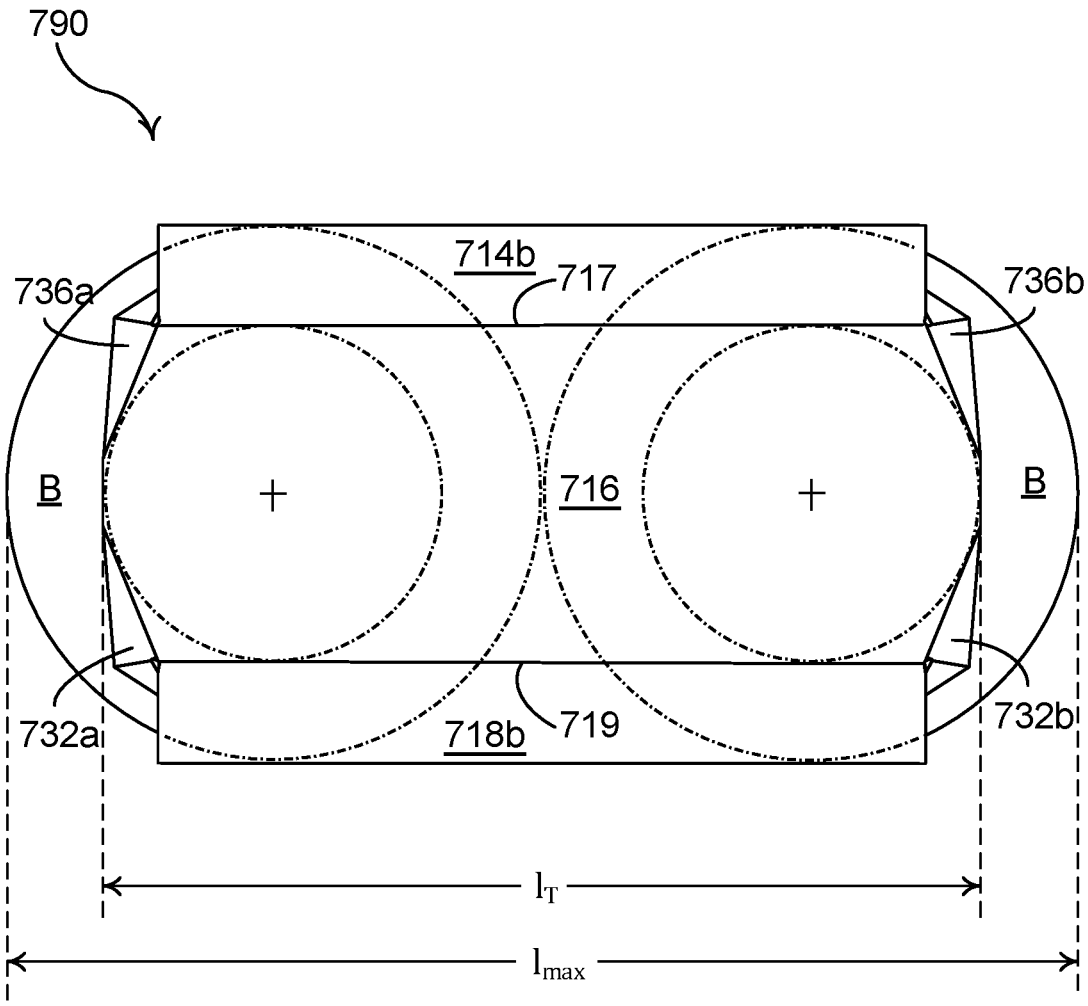
FIG. 38 is a plan view from above of the secondary package of FIG. 34.

The top panel 716 is configured to cover substantially all of the uppermost end of the articles B in the upper tier, this being the end of the articles B having the smaller lateral dimension or diameter, best illustrated in FIG. 38.

Similarly, the composite base panel 712/720 is configured to cover substantially all of the lowermost end of the articles B in the lower tier, again this being the end of the articles B having the smaller lateral dimension or diameter.

The central portion of the top panel 716 defines a maximum longitudinal dimension $l_T$ of the carrier 790 in a set up condition.

The article group comprises a maximum longitudinal dimension $l_{max}$ which is given by $n \times d_{max}$; where n is an integer number of articles, given by the number of columns of articles and $d_{max}$ is the maximum lateral dimension or diameter of the articles B.

The dimension $l_{max}$ is greater than the maximum longitudinal dimension $l_T$ of the carrier 790 in a set up condition. In this way and end-to-end length of each of the top, base and opposed side panels is less than a maximum end-to-end length of the group of articles.

The carton 790 is configured such that a portion of each endmost article B projects or extends beyond a respective one of the opposed end edges.

Figure 37:
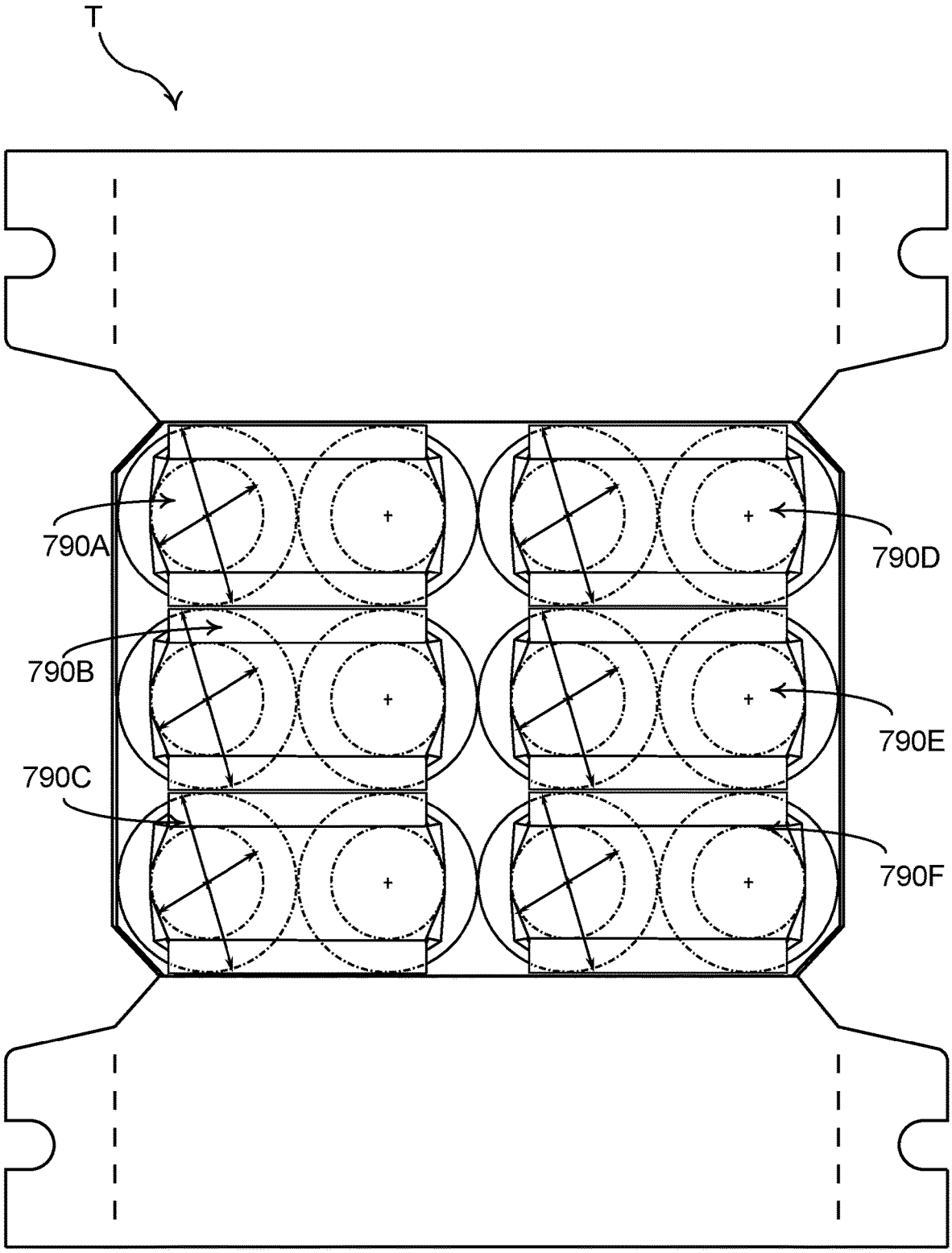
FIG. 37 is a plan view from above a partially assembled package system comprising a shipping carton, loaded with an arrangement of a plurality of secondary packages of FIG. 34 (each secondary carrier being loaded with a plurality of primary product containers)

FIG. 37 illustrates a plurality of article carriers 790 within the shipping carton T. In the illustrated embodiment six article carriers 790A, 790B, 790C, 790D, 790E, 790F are provided within the shipping carton T.

The shipping carton T comprises three rows of two secondary packages 790.

The shipping carton T can form a close or snug fit with the exposed portions of the endmost articles B. In some embodiments the end wall and/or beveled corner panel of the shipping carton 790 may be contactable with the exposed portion of the endmost article B.

Figure 35:
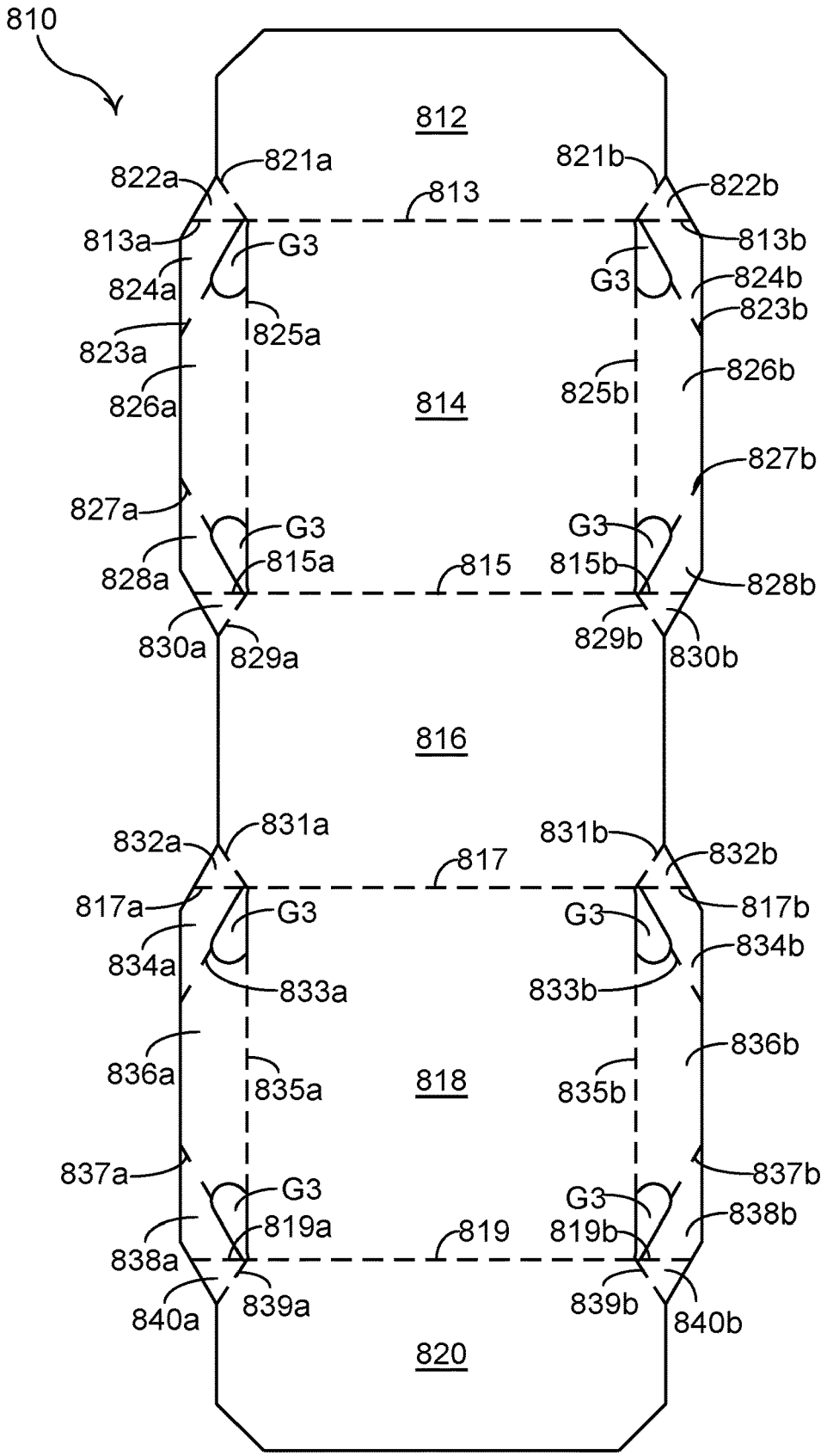
FIG. 35 is a plan view from above of a blank for forming a carrier of a secondary package according to a ninth embodiment of the disclosure.

Referring now to FIG. 35 there is shown a ninth embodiment of the present disclosure. In the ninth illustrated embodiment, like numerals have, where possible, been used to denote like parts, albeit with the addition of the prefix "800" to indicate that these features belong to the ninth embodiment. The ninth embodiment shares many common features with the embodiment of FIGS. 33 and 34, therefore only the differences from the embodiment illustrated in FIGS. 33 and 34 will be described in any greater detail.

FIG. 35 illustrates a blank 810 for forming a secondary package or article carrier (not shown) according to a second embodiment. The blank 810 comprises a plurality of main panels 812, 814, 816, 818, 820 for forming a tubular structure. The plurality of main panels 812, 814, 816, 818, 820 comprises a first base panel (or outer layer) 812, a first side panel 814, a top panel 816, a second side panel 818 and a second base panel or securing flap (or inner layer) 820. The plurality of panels 812, 814, 816, 818, 820 may be arranged in a linear series hinged one to the next by corresponding fold lines 813, 815, 817, 819.

The blank 810 is foldable to form a package; the first and second base panels 812, 820 are engageable with one another in an overlapping relationship to form a composite base wall 812/820 of the carrier.

An article carrier can be constructed by employing a series of sequential folding operations similar to that described above in relation to the blank 10 of FIG. 1.

The complementary locking mechanism M/F and the first apertures A1, A2 have been omitted as have the fold lines dividing the side walls into upper and lower panels. These features may be included in other embodiments.

The top panel 816 and the first and second base panels 812/820 are adapted to accommodate two rows of articles B, each row comprising six articles B arranged in two tiers or three articles B.

The end closure structures hinged to the first side panel 814 engage an endmost article in each tier disposed adjacent to the first side panel 814. The end closure structures hinged to the second side panel 818 engage an endmost article in each tier disposed adjacent to the second side panel 818.

The tertiary shipping carton T (shown in FIG. 37) comprises opposed side walls to each of which a lid panel is hinged, opposed end walls and four corner or bevel panels each of which couples an end wall to one of the side walls. The secondary packaging containers 90 are shaped to be arranged to fit internally of and fit snugly with the bevelled corner structures of the tertiary shipping carton T. Multiple tertiary shipping cartons T can be stacked one on top of the next due to the robust and strong structure. The stacking strength of the tertiary shipping cartons T may be enhanced by the provision of the beveled corner structures.

Figure 39:
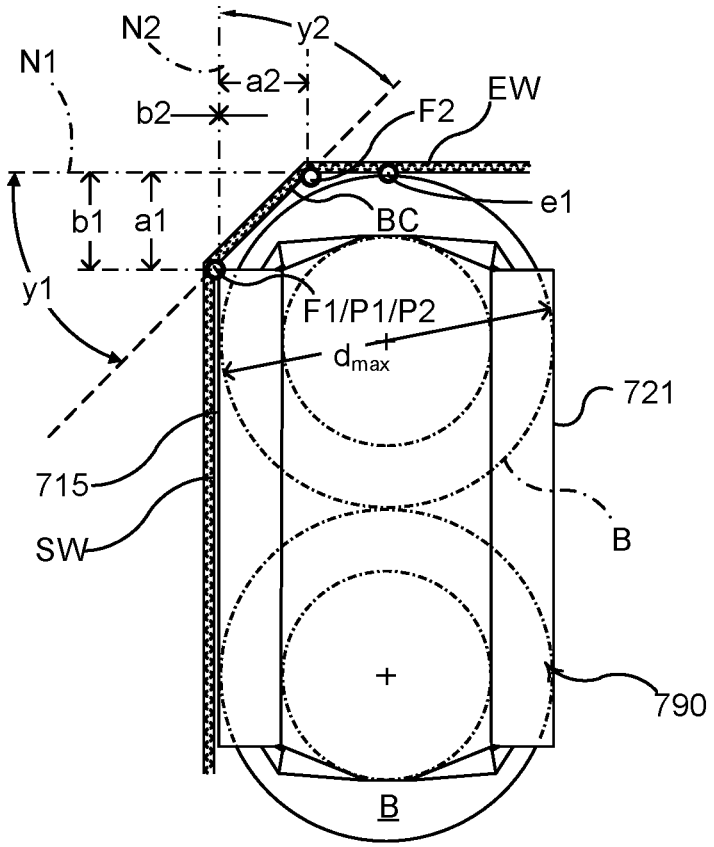
FIG. 39 is an enlarged plan view from above of a portion of the arrangement shown in FIG. 37.

Referring to FIG. 39 there is shown a portion of the tertiary carton T of FIG. 37, which tertiary carton T is loaded with six secondary cartons 790A to 790F, only one of which is shown in FIG. 39.

An inside surface of a first end wall EW lies on or defines a first notional plane N1. A fold line F1 between a corner panel BC and a first side wall SW is spaced a distance a1 from the first notional plane N1 containing the inside surface of the first end wall EW.

An inside surface of a first side wall SW lies on or defines a second notional plane N2. A fold line F2 between the corner panel BC and the first end wall EW is spaced a distance a2 from the second notional plane N2 containing the inside surface of the first side wall SW.

The first notional line N1 defines a first angle y1 with the corner panel BC. The second notional line N2 defines a second angle y2 with the corner panel BC. The first angle y1 is equal to the second angle y2. The second angle y2 is 45°. The first angle y1 is 45°.

The secondary package 790 comprises a terminal end e1, the terminal end e1 is disposed facing the inside surface of the first end wall EW. The terminal end e1 of secondary package 90 is provided by a protruding portion of an endmost article B. A tubular axis of the secondary carton 790 extends generally perpendicularly to the first end wall EW. One of the carton side panels 714 of the secondary carton 790 is in contact with, or close proximity to, the first side wall SW, in particular the fold line 715 is disposed contact with, or close proximity to, the first side wall SW. The secondary carton 790 comprises one or more primary containers each of which is disposed with their cylindrical axes extending generally perpendicularly to the bottom panel of the tertiary package T.

The terminal end e1 of the secondary package 90 lies on or defines a third notional plane.

The secondary package 790 comprises a maximum width point P1 along an end edge of the one carton side panel 714 adjacent to the corner panel BC.

The maximum width point P1 defines the maximum width of the secondary carton 790 extending between itself and a point on the other carton side panel 718 of the secondary carton 790. The notional plane containing the terminal end e1 is parallel to or contains the inside surface of the first end wall EW.

The maximum width point P1 of the secondary package 790 is spaced a distance b1 from the third notional plane containing the terminal end e1 of the secondary package 790.

The maximum width point P1 is adjacent to the first fold line F1, the maximum width point P1 being substantially coincident with the first fold line F1.

The secondary package 790 is in contact with the corner panel or closer to the corner panel than any other points on the corner panel at a second point P2.

The second point P2 of the secondary package 90 lies on or defines a fourth notional plane which is spaced apart from the second notional plane N2 by distance b2. In the illustrated embodiment the distance b2 is zero or is approaching zero. The distance a2 may be equal to or greater than the distance b2, (a2≥b2).

In the embodiment of FIG. 39 the distance a2 is greater than the distance b2. The distance a1 is equal to the distance b1.

The second point P2 is coincident with the maximum width point P1.

The present disclosure provides a secondary carrier 790 having a tubular structure having first open end and a second opposing open end. The carrier 790 is configured to expose a portion of a first article B at the first end of the carrier and to expose a portion of a second article B at the second end of the carrier.

The secondary carrier 790 can be placed within tertiary package T having mitred or beveled corner provided by one or more corner panels. The secondary carriers can be loaded such that one of the first or second articles is disposed in close proximity to or touching contact with one of the corner panels of the tertiary package. In some embodiments at least four secondary carriers are loaded into a tertiary package. The secondary carriers are arranged such that an endmost article from each secondary carrier is disposed close proximity to or touching contact with a respective one of each of the corner panels of the tertiary package.

It can be appreciated that various changes may be made within the scope of the present disclosure. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "aligned with" or "alignment with" as used herein refers to the alignment or registry of two or more elements in an erected carton, such as an aperture formed in a first of two overlapping panels and a second aperture formed in a second of two overlapping panels. Those elements in alignment with each other may be aligned with each other in the direction of the thickness of the overlapping panels. For example, when an aperture in a first panel is "in alignment with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A combination of a tertiary carton and a plurality of packages received in the tertiary carton, wherein the tertiary carton comprises:

a bottom panel and a plurality of side and end panels each extending upward from the bottom panel to form side and end walls, the plurality of side and end walls including a first side wall and a first end wall disposed at about a right angle with respect to one another, and a bevelled corner panel hingedly connected by respective fold lines between the first side wall and the first end wall, the plurality of packages comprising:

a corner package which comprises a secondary carton having a tubular structure and one or more generally cylindrical primary containers each received at least in part in the secondary carton, the tubular structure comprising a pair of opposing carton side panels, wherein the corner package is disposed with a terminal end thereof facing an inside surface of the first end wall with a tubular axis of the secondary carton thereof extending generally perpendicularly to the first end wall, wherein the secondary carton of the corner package is in contact at one of the carton side panels thereof with the first side wall, and wherein the one or more primary containers of the corner package each is disposed with a cylindrical axis thereof extending generally perpendicularly to the bottom panel, the combination being characterized by formulae as follows:

$$a1 \leq (1/2)*d,\ a2 \leq (1/2)*d, \text{ and } a1 \leq b1,$$

where "d" is a maximum diameter or maximum lateral size of each of the one or more primary containers, "a1" is the distance between a notional plane containing the inside surface of the first end wall and a fold line between the corner panel and the first side wall, "a2" is the distance between a notional plane containing the inside surface of the first side wall and a fold line between the corner panel and the first end wall, and "b1" is the distance between a notional plane containing the terminal end of the corner package and a maximum width point along an end edge of one of the pair of carton side panels that is adjacent to the corner panel, the maximum width point defining a maximum width of the secondary carton extending between the maximum width point and a point on the other of the pair of carton side panels of the secondary carton, wherein the notional plane containing the terminal end is parallel to or contains the inside surface of the first end wall.

2. The combination of claim 1 wherein the formulae further comprises:

$$a2 \geq b2$$

wherein "b2" is a distance between a notional plane containing the maximum width point and a second point on the corner package, wherein the notional plane containing the maximum width point is parallel to or contains the inside surface of the first side wall, the second point being spaced apart from the maximum width point and being either in contact with the corner panel or closer to the corner panel than any other points on the corner package excluding the maximum width point.

3. The combination of claim 2 wherein the secondary carton of the corner package comprises a bevelled corner edge extending at least from the maximum width point to the second point.

4. The combination of claim 3 wherein the bevelled corner edge comprises a top panel of the secondary carton of the corner package wherein a retention panel for engaging a primary container is hingedly connected to the bevelled corner edge.

5. The combination of claim 3 wherein the bevelled corner edge comprises a base panel of the secondary carton of the corner package wherein an opening for receiving a primary container is defined in the base panel.

6. The combination of claim 3 wherein the bevelled corner edge is parallel to or in contact with the corner panel.

7. The combination of claim 2 wherein the second point on the corner package is located on a corner primary container of the corner package.

8. The combination of claim 1 wherein the formulae further comprise:

$$a1 \leq (0.3)*d.$$

9. The combination of claim 1 wherein the maximum diameter or maximum lateral size of each of the one or more primary containers is defined by a cross section of a shape selected from the group consisting of a circle, an ellipse, a squircle and a rounded rectangle.

10. The combination of claim 3 wherein the bevelled corner edge defines an angle with respect to the notional plane containing the maximum width point that is equal to or greater than 10 degrees.

11. The combination of claim 10 wherein the corner panel defines an angle with respect to the notional plane containing the inside surface of the first side wall that is equal to or greater than the angle defined by the bevelled corner edge with respect to the notional plane containing the maximum width point.

12. The combination of claim 11 wherein the corner panel defines an angle with respect to the notional plane containing the inside surface of the first end wall that is equal to or greater than the angle defined by the corner panel with respect to the notional plane containing the inside surface of the first side wall.

13. The combination of claim 1 wherein the maximum width point is either in contact with the first side wall of the tertiary carton or is located adjacent to the fold line between the corner panel and the first side wall.

14. The combination of claim 1 wherein the terminal end of the corner package is in contact with the first end wall.

15. The combination of claim 2 wherein the second point on the corner package is either in contact with the corner panel and located between the fold line between the corner panel and the first side wall and the fold line between the corner panel and the first end wall or is located adjacent to the fold line between the corner panel and the first end wall.

* * * * *